US005342716A

United States Patent [19]

Kato et al.

[11] Patent Number: 5,342,716

[45] Date of Patent: Aug. 30, 1994

[54] ELECTROPHOTOGRAPHIC LITHOGRAPHIC PRINTING PLATE PRECURSOR

[75] Inventors: Eiichi Kato; Seishi Kasai, both of Shizuoka, Japan

[73] Assignee: Fuji Photo Film Co., Ltd., Kanagawa, Japan

[21] Appl. No.: 946,320

[22] PCT Filed: Feb. 21, 1992

[86] PCT No.: PCT/JP92/00188

§ 371 Date: Oct. 22, 1992

§ 102(e) Date: Oct. 22, 1992

[87] PCT Pub. No.: WO92/15048

PCT Pub. Date: Sep. 3, 1992

[30] Foreign Application Priority Data

| | | | |
|---|---|---|---|
| Feb. 22, 1991 | [JP] | Japan | 3-78711 |
| Mar. 19, 1991 | [JP] | Japan | 3-78175 |
| Apr. 2, 1991 | [JP] | Japan | 3-94886 |
| May 31, 1991 | [JP] | Japan | 3-156246 |

[51] Int. Cl.[5] ..... G03G 5/05

[52] U.S. Cl. ..... 430/49; 430/96

[58] Field of Search ..... 430/49, 96, 87

[56] References Cited

U.S. PATENT DOCUMENTS

| | | | |
|---|---|---|---|
| 4,960,661 | 10/1990 | Kato et al. | 430/49 |
| 4,971,870 | 11/1990 | Kato et al. | 430/49 |
| 5,017,448 | 5/1991 | Kato et al. | 430/49 |
| 5,077,165 | 12/1991 | Kato et al. | 430/49 |
| 5,229,240 | 7/1993 | Kato et al. | 430/96 |
| 5,229,241 | 7/1993 | Kato et al. | 430/96 |

*Primary Examiner*—John Goodrow

*Attorney, Agent, or Firm*—Sughrue, Mion, Zinn, Macpeak & Seas

[57] ABSTRACT

An electrophotographic lithographic printing plate precursor having a photoconductive layer containing resin (A) having a weight average molecular weight of from $1\times10^3$ to $2\times10^4$ and containing a polymer component of the specified repeating unit and a polymer component having a polar group and dispersed resin grain (L) which is obtained by dispersion polymerization of monomer (C) containing a functional group capable of forming a carboxy group upon decomposition in the presence of a dispersion stabilizing resin soluble in a non-aqueous solvent and which has a silicon and/or fluorine atom-containing substituent.

The electrophotographic lithographic printing plate precursor has good electrophotographic characteristics and water retentivity due to the suitable interaction between zinc oxide, a spectral sensitizing dye, the resin (A) and the dispersed resin grain (L) and provides a printing plater having excellent printing image and good printing durability even under severe conditions. Also, it is advantageously employed in the scanning exposure system using a semiconductor laser beam.

8 Claims, No Drawings

ELECTROPHOTOGRAPHIC LITHOGRAPHIC PRINTING PLATE PRECURSOR

TECHNICAL FIELD

The present invention relates to an electrophotographic lithographic printing plate precursor for producing a printing plate through electrophotography and, more particularly, to an improvement in a composition for forming a photoconductive layer of the electrophotographic lithographic printing plate precursor.

TECHNICAL BACKGROUND

Various kinds of offset printing plate precursors for directly producing printing plates have hitherto been proposed, and some of which have already been put into practical use. A widely employed precursor is a light-sensitive material having a photoconductive layer comprising photoconductive particles such as zinc oxide particles and a binder resin provided on a conductive support. A highly lipophilic toner image is subsequently formed on the photoconductive layer surface by an ordinary electrophotographic process. The surface of the photoconductive layer having the toner image is then treated with an oil-desensitizing solution, called an etching solution, to selectively render the non-image areas hydrophilic thereby producing an offset printing plate.

In order to obtain satisfactory prints, an offset printing plate precursor or light-sensitive material must faithfully reproduce an original on the surface thereof; the surface of the light-sensitive material should have a high affinity for an oil-desensitizing solution so as to render non-image areas sufficiently hydrophilic and, at the same time, should be water resistant. When used as printing plate, the photoconductive layer having a toner image formed thereon should not come off during printing, and should be well receptive to dampening water so that the non-image areas can remain sufficiently hydrophilic to be free from stains, even after a large number of prints have been reproduced from the plate. These properties are greatly affected by a binder resin used in the photoconductive layer as already known. With respect to offset masters, various binder resins for zinc oxide have been investigated particularly for the purpose of improving the oil-desensitivity. Specifically, copolymers containing at least methacrylate (or acrylate) components, for example, those described in JP-B-50-31011 (the term "JP-B" as used herein means an "examined Japanese patent publication"), JP-A-53-54027 (the term "JP-A" as used herein means an "unexamined published Japanese patent application"), JP-A-57--202544 and JP-A-58-68046 are known.

On the other hand, resins of the type which contain functional groups capable of producing hydrophilic groups through decomposition have been investigated on an aptitude for the resin binder. For example, the resins containing functional groups capable of producing carboxy groups through decomposition as described in U.S. Pat. Nos. 4,792,511 and 4,910,112 and JP-A-62-286064, and the resins containing functional groups capable of producing carboxy groups through decomposition and having a crosslinking structure therebetween which restrains the solubility thereof in water and impart water swellability thereto, whereby the prevention of background stains and the printing durability are furthermore improved as described in U.S. Pat. Nos. 4,960,661 and 5,017,448 are known.

However, when these resins are practically employed as binder resins for lithographic printing plate precursors, they are still insufficient with respect to the background stains and printing durability.

Moreover, addition of resin grains containing functional groups capable of producing carboxy groups through decomposition to the photoconductive layer for the purpose of improving the water retentivity is described in U.S. Pat. No. 4,971,870.

PROBLEMS TO BE SOLVED BY THE INVENTION

As a result of the detailed investigations on properties of the lithographic printing plate precursor, however, it has been found that the electrophotographic characteristics (particularly, dark charge retention property and photosensitivity) are fluctuated and good duplicated images can not be stably obtained sometimes in a case wherein the environmental conditions at the image formation are changed to high temperature and high humidity or to low temperature and low humidity. Consequently, the printing plate precursor provides prints of poor image or having background stains.

Further, when a scanning exposure system using a semiconductor laser beam is applied to digital direct type electrophotographic lithographic printing plate precursor, the exposure time becomes longer and also there is a restriction on the exposure intensity as compared to a conventional overall simultaneous exposure system using a visible light, and hence a higher performance has been required for the electrostatic characteristics, in particular, the dark charge retention property and photosensitivity.

However, when the above-described lithographic printing plate precursors containing known resins are employed in the scanning exposure system described above, the electrophotographic characteristics degrade, and the occurrence of background fog, cutting of fine lines and spread of letters are observed in the duplicated image obtained. As a result, when they are employed as printing plates, the image quality of prints obtained becomes poor, and the effect of preventing background stains owing to the increase in hydrophilic property in the non-image areas due to the binder resin is lost.

The present invention has been made for solving the problems of conventional electrophotographic lithographic printing plate precursors as described above.

Therefore, an object of the present invention is to provide an electrophotographic lithographic printing plate precursor having excellent electrostatic characteristics (particularly, dark charge retention property and photosensitivity) capable of reproducing a faithfully duplicated image to the original, and excellent oil-desensitivity forming neither overall background stains nor dotted background stains on prints.

Another object of the present invention is to provide an electrophotographic lithographic printing plate precursor providing clear and good images even when the environmental conditions during the formation of duplicated images are changed to low-temperature and low-humidity or to high-temperature and high-humidity.

A further object of the present invention is to provide an electrophotographic lithographic printing plate precursor being hardly affected by the kind of sensitizing dye to be used and having excellent electrostatic characteristics even in a scanning exposure system using a semiconductor laser beam.

Other objects of the present invention will be apparent from the following description.

DISCLOSURE OF THE INVENTION

These objects of the present invention can be accomplished by an electrophotographic lithographic printing plate precursor comprising a conductive support having provided thereon at least one photoconductive layer containing photoconductive zinc oxide, a spectral sensitizing dye and a binder resin, wherein the binder resin of the photoconductive layer comprises at least one resin (A) described below and the photoconductive layer further contains at least one non-aqueous solvent dispersed resin grain (L) described below having a grain diameter equivalent to or smaller than the maximum grain diameter of the photoconductive zinc oxide grain.

Resin (A)

Resin having a weight average molecular weight of from $1\times10^3$ to $2\times10^4$ and containing not less than 30% by weight of a polymer component corresponding to a repeating unit represented by the general formula (I) described below and from 0.5 to 15% by weight of a polymer component having at least one polar group selected from the group consisting of $-PO_3H_2$, $-SO_3H$, $-COOH$,

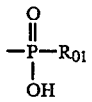

(wherein $R_{01}$ represents a hydrocarbon group or $-OR_{02}$ (wherein $R_{02}$ represents a hydrocarbon group)) and a cyclic acid anhydride-containing group,

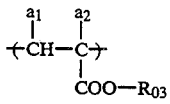

Formula (I)

wherein $a_1$ and $a_2$ each represents a hydrogen atom, a halogen atom, a cyano group or a hydrocarbon group; and $R_{03}$ represents a hydrocarbon group;

Non-aqueous Solvent Dispersed Resin Grain (L)

Polymer resin grain obtained by subjecting, to a dispersion polymerization reaction in a non-aqueous solvent, a monofunctional monomer (C) which is soluble in the non-aqueous solvent but becomes insoluble in the non-aqueous solvent by being polymerized and contains at least one functional group capable of forming at least one carboxy group upon decomposition, in the presence of a dispersion stabilizing resin which is soluble in the non-aqueous solvent, wherein the dispersion polymerization reaction is conducted under condition that the dispersion stabilizing resin contains a repeating unit having a silicon and/or fluorine atom-containing substituent and/or that a monofunctional monomer (D) which is copolymerizable with the monofunctional monomer (C) and which has a silicon and/or fluorine atom-containing substituent is additionally coexistent.

According to a preferred embodiment of the present invention, the resin (A) contains, as the polymer component represented by the general formula (I), at least one methacrylate component having an aryl group represented by the following general formula (Ia) or (Ib):

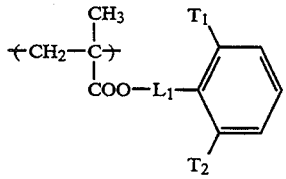

Formula (Ia)

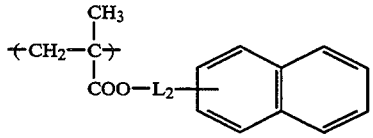

Formula (Ib)

wherein $T_1$ and $T_2$ each represents a hydrogen atom, a halogen atom, a hydrocarbon group having from 1 to 10 carbon atoms, $-COR_{04}$ or $-COOR_{05}$, wherein $R_{04}$ and $R_{05}$ each represents a hydrocarbon group having from 1 to 10 carbon atoms; and $L_1$ and $L_2$ each represents a mere bond or a linking group containing from 1 to 4 linking atoms, which connects —COO— and the benzene ring.

According to another preferred embodiment of the present invention, the non-aqueous solvent dispersed resin grain (L) has a network structure of high order.

According to a further preferred embodiment of the present invention, the dispersion stabilizing resin has at least one polymerizable double bond group moiety represented by the following general formula (II):

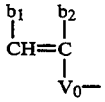

Formula (II)

wherein $V_0$ represents —O—, —COO—, —OCO—, $-(CH_2)_p-OCO-$, $-(CH_2)_p-COO-$, $-SO_2-$,

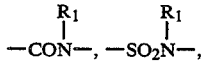

$-C_6H_4-$, —CONHCOO— or —CONHCONH— (wherein p represents an integer of from 1 to 4; and $R_1$ represents a hydrogen atom or a hydrocarbon group having from 1 to 18 carbon atoms); and $b_1$ and $b_2$, which may be the same or different, each represents a hydrogen atom, a halogen atom, a cyano group, a hydrocarbon group, $-COO-R_2-$ or $-COO-R_2$ bonded via a hydrocarbon group (wherein $R_2$ represents a hydrogen atom or an optionally substituted hydrocarbon group).

The electrophotographic lithographic printing plate precursor of the present invention is one having a photoconductive layer containing at least photoconductive zinc oxide, a spectral sensitizing dye and a binder resin as the uppermost layer and being suitable for a system wherein after the formation of image on the photoconductive layer, the photoconductive layer is subjected to an oil-desensitizing treatment to selectively render the surface of non-image areas hydrophilic thereby producing a lithographic printing plate.

The photoconductive layer of the lithographic printing plate precursor according to the present invention is characterized by comprising at least photoconductive zinc oxide, a spectral sensitizing dye, the low molecular weight resin (A) containing the specified polar group and the non-aqueous solvent dispersed resin grain (L) having a functional group capable of forming a carboxy group upon decomposition and a silicon and/or fluorine atom.

It has surprisingly found that both the excellent electrostatic characteristics and properties for printing plate, for example, remarkably improved water retentivity and printing durability can be obtained by employing the resin (A) and the resin grain (L) in combination.

The resin grain (L) which can be used in the present invention has a grain diameter equivalent to or smaller than the maximum grain diameter of photoconductive zinc oxide grain. The resin grain (L) is further characterized in that the distribution of grain diameter thereof is narrow and the grain diameter thereof is uniform. Moreover, the resin grain (L) has the features that it has a substituent containing a silicon and/or fluorine atom and is concentrated in the surface portion of the photoconductive layer and that the functional group thereof is subjected to a chemical reaction such as hydrolysis reaction, redox reaction or photodecomposition reaction during the oil-desensitizing treatment to form a carboxy group whereby it changes from hydrophobic to hydrophilic.

The resin (A) which is another important element of the photoconductive layer according to the present invention is characterized in that it is a low molecular weight polymer containing the polymer component represented by the general formula (I) and the specified polar group.

In the photoconductive layer according to the present invention, photoconductive zinc oxide grains, spectral sensitizing dyes and the resin grains (L) are dispersed in the resin (A) contained as the binder resin. The resin grains (L) are rather concentrated in the surface portion of the photoconductive layer. More specifically, in the dispersion-of photoconductive zinc oxide grains, spectral sensitizing dyes and the resin grains (L) in the resin (A), the resin (A) having a low molecular weight and the specified polar group is adsorbed on the stoichiometric defect of photoconductive zinc oxide and functions to maintain the adequate interaction between zinc oxide and sensitizing dye. Thus, the traps of photoconductive zinc oxide are sufficiently compensated and the humidity characteristics thereof are greatly improved. Further, photoconductive zinc oxide grains are sufficiently dispersed in the binder resin to restrain the occurrence of aggregation of zinc oxide grains.

In a system wherein a conventional binder resin is employed, satisfactory electrophotographic characteristics can not be obtained sometimes because of the hindrance to the interaction such as adsorption, when the spectral sensitizing dye used is changed from one to another. On the contrary, the resin (A) according to the present invention provides the excellent electrophotographic characteristics even when a dye suitable for spectral sensitization of zinc oxide to a semiconductor laser beam is employed.

It is important for an electrophotographic lithographic printing plate precursor to render the non-image areas sufficiently hydrophilic by the oil-desensitizing treatment and to maintain good water retentivity sufficient for preventing adhesion of ink during printing. In the electrophotographic lithographic printing plate precursor of the present invention, the resin grains (L) which are concentrated in the surface portion of the photoconductive layer provide the carboxy groups by the oil-desensitizing treatment to generate hydrophilicity thereby rendering the non-image areas sufficiently hydrophilic and providing good water retentivity sufficient for preventing the occurrence of background stains on prints. Further, zinc oxide grains uniformly dispersed in the resin (A) can be subjected to oil-desensitization in a conventional manner to render the non-image areas more hydrophilic.

According to the electrophotographic lithographic printing plate precursor of the present invention, two conflicting problems of the formation of good duplicated images based on the excellent electrophotographic characteristics and the maintenance of good water retentivity in the non-image areas after the image formation and oil-desensitization can be solved.

Since the resin grains (L) have silicon and/or fluorine atom-containing substituents, they are concentrated in the surface portion of the photoconductive layer and generate hydrophilicity by the oil-desensitizing treatment. Also, the water retentivity of the printing plate formed is improved.

Now, the resin (A) which can be used as the binder resin of the photoconductive layer of the electrophotographic lithographic printing plate precursor according to the present invention will be described in more detail below.

The weight average molecular weight of the resin (A) is suitably from $1\times10^3$ to $2\times10^4$, preferably from $3\times10^3$ to $1\times10^4$, and the glass transition point of the resin (A) is preferably from −30° C. to 110° C., and more preferably from −10° C. to 90° C.

If the molecular weight of the resin (A) is less than $1\times10^3$, the film-forming ability thereof is undesirably reduced, whereby the photoconductive layer formed cannot keep a sufficient film strength, while if the molecular weight thereof is larger than $2\times10^4$, the fluctuations of dark decay retention rate and photosensitivity of the photoconductive layer, particularly that containing a spectral sensitizing dye for sensitization in a range of from near infrared to infrared become somewhat large, and thus the effect for obtaining stable duplicated images according to the present invention is reduced under severe conditions of high-temperature and high-humidity or low-temperature or low-humidity.

In the resin (A), the content of the polymer component corresponding to the repeating unit represented by the general formula (I) is suitably not less than 30% by weight, preferably from 50 to 97% by weight, and the content of the polymer component containing the specified polar group is suitably from 0.5 to 15% by weight, preferably from 1 to 10% by weight.

If the content of the polar group-containing component in the resin (A) is less than 0.5% by weight, the resulting electrophotographic light-sensitive material has too low initial potential to provide a sufficient image density. If, on the other hand, it is more than 15% by weight, the dispersibility of the photoconductive substance is reduced even though the resin has a low molecular weight, and further background stains tend to increase when used as an offset master.

The repeating unit represented by the general formula (I) described above, which is contained in an amount of not less than 30% by weight in the resin (A) will be further described below.

In the general formula (I), $a_1$ and $a_2$ each preferably represents a hydrogen atom, a cyano group, an alkyl group having from 1 to 4 carbon atoms (e.g., methyl, ethyl, propyl and butyl), —COO—$R_{08}$ or —COO—$R_{08}$ bonded via a hydrocarbon group (wherein $R_{08}$ represents a hydrogen atom or an alkyl, alkenyl, aralkyl, alicyclic or aryl group which may be substituted, and specifically includes those as described for $R_{03}$ hereinafter).

The hydrocarbon group in the above described —COO—$R_{08}$ group bonded via a hydrocarbon group includes, for example, a methylene group, an ethylene group, and a propylene group.

$R_{03}$ preferably represents an alkyl group having from 1 to 18 carbon atoms which may be substituted (e.g., methyl, ethyl, propyl, butyl, pentyl, hexyl, octyl, decyl, dodecyl, tridecyl, tetradecyl, 2-chloroethyl, 2-bromoethyl, 2-cyanoethyl, 2-hydroxyethyl, 2-methoxyethyl, 2-ethoxyethyl, and 3-hydroxypropyl), an alkenyl group having from 2 to 18 carbon atoms which may be substituted (e.g., vinyl, allyl, isopropenyl, butenyl, hexenyl, heptenyl, and octenyl), an aralkyl group having from 7 to 12 carbon atoms which may be substituted (e.g., benzyl, phenethyl, naphthylmethyl, 2-naphthylethyl, methoxybenzyl, ethoxybenzyl, and methylbenzyl), a cycloalkyl group having from 5 to 8 carbon atoms which may be substituted (e.g., cyclopentyl, cyclohexyl, and cycloheptyl), or an aryl group which may be substituted (e.g., phenyl, tolyl, xylyl, mesityl, naphthyl, methoxyphenyl, ethoxyphenyl, fluorophenyl, difluorophenyl, bromophenyl, chlorophenyl, dichlorophenyl, iodophenyl, methoxycarbonylphenyl, ethoxycarbonylphenyl, and cyanophenyl).

More preferably, the polymer component corresponding to the repeating unit represented by the general formula (I) is a methacrylate component having the specific aryl group represented by the above described general formula (Ia) and/or (Ib). The low molecular weight resin containing the specific aryl group-containing methacrylate polymer component described above is sometimes referred to as a resin (A') hereinafter.

In the resin (A'), the content of the methacrylate polymer component corresponding to the repeating unit represented by the general formula (Ia) and/or (Ib) is suitably not less than 30% by weight, preferably from 50 to 97% by weight, and the content of polymer component containing the specified polar group is suitably from 0.5 to 15% by weight, preferably from 1 to 10% by weight.

In the general formula (Ia), $T_1$ and $T_2$ each preferably represents a hydrogen atom, a chlorine atom, a bromine atom, an alkyl group having from 1 to 4 carbon atoms (e.g., methyl, ethyl, propyl, and butyl), an aralkyl group having from 7 to 9 carbon atoms (e.g., benzyl, phenethyl, 3-phenylpropyl, chlorobenzyl, dichlorobenzyl, bromobenzyl, methylbenzyl, methoxybenzyl, and chloromethylbenzyl), an aryl group (e.g., phenyl, tolyl, xylyl, bromophenyl, methoxyphenyl, chlorophenyl, and dichlorophenyl), —$COR_{04}$ or —$COOR_{05}$ (wherein $R_{04}$ and $R_{05}$ each preferably represents any of the above-recited hydrocarbon groups).

In the general formula (Ia) or (Ib), $L_1$ and $L_2$ each represents a direct bond or linking group containing from 1 to 4 linking atoms, e.g., $-(CH_2)_{n_1}$ ($n_1$ represents an integer of 1, 2 or 3), —$CH_2OCO$—, —$CH_2CH_2OCO$—, $-(CH_2O)_{m_1}$ ($m_1$ represents an integer of 1 or 2), and —$CH_2CH_2O$—, which connects —COO— and the benzene ring.

Specific examples of the polymer component corresponding to the repeating unit represented by the general formula (Ia) or (Ib) which can be used in the resin (A) according to the present invention are set forth below, but the present invention should not be construed as being limited thereto. In the following formulae (a-1) to (a-17), n represents an integer of from 1 to 4; m represents an integer of from 0 to 3; p represents an integer of from 1 to 3; $R_{10}$ to $R_{13}$ each represents —$C_nH_{2n+1}$ or —$(CH_2)_m C_6H_5$ (wherein n and m each has the same meaning as defined above); and $X_1$ and $X_2$, which may be the same or different, each represents a hydrogen atom, —Cl, —Br or —I.

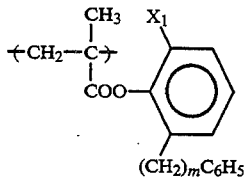
(a-1)

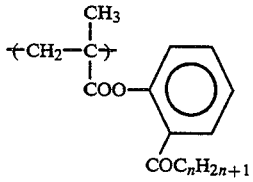
(a-2)

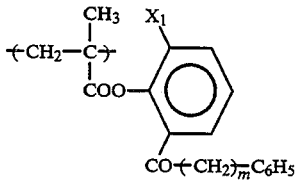
(a-3)

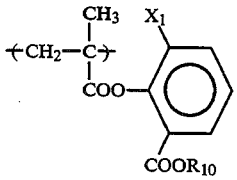
(a-4)

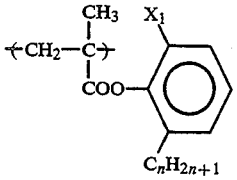
(a-5)

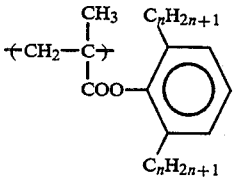
(a-6)

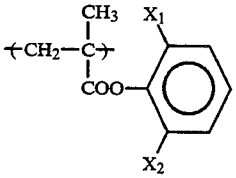
(a-7)

-continued (a-8)

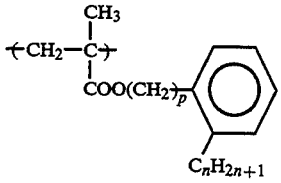

(a-9)

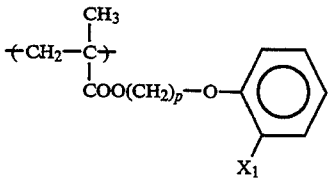

(a-10)

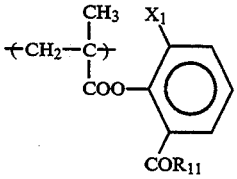

(a-11)

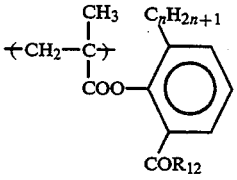

(a-12)

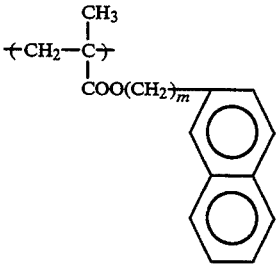

(a-13)

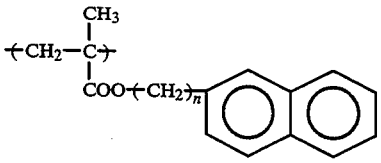

(a-14)

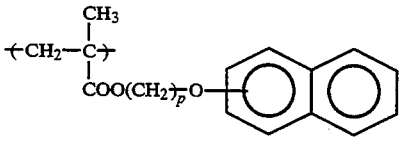

(a-15)

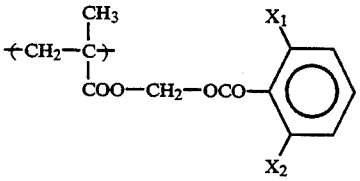

(a-16)

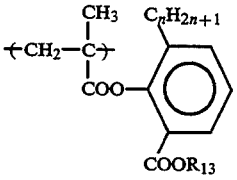

-continued (a-17)

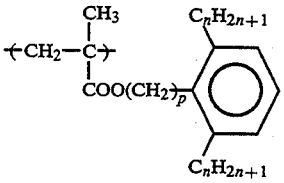

Now, the polymer component having the specified polar group present in the resin (A) will be described in detail below.

The polymer component having the specified polar group can exist either in the polymer chain of the resin (A), at one terminal of the polymer chain or both of them.

The polar group included in the polar group-containing polymer component is selected from $-PO_3H_2$, $-SO_3H$, $-COOH$,

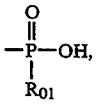

and a cyclic acid anhydride-containing group, as described above.

In the group

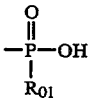

above, $R_{01}$ represents a hydrocarbon group or $-OR_{02}$ (wherein $R_{02}$ represents a hydrocarbon group). The hydrocarbon group represented by $R_{01}$ or $R_{02}$ preferably includes an aliphatic group having from 1 to 22 carbon atoms which may be substituted (e.g., methyl, ethyl, propyl, butyl, hexyl, octyl, decyl, dodecyl, octadecyl, 2-chloroethyl, 2-methoxyethyl, 3-ethoxypropyl, allyl, crotonyl, butenyl, cyclohexyl, benzyl, phenethyl, 3-phenylpropyl, methylbenzyl, chlorobenzyl, fluorobenzyl, and methoxybenzyl) and an aryl group which may be substituted (e.g., phenyl, tolyl, ethylphenyl, propylphenyl, chlorophenyl, fluorophenyl, bromophenyl, chloromethylphenyl, dichlorophenyl, methoxyphenyl, cyanophenyl, acetamidophenyl, acetylphenyl, and butoxyphenyl).

The cyclic acid anhydride-containing group is a group containing at least one cyclic acid anhydride. The cyclic acid anhydride to be contained includes an aliphatic dicarboxylic acid anhydride and an aromatic dicarboxylic acid anhydride.

Specific examples of the aliphatic dicarboxylic acid anhydrides include succinic anhydride ring, glutaconic anhydride ring, maleic anhydride ring, cyclopentane-1,2-dicarboxylic acid anhydride ring, cyclohexane-1,2-dicarboxylic acid anhydride ring, cyclohexene-1,2-dicarboxylic acid anhydride ring, and 2,3bicyclo[2,2,-2]octanedicarboxylic acid anhydride. These rings may be substituted with, for example, a halogen atom such as a chlorine atom and a bromine atom, and an alkyl group such as a methyl group, an ethyl group, a butyl group and a hexyl group.

Specific examples of the aromatic dicarboxylic acid anhydrides include phthalic anhydride ring, naphthalene-dicarboxylic acid anhydride ring, pyridine-dicarboxylic acid anhydride ring and thiophenedicarboxylic acid anhydride ring. These rings may be substituted with, for example, a halogen atom (e.g., chlorine and bromine), an alkyl group (e.g., methyl, ethyl, propyl, and butyl), a hydroxyl group, a cyano group, a nitro group, and an alkoxycarbonyl group (e.g., methoxycarbonyl and ethoxycarbonyl).

In a case wherein the polar group is present in the polymer chain of the resin (A), the polar group may be bonded to the polymer main chain either directly or via an appropriate linking group.

The linking group can be any group for connecting the polar group to the polymer main chain. Specific examples of suitable linking group include

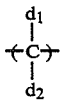

(wherein $d_1$ and $d_2$, which may be the same or different, each represents a hydrogen atom, a halogen atom (e.g., chlorine, and bromine), a hydroxyl group, a cyano group, an alkyl group (e.g., methyl, ethyl, 2-chloroethyl, 2-hydroxyethyl, propyl, butyl, and hexyl), an aralkyl group (e.g., benzyl, and phenethyl), an aryl group (e.g., phenyl),

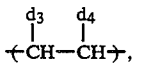

(wherein $d_3$ and $d_4$ each has the same meaning as defined for $d_1$ or $d_2$ above), $—C_6H_{10}$, $—C_6H_4—$, —O—, —S—,

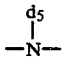

(wherein $d_5$ represents a hydrogen atom or a hydrocarbon group (preferably having from 1 to 12 carbon atoms (e.g., methyl, ethyl, propyl, butyl hexyl, octyl, decyl, dodecyl, 2-methoxyethyl, 2-chloroethyl, 2-cyanoethyl, benzyl, methylbenzyl, phenethyl, phenyl, tolyl, chlorophenyl, methoxyphenyl, and butylphenyl)), —CO—, —COO—, —OCO—, $—CON(d_5)$, $—SO_2N(d_5)—$, $—SO_2—$, —NHCONH—, —NHCOO—, $—NHSO_2$, —CONHCOO—, —CONHCONH—, a heterocyclic ring (preferably a 5-membered or 6-membered ring containing at least one of an oxygen atom, a sulfur atom and a nitrogen atom as a hetero atom or a condensed ring thereof (e.g., thiophene, pyridine, furan, imidazole, piperidine, and morpholine)),

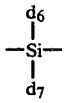

(wherein $d_6$ and $d_7$, which may be the same or different, each represents a hydrocarbon group or $—d_8$ (wherein $d_8$ represents a hydrocarbon group)), and a combination thereof. Suitable examples of the hydrocarbon group represented by $d_6$, $d_7$ or $d_8$ include those described for $d_5$.

The polymer component containing the polar group according to the present invention may be any of specified polar group-containing vinyl compounds copolymerizable with, for example, a monomer corresponding to the repeating unit represented by the general formula (I) (including that represented by the general formula (Ia) or (Ib)). Examples of such vinyl compounds are described, e.g., in Kobunshi Gakkai (ed.), *Kobunshi Data Handbook Kisohen* (*Polymer Date Handbook Basis*), Baifukan (1986). Specific examples of these vinyl monomers include acrylic acid, α- and/or β-substituted acrylic acids (e.g., α-acetoxy, α-acetoxymethyl, α-(2-amino)methyl, α-chloro, α-bromo, α-fluoro, α-tributylsilyl, α-cyano, β-chloro, β-bromo, α-chloro-β-methoxy, and α, β-dichloro compounds), methacrylic acid, itaconic acid, itaconic half esters, itaconic half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic half esters, maleic half amides, vinylbenzenecarboxylic acid, vinylbenzenesulfonic acid, vinylsulfonic acid, vinylphosphonic acid, dicarboxylic acid vinyl or allyl half esters, and ester or amide derivatives of these carboxylic acids or sulfonic acids containing the acidic group in the substituent thereof.

Specific examples of the polar group-containing polymer components are set forth below, but the present invention should not be construed as being limited thereto. In the following formulae, $e_1$ represents —H or $—CH_3$; $e_2$ represents —H, $—CH_3$ or $—CH_2COOCH_3$; $R_{14}$ represents an alkyl group having from 1 to 4 carbon atoms; $R_{15}$ represents an alkyl group having from 1 to 6 carbon atoms, a benzyl group or a phenyl group; c represents an integer of from 1 to 3; d represents an integer of from 2 to 11; e represents an integer of from 1 to 11; f represents an integer of from 2 to 4; and g represents an integer of from 2 to 10.

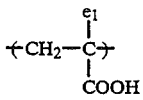

(b-1)

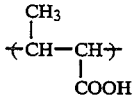

(b-2)

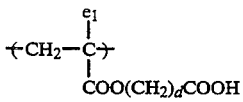

(b-3)

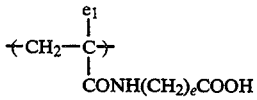

(b-4)

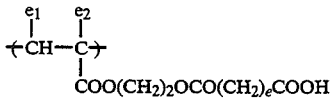

(b-5)

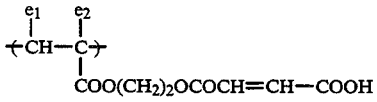

(b-6)

-continued
(b-7)
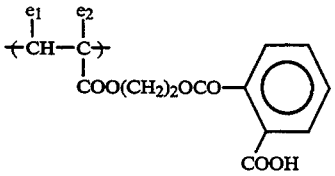
(b-8)
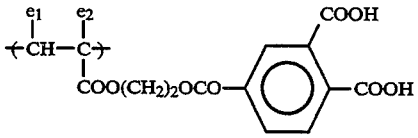
(b-9)
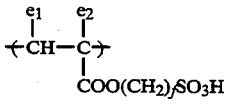
(b-10)
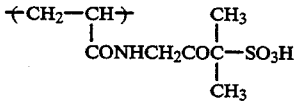
(b-11)
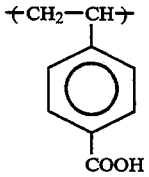
(b-12)
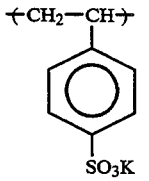
(b-13)
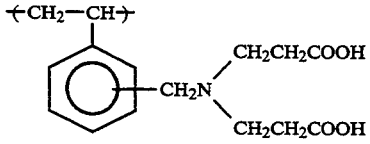
(b-14)
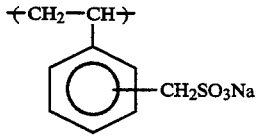
(b-15)
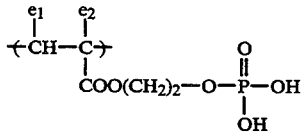
(b-16)
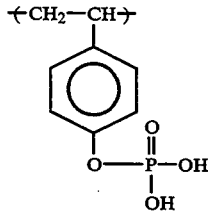
-continued
(b-17)
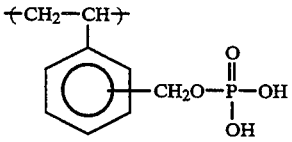
(b-18)
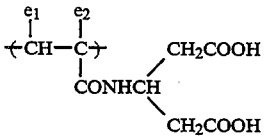
(b-19)
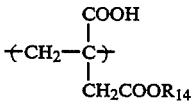
(b-20)
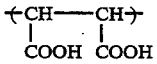
(b-21)
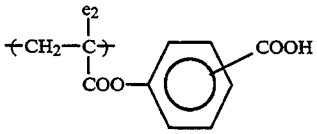
(b-22)
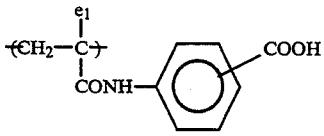
(b-23)
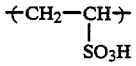
(b-24)
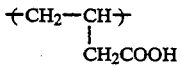
(b-25)
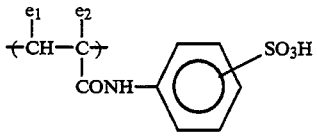
(b-26)
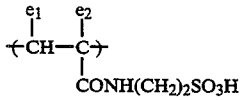
(b-27)
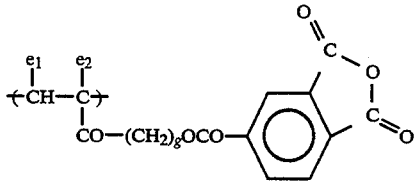
(b-28)
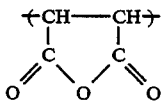
(b-29)
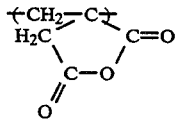

-continued
(b-30)
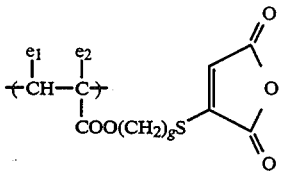
(b-31)
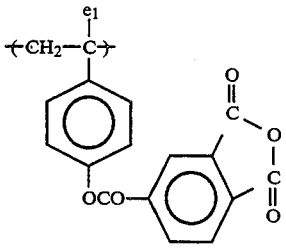
(b-32)
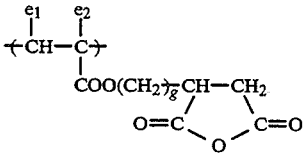
(b-33)
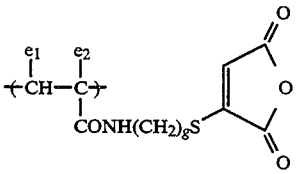
(b-34)
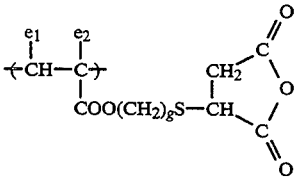
(b-35)
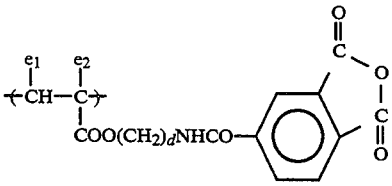
(b-36)
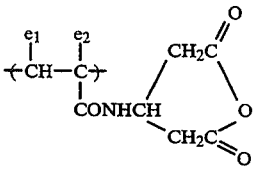
(b-37)
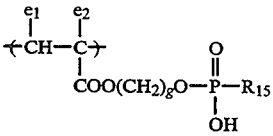
(b-38)
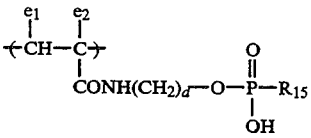
-continued
(b-39)
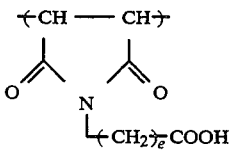
(b-40)
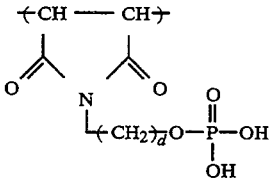
(b-41)
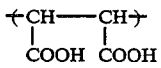
(b-42)
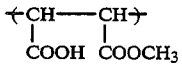
(b-43)
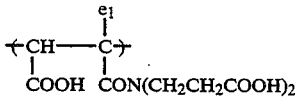
(b-44)
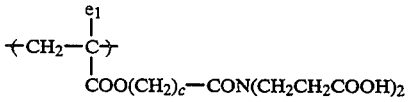
(b-45)
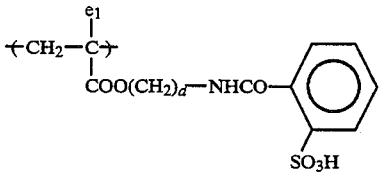
(b-46)
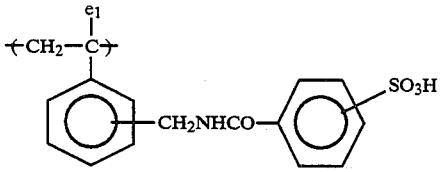
(b-47)
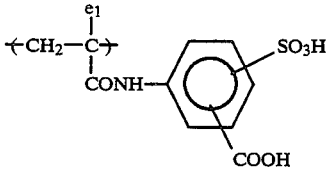
(b-48)
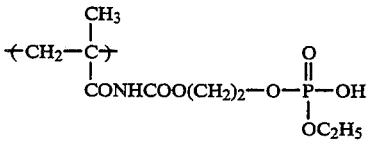
(b-49)
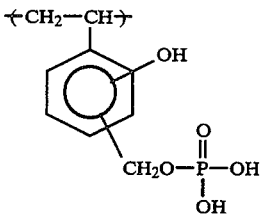

-continued

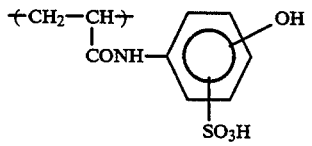
(b-50)

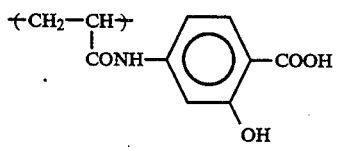
(b-51)

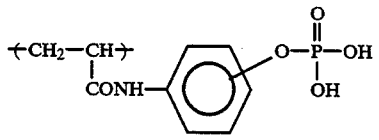
(b-52)

In such a case, the polar group is included in a component (repeating unit) for forming the polymer chain of the resin (A) and the polar groups can be present in the resin (A) regularly (in a case of a block polymer) or irregularly (in case of a random polymer).

In a case wherein the polar group is present at one terminal of the polymer chain of the resin (A), the polar group may be bonded to the terminal of the polymer main chain either directly or via an appropriate linking group. Suitable examples of the linking groups include those illustrated for the cases wherein the polar groups are present in the polymer chain hereinbefore described.

When the polar group is present at one terminal of polymer main chain of the resin (A) as described above, other polar groups are not necessary to exist in the polymer chain. However, the resin (A) having the specified polar groups in the polymer chain in addition to the polar group bonded to the terminal of the main chain is preferable since the electrostatic characteristics are further improved.

In the resin (A), the ratio of the polar group present in the polymer chain to the polar group bonded to the terminal of the polymer main chain may be varied depending on the kinds and amounts of other binder resins, a resin grain, a spectral sensitizing dye, a chemical sensitizer and other additives which constitute the photoconductive layer according to the present invention, and can be appropriately controlled. What is important is that the total amount of the polar group-containing component present in the resin (A) is from 0.5 to 15% by weight.

The resin (A) (including resin (A')) according to the present invention may further comprise repeating units corresponding to other copolymerizable monomers as polymer components in addition to the repeating unit of the general formula (I), (Ia) and/or (Ib) and the repeating unit containing the polar group. Examples of such monomers include, in addition to methacrylic acid esters, acrylic acid esters and crotonic acid esters containing substituents other than those described for the general formula (I), α-olefins, vinyl or allyl esters of carboxylic acids (including, e.g., acetic acid, propionic acid, butyric acid, valeric acid, benzoic acid, and naphthalenecarboxylic acid, as examples of the carboxylic acids), arylonitrile, methacrylonitrile, vinyl ethers, itaconic acid esters (e.g., dimethyl itaconate, and diethyl itaconate), acrylamides, methacrylamides, styrenes (e.g., styrene, vinyltoluene, chlorostyrene, hydroxystyrene, N,N-dimethylaminomethylstyrene, methoxycarbonylstyrene, methanesulfonyloxystyrene, and vinylnaphthalene), vinylsulfone-containing compounds, vinylketone-containing compounds, and heterocyclic vinyl compounds (e.g., vinylpyrrolidone, vinylpyridine, vinylimidazole, vinylthiophene, vinylimidazoline, vinylpyrazoles, vinyldioxane, vinylquinoline, vinyltetrazole, and vinyloxazine).

The resin (A) having the specified polar groups at random in the polymer chain thereof used in the present invention can be easily synthesized according to a conventionally known method, for example, a radical polymerization method or an ion polymerization method using a monomer corresponding to the repeating unit represented by the general formula (I), a monomer corresponding to the repeating unit containing the specified polar group and, if desired, other monomers by appropriately selecting the polymerization condition so as to obtain the resin having the desired molecular weight. A radical polymerization method is preferred because purification of the monomers and solvent to be used is unnecessary and a very low polymerization temperature such as 0° C. or below is not required. Specifically, a polymerization initiator used includes an azobis type initiator and a peroxide compound each of which is conventionally known. In order to synthesize the resin having the low molecular weight according to the present invention, a known method, for example, increase in the amount of initiator used or regulation of a high polymerization temperature may be utilized. In general, the amount of initiator used is in a range of from 0.1 to 20 parts by weight based on the total amount of the monomers employed, and the polymerization temperature is regulated in a range of from 30° C. to 200° C. Moreover, a method using a chain transfer agent together may be employed. Specifically, a chain transfer agent, for example, a mercapto compound, or a halogenated compound is used in a range of from 0.01 to 10 parts by weight based on the total amount of the monomers employed to adjust the desired weight average molecular weight.

The resin (A) having the specified polar groups as a block in the polymer chain thereof used in the present invention can be produced by a conventionally known polymerization reaction method. More specifically, it can be produced by a method comprising previously protecting the polar group of a monomer corresponding to the polymer component having the specific polar group to form a functional group, synthesizing a block copolymer by an ion polymerization reaction with an organic metal compound (e.g., alkyl lithiums, lithium diisopropylamide, and alkylmagnesium halides) or a hydrogen iodide/iodine system, a photopolymerization reaction using a porphyrin metal complex as a catalyst, or a so-called known living polymerization reaction such as a group transfer polymerization reaction, etc., and then conducting a protection-removing reaction of the functional group formed by protecting the polar group by a hydrolysis reaction, hydrogenolysis reaction, an oxidative decomposition reaction, or a photodecomposition reaction to form the polar group.

One of the examples is shown by the following reaction scheme (1):

Reaction Scheme (1)

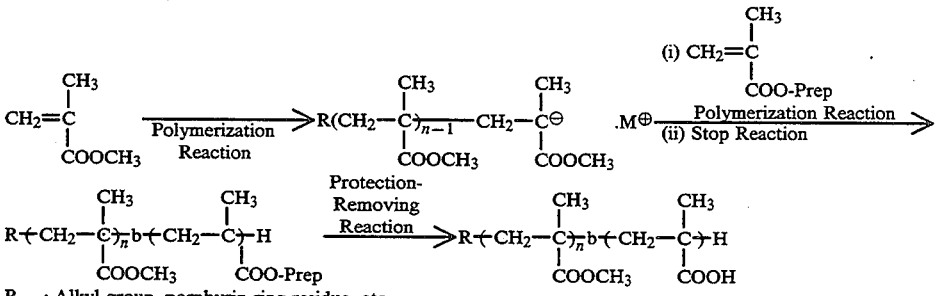

R : Alkyl group, porphyrin ring residue, etc.
Prep: Protective group (e.g., $-C(C_6H_5)_3$, $-Si(C_3H_7)_3$, etc.)
b : A bond connecting blocks Specifically, the block copolymer can be easily synthesized according to the synthesis methods described, e.g. , in P. Lutz, P. Masson et al, *Polym. Bull.*, 12, 79 (1984), Anderson, G. D. Andrews, et al, *Macromolecules*, 14, 1601 (1981), K. Hatada, K. Ute, et al, *Polym. J.*, 17, 977 (1985), ibid., 18, 1037 (1986), Koichi Ute and Koichi Hatada, *Kobunshi Kako* (*Polymer Processing*), 36, 366 (1987), Toshinobu Higashimura and Mitsuo Sawamoto, *Kobunshi Ronbun Shu* (*Polymer Treatieses*), 46, 189 (1987), M. Kuroki and T. Aida, *J. Am. Chem. Soc.*, 109, 4737 (1989), Teizo Aida and Shohei Inoue, *Yuki Gosei Kagaku* (*Organic Synthesis Chemistry*), 43, 300 (1985), and D. Y. Sogah, W. R. Hertler, et al, *Macromolecules*, 20, 1473 (1987).

Furthermore, the resin (A) having the polar groups as a block can be also synthesized by a photoinitiator polymerization method using the monomer having the unprotected polar group and also using a dithiocarbamate compound as an initiator. For example, the block copolymers can be synthesized according to the synthesis methods described in Takayuki Otsu, *Kobunshi* (*Polymer*), 37, 248 (1988), Shunichi Himori and Ryuichi Ohtsu, *Polym. Rep. Jap.* 37, 3508 (1988), JP-A-64-111, and JP-A-64-26619.

Also, the protection of the specific polar group of the present invention and the release of the protective group (a reaction for removing a protective group) can be easily conducted by utilizing conventionally known knowledges, such as the methods described, e.g., in Yoshio Iwakura and Keisuke Kurita, *Hannosei Kobunshi* (*Reactive Polymer*), published by Kodansha (1977), T. W. Greene, *Protective Groups in Organic Synthesis*, published by John Wiley & Sons (1981), and J. F. W. McOmie, *Protective Groups in Organic Chemistry*, Plenum Press, (1973).

Specific examples of production of the resin (A) having the polar groups as a block are described, for example, in JP-A-3-181948.

The resin (A) according to the present invention, in which the specific polar group is bonded to only one terminal of the polymer main chain, can easily be prepared by an ion polymerization process, in which a various kind of reagents is reacted at the terminal of a living polymer obtained by conventionally known anion polymerization or cation polymerization; a radical polymerization process, in which radical polymerization is performed in the presence of a polymerization initiator and/or a chain transfer agent which contains the specific polar group in the molecule thereof; or a process, in which a polymer having a reactive group (for example, an amino group, a halogen atom, an epoxy group, and an acid halide group) at the terminal obtained by the above-described ion polymerization or radical polymerization is subjected to a polymer reaction to convert the terminal reactive group into the specific polar group.

More specifically, reference can be made to, e.g., P. Dreyfuss and R. P. Quirk, *Encycl. Polym. Sci. Eng.*, 7, 551 (1987), Yoshiki Nakajo and Yuya Yamashita, *Senryo to Yakuhin* (*Dyes and Chemicals*), 30, 232 (1985), Akira Ueda and Susumu Nagai, *Kagaku to Kogyo* (*Science and Industry*), 60, 57 (1986) and literature references cited therein.

Specific examples of chain transfer agents which can be used include mercapto compounds containing the polar group or the reactive group capable of being converted into the polar group (e.g., thioglycolic acid, thiomalic acid, thiosalicylic acid, 2-mercaptopropionic acid, 3-mercaptopropionic acid, 3-mercaptobutyric acid, N-(2-mercaptopropionyl)glycine, 2-mercaptonicotinic acid, 3-[N-(2-mercaptoethyl)carbamoyl]propionic acid, 3-[N-(2-mercaptoethyl)amino]propionic acid, N-(3-mercaptopropionyl)alanine, 2-mercaptoethanesulfonic acid, 3-mercaptopropanesulfonic acid, 4-mecaptobutanesulfonic acid, 2-mercaptoethanol, 3-mercapto-1,2-propanediol, 1-mercapto-2-propanol, 3-mercapto-2-butanol, mercaptophenol, 2-mercaptoethylamine, 2-mercaptoimidazole, 2-mercapto-3-pyridinol, 4-(2-mercaptoethyloxycarbonyl)phthalic acid anhydride, 2-mercaptoethylphosphonic acid anhydride, and monomethyl 2-mercaptoethylphosphonate), and alkyl iodide compounds containing the polar group or the polar group-forming reactive group (e.g., iodoacetic acid, iodopropionic acid, 2-iodoethanol, 2-iodoethanesulfonic acid, and 3-iodopropanesulfonic acid).

Specific examples of the polymerization initiators containing the polar group or the reactive group include 4,4'-azobis(4-cyanovaleric acid), 4,4'-azobis(4-cyanovaleric acid chloride), 2,2'-azobis(2-cyanopropanol), 2,2'-azobis(2-cyanopentanol), 2,2'-azobis[2-methyl-N-(2-hydroxyethyl)propionamide], 2,2'-azobis{2-methyl-N-[1,1-bis(hydroxymethyl)-2-hydroxyethyl]propionamide}, 2,2'-azobis{2-[1-(2-hydroxyethyl)-2-imidazolin-2-yl]propane}, 2,2'-azobis[2-(2-imidazolin-2-yl)propane], and 2,2'-azobis[2-(4,5,6,7-tetrahydro-1H-1,3-diazepin-2-yl)propane].

The chain transfer agent or polymerization initiator is usually used in an amount of from 0.5 to 15 parts by weight, preferably from 2 to 10 parts by weight, per 100 parts by weight of the total monomers used.

The resin (A) (including resin (A')) which has a low molecular weight is preferably employed together with a resin conventionally known as a binder resin for photoconductive zinc oxide. The proportion of the resin (A) to other resins is preferably from 5 to 50 to from 95 to 50 by weight.

Other resins suitable for use together with the resin (A) are medium to high molecular weight resins having a weight average molecular weight of from $3\times10^4$ to $1\times10^6$, preferably from $5\times10^4$ to $5\times10^5$, and a glass transition point of from −10° C. to 120° C., preferably from 0° C. to 110° C.

Examples of other resins are described, for example, in Takaharu Shibata and Jiro Ishiwatari, *Kobunshi* (*High Molecular Materials*), 17, 278 (1968), Harumi Miyamoto and Hidehiko Takei, *Imaging* No. 8, 9 (1973), Koichi Nakamura, *Kiroku Zairyoyo Binder no Jissai Gijutsu* (*Practical Technique of Binders for Recording Materials*), Cp. 10, published by C. M. C. Shuppan (1985), D. Tart, S. C. Heidecker *Tappi*, 49, No. 10, 439 (1966), E. S. Baltazzi, R. G. Blanckette, et al., *Photo. Sci. Eng.*, 16, No. 5, 354 (1972), Nguyen Chank Keh, Isamu Shimizu and Eiichi Inoue, *Denshi Shashin Gakkaishi* (*Journal of Electrophotographic Association*), 18, No. 2, 22 (1980), JP-B-50-31011, JP-A-53-54027, JP-A-54-20735, JP-A-57-202544 and JP-A-58-68046.

More specifically, they include olefin polymers and copolymers, vinyl chloride copolymers, vinylidene chloride copolymers, vinyl alkanoate polymers and copolymers, allyl alkanoate polymers and copolymers, styrene and its derivative polymers and copolymers, butadiene-styrene copolymers, isoprene-styrene copolymers, butadiene-unsaturated carboxylic acid ester copolymers, acrylonitrile copolymers, metharylonitrile copolymers, alkyl vinyl ether copolymers, acrylic acid ester polymers and copolymers, methacrylic acid ester polymers and copolymers, styrene-acrylic acid ester copolymers, styrene-methacrylic acid ester copolymers, itaconic acid diester polymers and copolymers, maleic anhydride copolymers, acrylamide copolymers, methacrylamide copolymers, hydroxyl group-modified silicone resins, polycarbonate resins, ketone resins, amide resins, hydroxyl group and carboxyl group-modified polyester resins, butyral resins, polyvinyl acetal resins, cyclic rubber-methacrylic acid ester copolymers, cyclic rubber-acrylic acid ester copolymers, nitrogen atom-free heterocyclic ring containing copolymers (examples of heterocyclic ring including, e.g., furan, tetrahydrofuran thiophene, dioxane, dioxofuran, lactone, benzofuran, benzothiophene, or 1,3-dioxetane) and epoxy resins.

Furthermore, as the medium to high molecular weight resins to be used together, there are preferably polymers which satisfy the above described conditions and contain at least 30% by weight of a polymer component of a repeating unit represented by the following general formula (III):

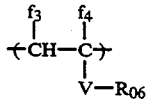

Formula (III)

wherein V represents —COO—, —OCO—, $-(CH_2)_nOCO-$, $-(CH_2)_n-COO-$, —O— or $-SO_2-$; h represents an integer of from 1 to 4; $f_3$ and $f_4$ each has the same meaning as $a_1$ and $a_2$ defined in the general formula (I) above; and $R_{06}$ has the same meaning as $R_{03}$ in the general formula (I) above.

Suitable examples of the medium to high molecular weight binder resins containing the polymer component represented by the general formula (III) (hereinafter, sometimes referred to as resin (B)) include a random copolymer containing the polymer component represented by the general formula (III) as described in U.S. Pat. No. 4,871,683, JP-A-63-220149 and JP-A-63-220148, the above-described random copolymer used together with a crosslinkable resin as described in JP-A-1-211766 and JP-A-1-102573, a copolymer containing the polymer component represented by the general formula (III) and being previously partially crosslinked as described in U.S. Pat. No. 5,084,376, and a graft type block copolymer obtained by polymerization of a monofunctional macromonomer comprising a polymer component of the specified repeating unit and a monomer corresponding to a polymer component represented by the general formula (III) as described in U.S. Pat. Nos. 5,030,534 and 5,077,166, JP-A-3-92861, JP-A-3-53257 and JP-A-3-206464.

In a case wherein the resin (A) is employed together with the resin (B) of medium to high molecular weight, the mechanical strength of a photoconductive layer can be more sufficiently improved as compared with a case when the resin (A) is used alone without deteriorating the electrophotographic properties obtained by the use of the resin (A). More specifically, the interaction of adsorption and covering can suitably be performed in a system of a photoconductive material and a binder resin, and the film strength of the photoconductive coating layer can be sufficiently maintained.

Now, the non-aqueous solvent dispersed resin grain (L) which can be employed in the photoconductive layer of the electrophotographic lithographic printing plate precursor according to the present invention will be described in more detail below.

The resin grain (L) is composed of an insoluble polymer portion formed by polymerization granulation in a non-aqueous system and a dispersion stabilizing resin which is present around the insoluble polymer portion and contributes to stable dispersion of the insoluble polymer portion in the system. Specifically, the dispersion stabilizing resin which functions dispersion stability of the non-aqueous solvent dispersed resin grain is adsorbed on the insolubilized polymer portion, and further is chemically bonded to the insolubilized polymer portion in case of a dispersion stabilizing resin having the polymerizable double bond group moiety represented by the general formula (II) described above during the process of polymerization granulation.

The resin grain used in the present invention has a hydrophobic polymer portion, i.e., polymer portion corresponding to the dispersion stabilizing resin, which performs interaction with the binder resin of the photoconductive layer, and as a result the resin grain is prevented from dissolving-out from the printing plate with dampening water used during printing due to the anchor effect of the hydrophobic polymer portion, and thus the printing plate can maintain good printing properties even after providing a large number of prints.

The resin grain (L) used in the present invention has an average grain diameter equivalent to or smaller than the maximum grain diameter of photoconductive zinc oxide grain and a narrow distribution of grain diameter, that is, a uniform grain diameter.

When resin grains having a larger grain diameter than zinc oxide grain are present, the electrophotographic properties are deteriorated, in particular, uniform electric charge cannot be conducted, thus resulting in unevenness of density in an image area, cutting of letters or fine lines and background stain in a non-image area of a reproduced image.

Specifically, the resin-grain (L) according to the present invention have a maximum grain diameter of not more than 2 μm, preferably not more than 0.5 μm, and an average grain diameter of not more than 0.8 μm, preferably not more than 0.5 μm.

The specific surface area of the resin grain (L) increases with the decrease in the grain diameter thereof, resulting in good electrophotographic properties, and the grain size of colloidal grain, i.e. about 0.01 μm or less is sufficient. However, too much small grains cause to decrease the effect of improving the water retentivity as in a case of molecular dispersion. Accordingly, a grain size of not less than 0.001 μm is preferable.

The weight average molecular weight of the resin grain (L) is suitably from $1\times10^4$ to $1\times10^6$.

The resin grain (L) according to the present invention is produced by a so-called non-aqueous system dispersion polymerization. More specifically, the resin grain (L) is characterized by obtaining according to polymerization, in a non-aqueous solvent, of a monofunctional monomer (C) which contains at least one functional group capable of forming a carboxy group upon decomposition and becomes insoluble in the non-aqueous solvent after being polymerized in the presence of a dispersion stabilizing resin soluble in the non-aqueous solvent and having a silicon and/or fluorine atom. The introduction of silicon and/or fluorine atom can be performed by means of using a dispersion stabilizing resin having a repeating unit containing a silicon and/or fluorine atom-containing substituent or additionally using a monofunctional monomer (D) having a silicon and/or fluorine atom-containing substituent, at the production of the resin grain (L).

A functional group capable of forming at least one carboxy group upon decomposition (hereinafter, sometimes simply referred to as a carboxy group-forming functional group) contained in the monomer (C) which forms the resin grain (L) used in the present invention will be described in greater detail below.

The carboxy group-forming functional group according to the present invention forms a carboxy group upon decomposition, and a number of the carboxy groups formed from one functional group may be one, two or more.

In accordance with one preferred embodiment of the present invention, the carboxy group-forming functional group is represented by the following general formula (IV):

$$-COO-A_1 \qquad (IV)$$

wherein $A_1$ represents

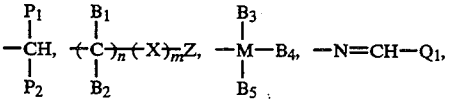

-continued

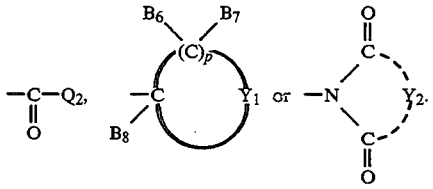

In a case where $A_1$ represents

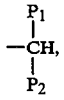

$P_1$ represents a hydrogen atom, —CN, $—CF_3$, $—COD_1$, or $—COOD_1$ wherein $D_1$ represents an alkyl group having from 1 to 6 carbon atoms (e.g., methyl, ethyl, propyl, butyl, pentyl or hexyl), an aralkyl group having from 7 to 12 carbon atoms which may be substituted (e.g., benzyl, phenethyl, chlorobenzyl, methoxybenzyl, chlorophenethyl or methylphenethyl) or an aromatic group (e.g., a phenyl or naphthyl group which may be substituted, including specifically phenyl, chlorophenyl, dichlorophenyl, methylphenyl, methoxyphenyl, acetylphenyl, acetamidophenyl, methoxycarbonylphenyl or naphthyl); and $P_2$ represents —CN, $—COD_1$ or $—COOD_1$ (wherein $D_1$ has the same meaning as defined above).

In a case where $A_1$ represents

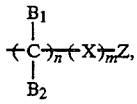

$B_1$ and $B_2$, which may be the same or different, each preferably represents a hydrogen atom or a straight chain or branched chain alkyl group containing from 1 to 12 carbon atoms which may be substituted (e.g., methyl, ethyl, propyl, chloromethyl, dichloromethyl, trichloromethyl, octyl, decyl, hydroxyethyl or 3-chloropropyl); X preferably represents a phenyl or naphthyl group which may be substituted (e.g., phenyl, methylphenyl, chlorophenyl, dimethylphenyl, chloromethylphenyl or naphthyl); Z preferably represents a hydrogen atom, a halogen atom (e.g., chlorine or fluorine), a trihalomethyl group (e.g., trichloromethyl), a straight chain or branched chain alkyl group containing from 1 to 12 carbon atoms which may be substituted (e.g., methyl, chloromethyl, dichloromethyl, ethyl, propyl, butyl, hexyl, tetrafluoroethyl, octyl, cyanoethyl or chloroethyl), —CN, $—NO_2$, $—SO_2R_1'$ (wherein $R_1'$ represents an aliphatic group (e.g., an alkyl group having from 1 to 12 carbon atoms which may be substituted (including specifically methyl, ethyl, propyl, butyl, chloroethyl, pentyl or octyl), an aralkyl group containing from 7 to 12 carbon atoms which may be substituted (including specifically benzyl, phenethyl, chlorobenzyl, methoxybenzyl, chlorophenethyl, or methylphenethyl) or an aromatic group (e.g., a phenyl or naphthyl group which may be substituted including specifically phenyl, chlorophenyl, dichlorophenyl, methylphenyl, methoxyphenyl, acetylphenyl, acetamidophenyl, methoxycarbonylphenyl or naphthyl)), $—COOR_2'$ (wherein $R_2'$ has the same meaning as $R_1'$ defined above) or $—O—R_3'$ (wherein $R_3'$ has the same meaning as $R_1'$ defined above); and n and m each represents 0, 1, or 2.

In a case where $A_1$ represents

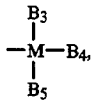

$R_3$, $R_4$, and $R_5$, which may be the same or different, each preferably represents an aliphatic group containing from 1 to 18 carbon atoms (wherein the aliphatic group includes an alkyl group, an alkenyl group, an aralkyl group and an alicyclic group, and the substituent includes, e.g., a halogen atom, —CN, —OH, —O—Q' (wherein Q' represents an alkyl group which may be substituted, an aralkyl group, an alicyclic group or an aryl group), an aromatic group containing from 6 to 18 carbon atoms which may be substituted (e.g., phenyl, tolyl, chlorophenyl, methoxyphenyl, acetamidophenyl or naphthyl) or —O—$R_4'$ (wherein $R_4'$ represents an alkyl group containing from 1 to 12 carbon atoms which may be substituted, an alkenyl group containing from 2 to 12 carbon atoms which may be substituted, an aralkyl group containing from 7 to 12 carbon atoms which may be substituted, an alicyclic group containing from 5 to 18 carbon atoms which may be substituted, or an aryl group containing from 6 to 18 carbon atoms which may be substituted); and M represents Si, Ti, or Sn, preferably Si.

In a case where $A_1$ represents —N=CH—$Q_1$ or

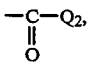

$Q_1$ and $Q_2$ each preferably represents an aliphatic group containing from 1 to 18 carbon atoms which may be substituted (wherein the aliphatic group includes an alkyl group, an alkenyl group, an aralkyl group and an alicyclic group, and the substituent includes, e.g., a halogen atom, —CN or an alkoxy group), or an aryl group containing from 6 to 18 carbon atoms which may be substituted (e.g., phenyl, methoxyphenyl, tolyl, chlorophenyl or naphthyl).

In a case where $A_1$ represents

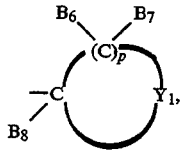

$Y_1$ represents an oxygen atom or a sulfur atom; $R_6$, $R_7$ and $R_8$, which may be the same or different, each preferably represents a hydrogen atom, a straight chain or branched chain alkyl group containing from 1 to 18 carbon atoms which may be substituted (e.g. , methyl, ethyl, propyl, butyl, hexyl, octyl, decyl, dodecyl, octadecyl, chloroethyl, methyoxyethyl or methoxypropyl), an alicyclic group which may be substituted (e.g., cyclopentyl or cyclohexyl), and aralkyl group containing from 7 to 12 carbon atoms which may be substituted (e.g., benzyl, phenethyl, chlorobenzyl or methoxybenzyl), an aromatic group which may be substituted (e.g., phenyl, naphthyl, chlorophenyl, tolyl, methoxyphenyl, methoxycarbonylphenyl or dichlorophenyl), or —O—$R_5'$ (wherein $R_5'$ represents a hydrocarbon group including those defined for $B_6$, $B_7$ and $B_8$ above); and p represents an integer of 3 or 4.

In a case where $A_1$ represents

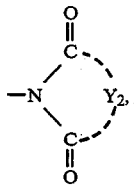

$Y_2$ represents an organic moiety necessary to form a cyclic imido group. Preferred examples of the organic moiety represented by $Y_2$ include those represented by the following general formula (V) or (VI):

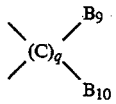

Formula (V)

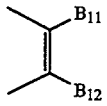

Formula (VI)

In the general formula (V), $B_9$ and $B_{10}$, which may be the same or different, each represents a hydrogen atom, a halogen atom (e.g., chlorine or bromine), an alkyl group containing from 1 to 18 carbon atoms which may be substituted (e.g., methyl, ethyl, propyl, butyl, hexyl, octyl, decyl, dodecyl, hexadecyl, octadecyl, 2-chloroethyl, 2-methoxyethyl, 2-cyanoethyl, 3-choloropropyl, 2-(methanesulfonyl)ethyl or 2-(ethoxy)ethyl), an aralkyl group containing from 7 to 12 carbon atoms which may be substituted (e.g., benzyl, phenethyl, 3-phenylpropyl, methylbenzyl, dimethylbenzyl, methoxybenzyl, chlorobenzyl or bromobenzyl), an alkenyl group containing from 3 to 18 carbon atoms which may be substituted (e.g., allyl, 3-methyl-2-propenyl, 2-hexenyl, 4-propyl-2-pentenyl or 12-octadecenyl), —S—$R_6'$ (wherein $R_6'$ represents an alkyl group, an aralkyl group or an alkenyl group each having the same meaning as that defined for $B_9$ or $B_{10}$ above), an aryl group which may be substituted (e.g., phenyl, tolyl, chlorophenyl, bromophenyl, methoxyphenyl, ethoxyphenyl or ethoxycarbonylphenyl), or —$NHR_7'$ (wherein $R_7'$ has the same meaning as $R_6'$ above); and further, $B_9$ and $B_{10}$ may combine with each other to form a ring (for example, a 5-membered or 6-membered monocyclic ring (e.g., cyclopentane, or cyclohexane), or a 5-membered or 6-membered ring-containing bicyclo ring (e.g., bicycloheptane, bicycloheptene, bicyclooctane or bicyclooctene), which may be substituted with a substituent selected from the groups defined for $B_9$ or $B_{10}$ above. q represents an integer of 2 or 3.

In the general formula (VI), $B_{11}$ and $B_{12}$, which may be the same or different, each has the same meaning as $B_9$ or $B_{10}$ defined above. In addition, $B_{11}$ and $B_{12}$ may combine with each other to from an aromatic ring (e.g., benzene or naphthalene).

In another preferred embodiment of the present invention, the carboxy group-forming functional group is represented by the following general formula (VII):

Formula (VII) —CO—$A_2$ wherein $A_2$ represents

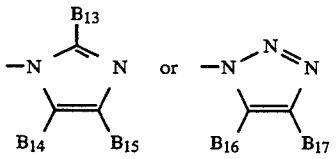

(wherein $B_{13}$, $B_{14}$, $B_{15}$, $B_{16}$ and $B_{17}$ each represents a hydrogen atom or an aliphatic group). preferred examples of the aliphatic group include those described for $B_6$, $B_7$ or $B_8$ above. Further, $B_{14}$ and $B_{15}$ or $B_{16}$ and $B_{17}$ represent an organic moiety for forming a condensed ring. Preferred examples of the ring include a 5-membered or 6-membered monocyclic ring (e.g., cyclopentene or cyclohexene) and a 5-membered to 12-membered aromatic ring (e.g., benzene, naphthalene, thiophene, pyrrole, pyran or quinoline).

In still another preferred embodiment of the present invention, the carboxy group-forming functional group is a group containing an oxazolone ring represented by the following general formula (VIII):

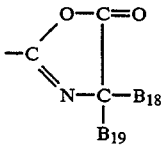

Formula (VIII)

wherein $B_{18}$ and $B_{19}$, which may be the same or different, each represents a hydrogen atom or a hydrocarbon group, or they may combine with each other to form a ring.

Preferably, $B_{18}$ and $B_{19}$, which may be the same or different, each represents a hydrogen atom, a straight chain or branched chain alkyl group containing from 1 to 12 carbon atoms which may be substituted ((e.g., methyl, ethyl, propyl, butyl, hexyl, 2-chloroethyl, 2-methoxyethyl, 2-methoxycarbonylethyl or 3-hydroxypropyl), an aralkyl group containing from 7 to 12 carbon atoms which may be substituted (e.g., benzyl, 4-chlorobenzyl, 4-acetamidobenzyl, phenethyl or 4-methyoxybenzyl), an alkenyl group containing from 2 to 12 carbon atoms which may be substituted (e.g., ethylene, allyl, isopropenyl, butenyl or hexenyl), a 5- to 7-membered alicyclic group which may be substituted (e.g., cyclopentyl, cyclohexyl, or chlorocyclohexyl), or an aromatic group which may be substituted (e.g., phenyl, chlorophenyl, methoxyphenyl, acetamidophenyl, methylphenyl, dichlorophenyl, nitrophenyl, naphthyl, butylphenyl or dimethylphenyl), or $B_{18}$ and $B_{19}$ may combine with each other to form a ring (e.g., tetramethylene, pentamethylene or hexamethylene).

Specific examples of the carboxy group-forming functional group represented by the general formulae (IV) to (VIII) are set forth below, but the present invention should not be construed as being limited thereto.

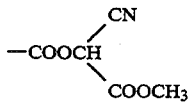

(c-1)

-continued

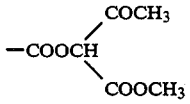

(c-2)

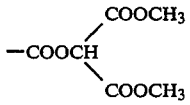

(c-3)

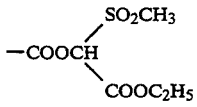

(c-4)

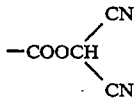

(c-5)

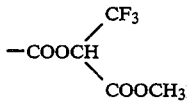

(c-6)

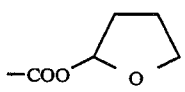

(c-7)

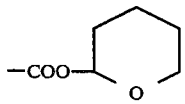

(c-8)

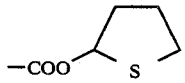

(c-9)

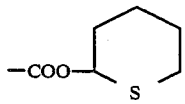

(c-10)

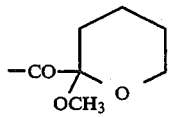

(c-11)

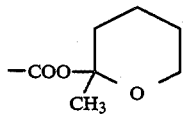

(c-12)

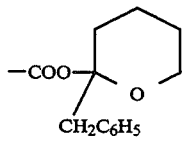

(c-13)

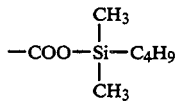

(c-14)

-continued
(c-15)
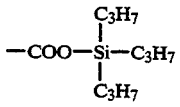
(c-16)
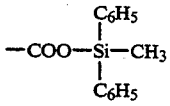
(c-17)
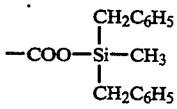
(c-18)
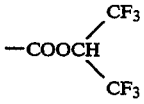
(c-19)
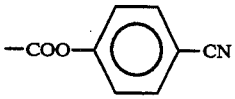
(c-20)
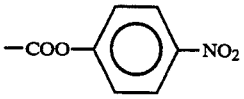
(c-21)
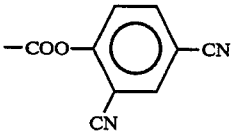
(c-22)
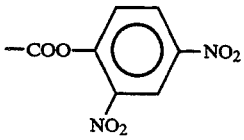
(c-23)
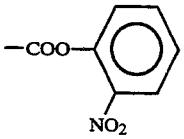
(c-24)
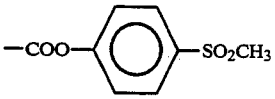
(c-25)
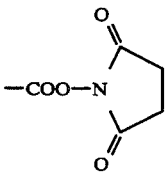
(c-26)
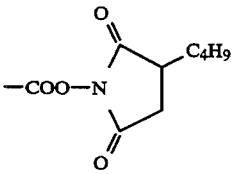
-continued
(c-27)
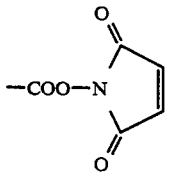
(c-28)
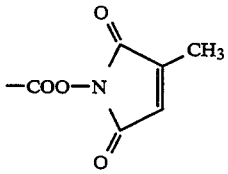
(c-29)
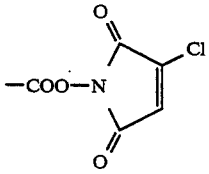
(c-30)
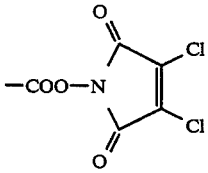
(c-31)
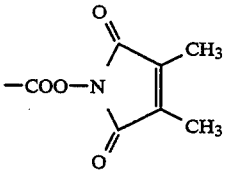
(c-32)
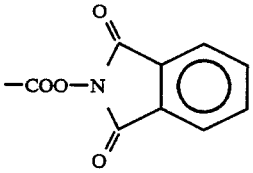
(c-33)
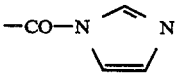
(c-34)
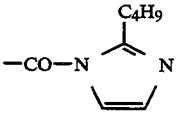
(c-35)
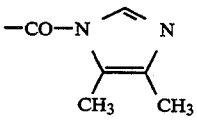
(c-36)
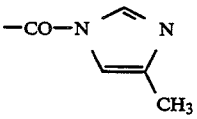

-continued (c-37)

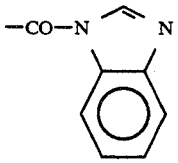

(c-38)

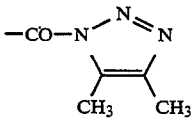

(c-39)

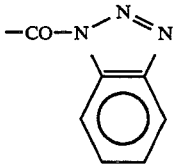

(c-40)

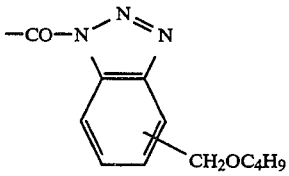

(c-41)

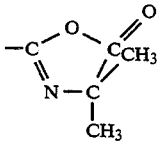

(c-42)

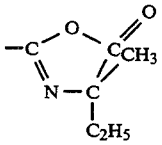

(c-43)

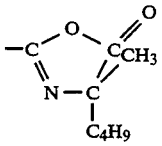

(c-44)

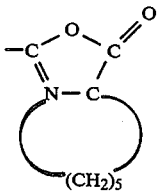

(c-45)

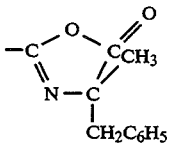

(c-46) $-COOCH_2OCH_3$

-continued (c-47)

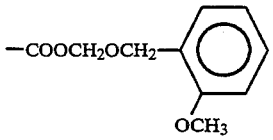

(c-48) $-COOC(C_6H_5)_3$ (c-49) $-COOCH(C_6H_5)_2$ (c-50)

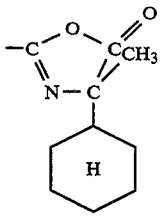

The monomer (C) containing the carboxy group-forming functional group represented by the general formulae (IV) to (VIII) described above can be represented, for example, by the general formula (IX) shown below. However, the monomer (C) according to the present invention should not be construed as being limited thereto.

Formula (IX)

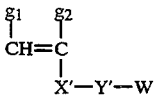

wherein X' represents —O—, —CO—, —COO—, —OCO—,

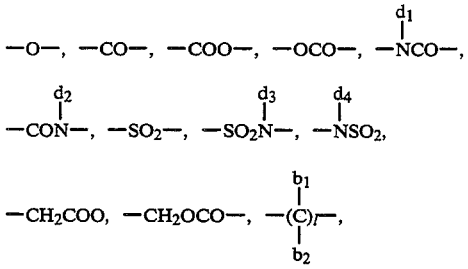

an aromatic group, or a heterocyclic group (wherein $d_1$, $d_2$, $d_3$ and $d_4$ each represents a hydrogen atom, a hydrocarbon group or the moiety of —Y'—W in the general formula (IX); $b_1$ and $b_2$, which may be the same or different, each represents a hydrogen atom, a hydrocarbon group or the moiety of —Y'—W in the general formula (IX); and l is an integer of from 0 to 18); Y' represents a carbon-carbon linkage which may contain a hetero atom (e.g., oxygen, sulfur, or nitrogen) and which connects the linking group of X' to the functional group of W, including for example,

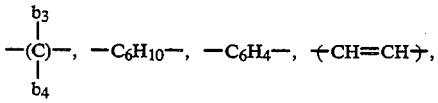

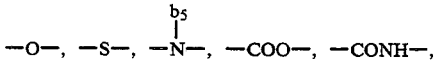

-continued $-SO_2-$, $-SO_2NH-$, $-NHCOO-$, $-NHCOONH-$ or a combination of one or more of these groups (wherein $b_3$, $b_4$ and $b_5$ each has the same meaning as $b_1$ or $b_2$ described above); W represents the functional group represented by the general formulae (IV) to (VIII); and $g_1$ and $g_2$ each has the same meaning as $a_1$ or $a_2$ in the general formula (I) above.

The monofunctional monomer (C) containing at least one functional group selected from the carboxy group-forming functional groups represented by the general formulae (IV) to (VIII) used in the present invention can be synthesized according to a conventionally known reaction in organic synthesis. The synthesis methods are described in greater detail, for example, in Nihon Kagakukai (ed.), *Shin-Jikken Kagaku Koza*, vol. 14, "Yuki Kagobutsu no Gosei to Han-no (V)", p. 2535, Maruzen K.K., Yoshio Iwakura and Keisuke Kurita, *Hannosei Kobunshi* (*Reactive High Molecules*), p. 170, Kodansha, T. W. Greene, *Protective Groups in Organic Synthesis*, Chapter 5, John Wiley & Sons, New York (1981), and J. F. W. McOmie, *Protective Groups in Organic Chemistry*, Chapter 5, Plenum Press (1973).

The content of the monomer (C) is preferably not less than 30 parts by weight, more preferably not less than 50 parts by weight per 100 parts by weight of the total amount of monomers (including the monomer (D) and other monomers employed if desired) for forming the insoluble polymer portion used in the production of the resin grain (L).

Now, the monofunctional monomer (D) which is copolymerizable with the monofunctional monomer (C) containing a carboxy group-forming functional group and which has a silicon and/or fluorine atom-containing substituent will be described in detail below.

The monomer (D) may be any compound which can comply with the above described requirements. A monomer having a substituent containing two or more silicon and/or fluorine atoms is preferred.

Suitable examples of fluorine atom-containing substituent include $-C_hF_{2h+1}$ (h represents an integer of from 1 to 12), $-(CF_2)_jCF_2F$ (j represents an integer of from 1 to 11), and $-C_6H_lF_l$ (l represents 5-l' and l represents an integer of from 2 to 5).

Suitable examples of the silicon -atom-containing substituent include

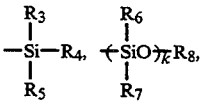

and polysiloxane structure.

In the above described formulae, $R_3$, $R_4$ and $R_5$, which may be the same or different, each represents a hydrocarbon group which may be substituted or $-OR_9$ (wherein $R_9$ represents a hydrocarbon group which may be substituted).

Suitable examples of the hydrocarbon group represented by $R_3$, $R_4$, $R_5$ or $R_9$ include an alkyl group containing from 1 to 18 carbon atoms which may be substituted (e.g., methyl, ethyl, propyl, butyl, hexyl, octyl, decyl, dodecyl, hexadecyl, 2-chloroethyl, 2-bromoethyl, 2,2,2-trifluoroethyl, 2-cyanoethyl, 3,3,3-trifluoropropyl, 2-methoxyethyl, 3-bromopropyl, 2-methoxycarbonylethyl, or 2,2,2,2',2',2'-hexafluoropropyl), an alkenyl group containing from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, or 4-methyl-2-hexenyl), an aralkyl group containing from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, or dimethoxybenzyl), an alicyclic group containing from 5 to 8 carbon atoms which may be substituted (e.g., cyclohexyl, 2-cyclohexylethyl, or 2-cyclopentylethyl) or an aromatic group containing from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propionamidophenyl, dodecyloylamidophenyl).

$R_6$, $R_7$ and $R_8$, which may be the same or different, each has the same meaning as $R_3$, $R_4$ or $R_5$. k represents an integer of from 1 to 20.

Specific examples of the monomer (D) having a substituent containing a silicon and/or fluorine atom are set forth below, but the present invention should not be construed as being limited thereto.

In the following formulae, b represents —H or $-CH_3$; $R_f$ represents $-CH_2C_hF_{2h+1}$ or $-(CH_2)_2(CF_2)_jCF_2H$; $R_1'$, $R_2'$ and $R_3'$ each represents an alkyl group having from 1 to 12 carbon atoms; R'' represents $-Si(CH_3)_3$; h represents an integer of from 2 to 12; j represents an integer of from 1 to 11; i represents an integer of from 1 to 3; l represents an integer of from 1 to 5; q represents an integer of from 1 to 20; r represents an integer of from 0 to 20; and t represents an integer of from 2 to 12.

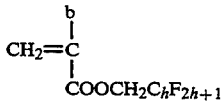

(d-1)

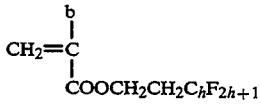

(d-2)

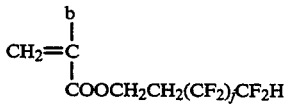

(d-3)

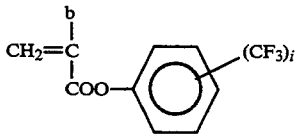

(d-4)

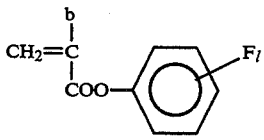

(d-5)

(l = an integer of from 1 to 5)

-continued
(d-6)
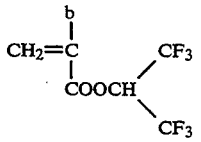
(d-7)
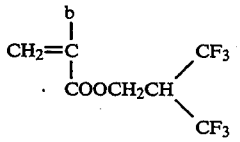
(d-8)
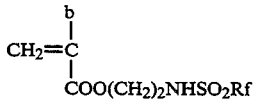
(d-9)
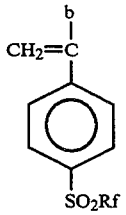
(d-10)
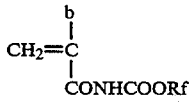
(d-11)
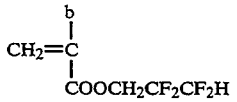
(d-12)
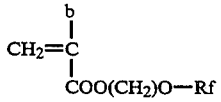
(d-13)
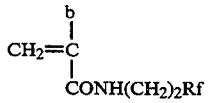
(d-14)
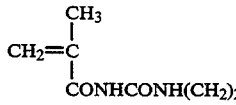
(d-15)
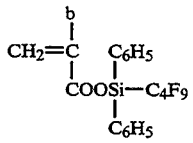
(d-16)
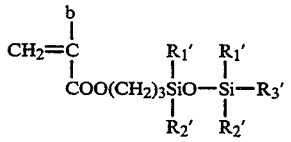
(d-17)
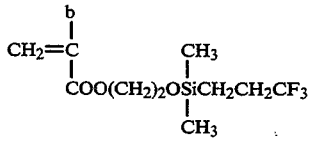
(d-18)
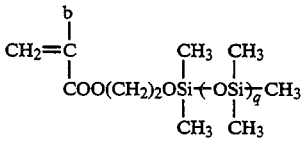
(d-19)
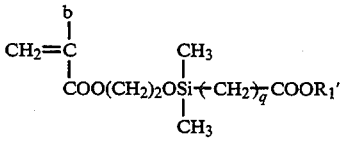
(d-20)
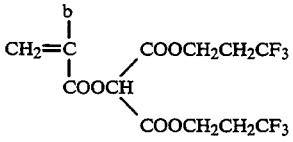
(d-21)
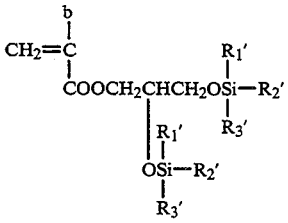
(d-22)
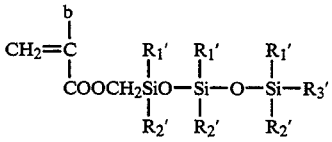
(d-23)
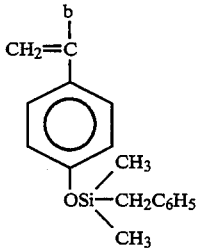
(d-24)
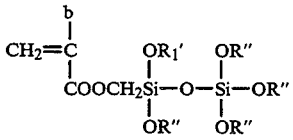
(d-25)
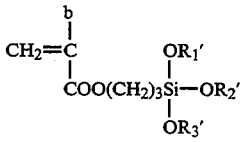
(d-26)
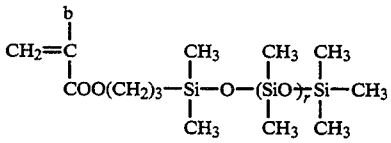
(d-27)
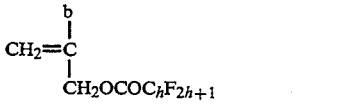

-continued

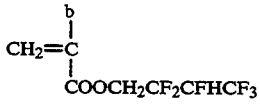

(d-28)

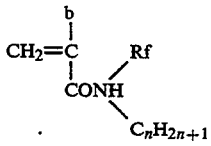

(d-29)

The content of the monomer (D) is preferably from 0.5 to 30% by weight, more preferably from 1 to 20% by weight based on the total amount of the monomer (C) which forms an insoluble polymer portion, the monomer (D) and other monomers which are employed if desired.

The resin grain (L) according to the present invention may be produced by polymerization of the monomer (C) or of the monomer (C) and the monomer (D) together with other monomers. Other monomers may be any monomers which are copolymerizable with the monomer (C) and the monomer (D), and a copolymer formed from which is insoluble in the non-aqueous solvent.

Suitable examples of other monomers include vinyl or allyl esters of aliphatic carboxylic acids (e.g., vinyl acetate, vinyl propionate, vinyl butyrate, allyl acetate, or allyl propionate), esters or amides of unsaturated carboxylic acids including, e.g., acrylic acid, methacrylic acid, crotonic acid, itaconic acid, maleic acid, or fumaric acid, styrene derivatives (e.g., styrene, vinyltoluene, or α-methylstyrene), α-olefins, acrylonitrile, methacrylonitrile, or heterocyclic compounds containing a vinyl group (e.g., N-vinylpyrrolidone).

Suitable examples of other monomers include monomers corresponding to the recurring unit represented by the general formula (V) described hereinafter, and monomers copolymerizable with the monomers corresponding to the recurring unit represented by the general formula (V).

It is important that the polymer component becoming insoluble in the non-aqueous solvent should have such a hydrophilic property that the contact angle with distilled water is 50 degrees or less.

The content of such other monomers is not more than 60% by weight, preferably not more than 50% by weight based on the total amount of the monomers which forms the insoluble polymer portion.

Now, the dispersion stabilizing resin which is soluble in the non-aqueous solvent and functions to stably disperse the insoluble polymer portion formed by polymerization of the monomer (C) in the non-aqueous solvent will be described in detail below.

The dispersion stabilizing resin according to the present invention is soluble in the non-aqueous solvent. Specifically, the resin has such a solubility that at least 5 parts by weight of it is dissolved in 100 parts by weight of the non-aqueous solvent at 25° C.

The weight average molecular weight of the dispersion stabilizing resin is generally in a range of from $1\times10^3$ to $1\times10^5$, preferably from $2\times10^3$ to $1\times10^4$, and more preferably from $3\times10^3$ to $5\times10^4$. If the weight average molecular weight of the dispersion stabilizing resin is less than $1\times10^3$, the resulting dispersed resin grains tend to aggregate, so that fine resin grains whose average grain diameters are uniform can hardly be obtained. On the other hand, if it is more than $5\times10^5$, the advantage of the present invention will rather be decreased that the water retentivity is improved while maintaining the satisfactory electrophotographic characteristics.

As the dispersion stabilizing resin of the present invention, any polymer soluble in the non-aqueous solvent can be used. Specifically, polymers as described in K. B. J. Barrett, "Dispersion Polymerization in Organic Media" published by John Wiley and Sons (1975); R. Dowpenco and D. P. Hart, *Ind. Eng. Chem. Prod. Res. Develop.*, Vol. 12 (No. 1), 14 (1973); Toyokichi Tange, *Nippon Setchaku Kyokaishi*, Vol. 23 (1), 26 (1987); D. J. Walbridege, *NATO. Adv. Study Inst. Ser. E.*, No. 67, 40 (1983); and Y. Sasaki and M. Yabuta, *Proc. 10th, Int. Conf. Org. Coat. Sci. Technol.*, Vol. 10, 263 (1984) can be employed.

For example, these polymers include olefin polymers, modified olefin polymers, styrene-olefin copolymers, aliphatic carboxylic acid vinyl ester copolymers, modified maleic anhydride copolymers, polyester polymers, polyether polymers, methacrylate homopolymers, acrylate homopolymers, methacrylate copolymers, acrylate copolymers, and alkyd resins.

More specifically, a polymer component as a recurring unit of the dispersion stabilizing resin of the present invention is represented by the following general formula (V):

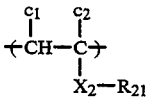

Formula (V)

wherein $R_{21}$ represents a hydrocarbon group; $X_2$ has the same meaning as $V_0$ in the general formula (II); and $c_1$ and $c_2$ each has the same meaning as $b_1$ or $b_2$ in the general formula (II).

The hydrocarbon group represented by $R_{21}$ specifically includes an alkyl group containing from 1 to 22 carbon atoms which may be substituted (e.g., methyl, ethyl, propyl, butyl, pentyl, hexyl, octyl, nonyl, decyl, dodecyl, tridecyl, tetradecyl, hexadecyl, octadecyl, docosanyl, 2-(N,N-dimethylamino)ethyl, 2-(N-morpholino)ethyl, 2-chloroethyl, 2-bromoethyl, 2-hydroxyethyl, 2-cyanoethyl, 2-(α-thienyl)ethyl, 2-carboxyethyl, 2-methoxycarbonylethyl, 2,3-epoxypropyl, 2,3-diacetoxypropyl, 3-chloropropyl, or 4-ethoxycarbonylbutyl), an alkenyl group containing from 3 to 22 carbon atoms which may be substituted (e.g., allyl, hexenyl, octenyl, decenyl, dodecenyl, tridecenyl, octadecenyl, oleyl, or linoleyl), an aralkyl group containing from 7 to 22 carbon atoms which may be substituted (e.g., benzyl, phenethyl, 3-phenylpropyl, 2-naphthylmethyl, 2-(2'-naphthyl)ethyl, chlorobenzyl, bromobenzyl, methylbenzyl, dimethylbenzyl, trimethylbenzyl, methoxybenzyl, dimethoxybenzyl, butylbenzyl, or methoxycarbonylbenzyl), an alicyclic group containing from 4 to 12 carbon atoms which may be substituted (e.g., cyclopentyl, cyclohexyl, cyclooctyl, adamantyl, chlorocyclohexyl, methylcyclohexyl, or methoxycyclohexyl), and an aromatic group containing from 6 to 22 carbon atoms which may be substituted (e.g., phenyl, tolyl, xylyl, mesityl, naphthyl, anthranyl, chlorophenyl, bromophenyl, butylphenyl, hexylphenyl, octylphenyl, decylphenyl, dodecylphenyl, methoxyphenyl, ethoxyphenyl, octyloxyphenyl, ethoxycarbonylphenyl, acetylphenyl, butoxycarbonylphenyl, butylmethylphenyl, N,N-dibutylaminophenyl, N-methyl-N-dodecylphenyl, thienyl, or pyranyl).

The details of $X_2$, $c_1$ and $c_2$ are referred to the descriptions with respect to $V_0$, $b_1$ and $b_2$ in the general formula (II) respectively.

In the dispersion stabilizing resin of the present invention, the polymer component represented by the general formula (V) is present in an amount of, preferably not less than 30 parts by weight, more preferably not less than 50 parts by weight to 100 parts by weight of the whole polymer components of the resin.

In addition to the polymer component represented by the general formula (V), other polymer components may be incorporated as the polymer component in the dispersion stabilizing resin of the present invention.

As other polymer components, there can be used any monomers copolymerizable with the monomer corresponding to the component represented by the general formula (V). Suitable examples of monomers corresponding to other polymer components include α-olefins, acrylonitrile, methacrylonitrile, vinyl group-containing heterocyclic compounds (including, for example, pyrane, pyrrolidone, imidazole, or pyridine as the heterocyclic ring), vinyl group-containing carboxylic acids (e.g., acrylic acid, methacrylic acid, crotonic acid, itaconic acid, or maleic acid), and vinyl group-containing carboxamides (e.g., acrylamide, methacrylamide, crotonylamide, itaconylamide, itaconylsemiamide, or itaconyldiamide).

In a case wherein the dispersion stabilizing resin used in the present invention has a recurring unit containing a silicon and/or fluorine atom-containing substituent, the recurring unit may be of any chemical structure obtained from a radical addition-polymerizable monomer or composed of a polyester or polyether structure, in the side chain of which a silicon and/or fluorine atom is contained.

Suitable examples of the fluorine atom-containing substituent and the silicon atom-containing substituent include those described with respect to the monomer (D) hereinbefore.

Specific examples of the recurring unit having a substituent containing a silicon and/or fluorine atom are set forth below, but the present invention should not be construed as being limited thereto.

In the following formulae, a represents —H or —$CH_3$, $R_f$ represents —$CH_2C_hF_{2h+1}$ or —$(CH_2)_2(CF_2)_jCF_2H$; $R_1'$, $R_2'$ and $R_3'$ each represents an alkyl group having from 1 to 12 carbon atoms; R'' represents —$Si(CH_3)_3$; h represents an integer of from 1 to 12; j represents an integer of from 1 to 11; p represents an integer of from 1 to 3; l represents an integer of from 1 to 5; q represents an integer of from 1 to 20; r represents an integer of from 30 to 150; and t represents an integer of from 2 to 12.

(d'-1)

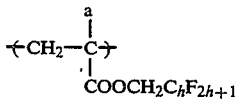

(d'-2)

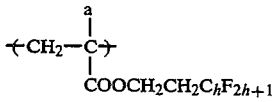

-continued (d'-3)

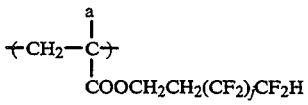

(d'-4)

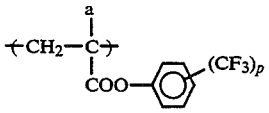

(d'-5)

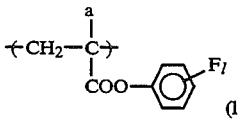

(l is an integer of from 1 to 5)

(d'-6)

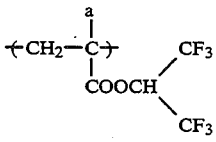

(d'-7)

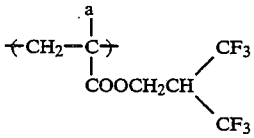

(d'-8)

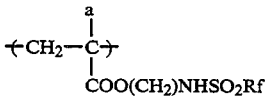

(d'-9)

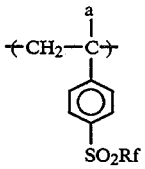

(d'-10)

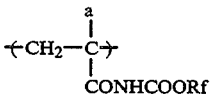

(d'-11)

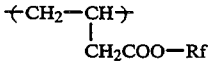

(d'-12)

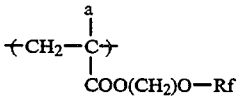

(d'-13)

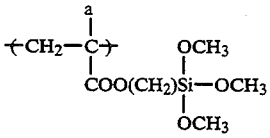

(d'-14)

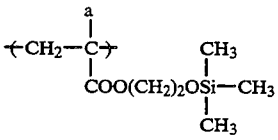

-continued (d'-15)

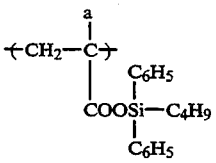

(d'-16)

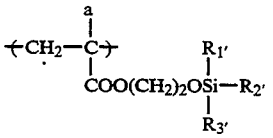

(d'-17)

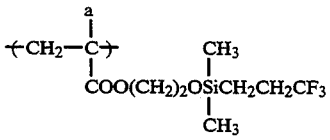

(d'-18)

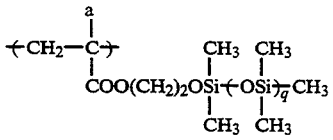

(d'-19)

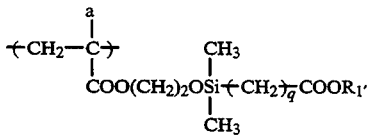

(d'-20)

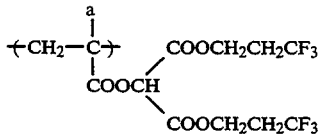

(d'-21)

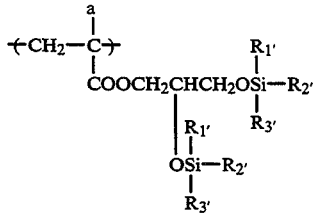

(d'-22)

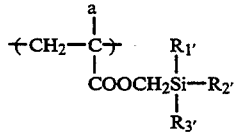

(d'-23)

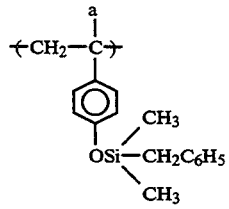

(d'-24)

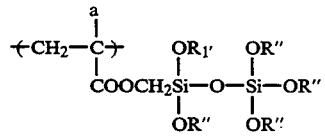

-continued (d'-25)

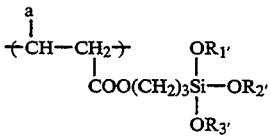

(d'-26)

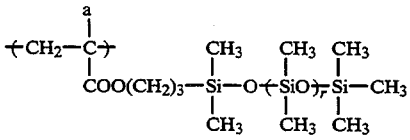

(d'-27)

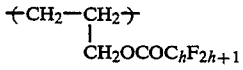

(d'-28)

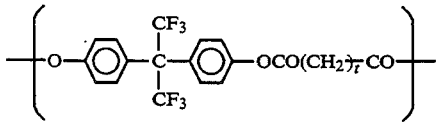

(d'-29)

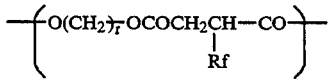

(d'-30)

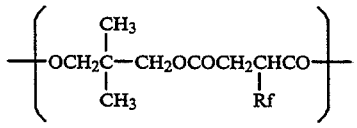

When the dispersion stabilizing resin containing a silicon and/or fluorine atom is used, the amount of the polymer component containing a silicon and/or fluorine atom present in the dispersion stabilizing resin according to the present invention is suitably not less than 30 parts by weight, preferably not less than 50 parts by weight, based on 100 parts by weight of the total polymer component constituting the resin.

The dispersion stabilizing resin used in the present invention may contain a polymer component containing a photo and/or heat curable functional group in a range of not more than 30 parts by weight, preferably not more than 20 parts by weight, based on 100 parts by weight of the total polymer component constituting the resin. Such a dispersion stabilizing resin can form chemical bonds to the binder resin in the photoconductive layer, and thus it is further prevented that resin grains dissolve out from the printing plate with dampening water during printing. The photo and/or heat curable functional groups used are those other than polymerizable functional groups and specifically selected from the crosslinkage-forming functional groups described hereinafter.

Furthermore, the dispersion stabilizing resin according to the present invention preferably contains at least one polymerizable double bond group moiety represented by the above described general formula (II).

The polymerizable double bond group moiety is described hereinbelow.

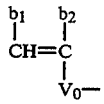

Formula (II)

$V_0$ represents —O—, —COO—, —OCO—, —$(CH_2)_p$—OCO—, —$(CH_2)_p$—COO—, —$SO_2$—,

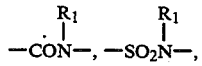

—$C_6H_4$, —CONHCOO— or —CONHCONH— (p represents an integer of from 1 to 4). $R_1$ includes a hydrogen atom and, as preferred examples of the hydrocarbon group, an alkyl group containing from 1 to 18 carbon atoms which may be substituted (e.g., methyl, ethyl, propyl, butyl, pentyl, hexyl, heptyl, octyl, decyl, dodecyl, hexadecyl, octadecyl, 2-chloroethyl, 2-bromoethyl, 2-cycanoethyl, 2-methoxycarbonylethyl, 2-methoxyethyl, and 3-bromopropyl groups), an alkenyl group containing from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, and 4-methyl-2-hexenyl groups), an aralkyl group containing from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, and dimethoxybenzyl groups), an alicyclic group containing from 5 to 8 carbon atoms which may be substituted (e.g., cyclohexyl, 2-cyclohexylethyl, and 2-cyclopentylethyl groups), and an aromatic group containing from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cycanophenyl, acetylphenyl, methoxycarbonylphenyl, ethoxycarbonylphenyl, butoxycarbonylphenyl, acetamidophenyl, propioamidophenyl, and dodecyloylamidophenyl groups).

When $V_0$ represents —$C_6H_4$—, the benzene ring may have a substituent. The substituents include a halogen atom (e.g., chlorine and bromine atoms), an alkyl group (e.g., methyl, ethyl, propyl, butyl, chloromethyl, and methoxymethyl groups), and an alkoxy group (e.g., methoxy, ethoxy, propoxy, and butoxy groups).

$b_1$ and $b_2$, which may be the same or different, each represents preferably a hydrogen atom, a halogen atom (e.g., chlorine and bromine atoms), a cyano group, an alkyl group containing from 1 to 4 carbon atoms (e.g., methyl, ethyl, propyl, and butyl groups), —COO—$R_2$ or —COO—$R_2$ bonded via a hydrocarbon group (wherein $R_2$ represents a hydrocarbon group containing from 1 to 18 carbon atoms including an alkyl group, an alkenyl group, an aralkyl group, an alicyclic group or an aryl group, which may be substituted, and specifically, is the same as those described for $R_1$ above).

The hydrocarbon group in the above described —COO—$R_2$ group bonded via a hydrocarbon group includes a methylene group, an ethylene group, and a propylene group.

More preferably, in the general formula (II), $V_0$ represents —COO—, —OCO—, —$CH_2$OCO—, —$CH_2$COO—, —O—, —CONH—, —$SO_2$NH—, —CONHCOO— or —$C_6H_4$—, and $b_1$ and $b_2$, which may be the same or different, each represents a hydrogen atom, a methyl group, —$COOR_2$ or —$CH_2COOR_2$ (wherein $R_2$ represents an alkyl group containing from 1 to 6 carbon atoms (e.g., methyl, ethyl, propyl, butyl, and hexyl groups)). Further more preferably, either of $b_1$ and $b_2$ represents a hydrogen atom.

Specific examples of the polymerizable double bond group moiety represented by the general formula (II) include:

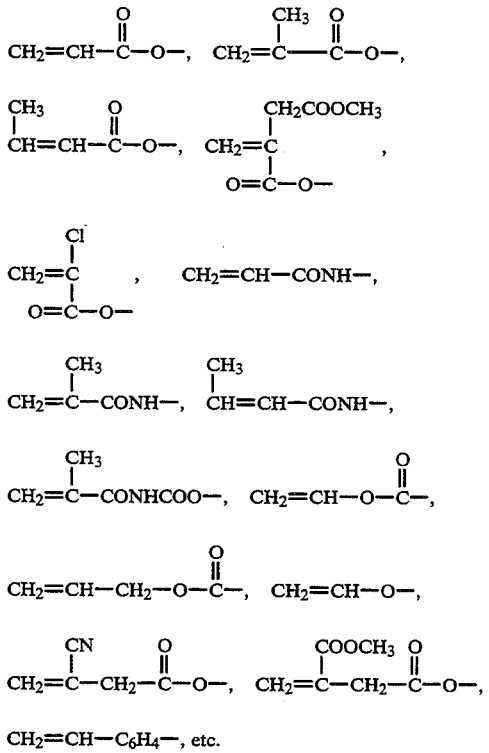

These polymerizable double bond group moieties are bonded to the polymer chain directly or through an appropriate linkage group. The linkage group can be a divalent organic residue, for example, a divalent aliphatic group or a divalent aromatic group, which may contain a linkage group selected from —O—, —S—, —N($d_1$)—, —SO—, —$SO_2$—, —COO—, —OCO—, —CONHCO—, —NHCONH—, —CON($d_2$)—, —$SO_2$($d_3$)— and

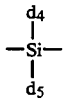

(wherein $d_1$ to $d_5$ have the same meaning as $R_1$ in the general formula (II)), or an organic residue formed from a combination of these divalent residues.

Examples of the divalent aliphatic group include

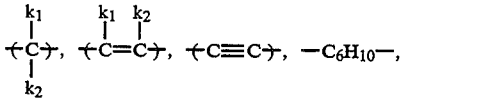

-continued

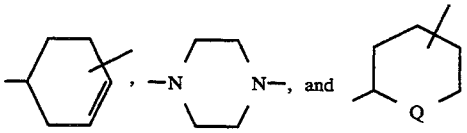

(wherein $k_1$ and $k_2$, which may be the same or different, each represents a hydrogen atom, a halogen atom (e.g., fluorine, chlorine, and bromine atoms) or an alkyl group containing from 1 to 12 carbon atoms (e.g., methyl, ethyl, propyl, chloromethyl, bromomethyl, butyl, hexyl, octyl, nonyl, and decyl groups); and Q represents —O—, —S— or —$NR_{20}$— (wherein $R_{20}$ represents an alkyl group containing from 1 to 4 carbon atoms, —$CH_2Cl$ or —$CH_2Br$).

Examples of the divalent aromatic group include a benzene ring group, a naphthalene ring group and a 5-or 6-membered heterocyclic ring group containing at least one hetero atom selected from an oxygen atom, a sulfur atom and a nitrogen atom, as the hetero atom which forms the ring. The aromatic group may have at least one substituent, and examples of the substituent include a halogen atom (e.g., fluorine, chlorine, and bromine atoms), an alkyl group containing from 1 to 8 carbon atoms (e.g., methyl, ethyl, propyl, butyl, hexyl, and octyl atoms), or an alkoxy group containing from 1 to 6 carbon atoms (e.g., methoxy, ethoxy, propoxy, and butoxy groups).

Examples of the heterocyclic ring include furan, thiophene, pyridine, pyrazine, piperazine, tetrahydrofuran, pyrrole, tetrahydropyran, and 1,3-oxazoline rings.

The above-described polymerizable double bond containing group is bonded to the polymer chain and/or at one terminal of the polymer chain. The polymer having a polymerizable double bond group moiety only at one terminal of its polymer main chain (hereinafter sometimes simply referred to as a monofunctional polymer (M)) is preferred as the dispersion stabilizing resin.

Specific examples of the polymerizable double bond group moiety represented by the general formula (II) bonded to one terminal of the monofunctional polymer (M) and a moiety composed of the organic radical bonded thereto are set forth below, but the present invention should not be construed as being limited thereto.

In the following formulae, $P_1$ represents —H, —$CH_3$, —$CH_2COOCH_3$, —Cl, —Br or —CN; $P_2$ represents —H or —$CH_3$; X represents —Cl or —Br; n represents an integer of from 2 to 12; and m represents an integer of from 1 to 4.

$CH_2{=}C(P_1)-COO(CH_2)_nO-$ (e-1)

$CH(CH_3){=}CH-O(CH_2)_nO-$ (e-2)

$CH_2{=}CH-$ (e-3)

$CH_2{=}CH-CH_2-$ (e-4)

$CH_2{=}C(P_1)-COO(CH_2)_nNH-$ (e-5)

-continued $CH_2{=}C(P_1)-COOCH_2CH(OH)CH_2O$ (e-6)

$CH_2{=}C(P_1)-CONH(CH_2)_n$ (e-7)

$CH_2{=}CH-CH(OH)-CH_2O-$ (e-8)

$CH_2{=}C(P_1)-COOCH_2CH(SH)CH_2O-$ (e-9)

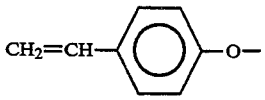
(e-10)

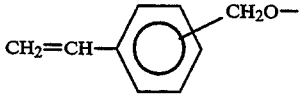
(e-11)

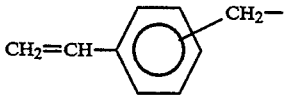
(e-12)

$CH_2{=}C(P_1)-COO(CH_2)_n$ (e-13)

$CH_2{=}C(P_1)-CONH(CH_2)_n$ (e-14)

$CH_2{=}C(P_2)-CONHCOO(CH_2)_n$ (e-15)

$CH_2{=}C(P_2)-CONHCONH(CH_2)_n$ (e-16)

$CH_2{=}CH-CH_2-COO(CH_2)_n$ (e-17)

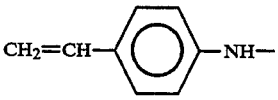
(e-18)

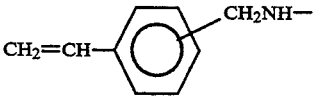
(e-19)

$CH_2{=}C(P_2)-COOCH(CH_2CH_2X)O$ (e-20)

$CH_2{=}C(P_2)-COO(CH_2)_3NHCOO(CH_2)_n$ (e-21)

$CH_2{=}C(P_2)-COO(CH_2CH_2O)_mCO(CH_2)_n$ (e-22)

-continued

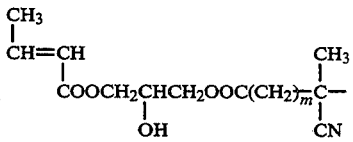

(e-23)

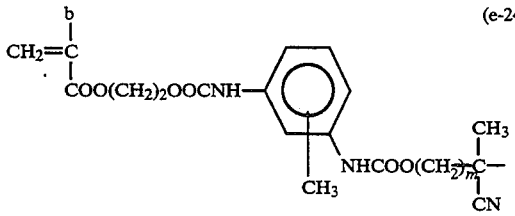

(e-24)

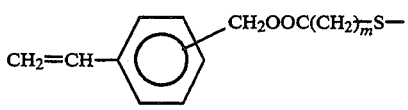

(e-25)

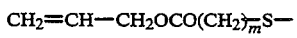

(e-26)

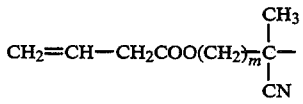

(e-27)

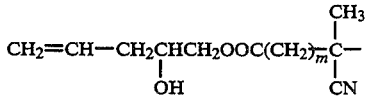

(e-28)

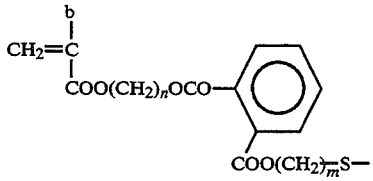

(e-29)

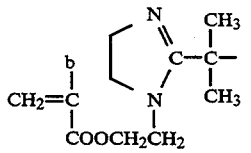

(e-30)

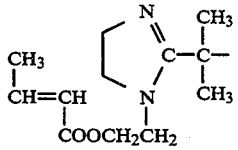

(e-31)

Synthesis of the dispersion stabilizing resin having the polymerizable double bond group moiety in its polymer chain, which is a preferred dispersion stabilizing resin in the present invention, can be performed according to conventionally known methods.

For example, there are a method (1) comprising copolymerizing a monomer containing two polymerizable double bond groups having different polymerization reactivity from each other in the molecule, and a method (2) comprising copolymerizing a monofunctional monomer containing a reactive group, for example, a carboxyl, hydroxyl, amino or epoxy group in the molecule to obtain a polymer and then subjecting to a so-called polymer reaction with an organic low molecular weight compound containing a polymerizable double bond group and another reactive group capable of chemically bonding with the reactive group present in the chain of the polymer, as well known in the art.

The above-described method (1) is described, for example, in JP-A-60-185962.

The above-described method (2) is described in detail, for example, in Yoshio Iwakura and Keisuke Kurita, "Hannosei Kobunshi" (Reactive Polymer) published by Kohdansha (1977), Ryohei Oda, "Kobunshi Fine Chemical" (High Molecular Fine Chemical) published by Kodansha (1976), JP-A-61-43757 and JP-A-3-15862.

The polymer reaction by a combination of a functional group classified as Group A and a functional group classified as Group B shown in Table 1 below is exemplified as an ordinary well-known method. In Table 1, $R_{22}$ and $R_{23}$ each represents a hydrogen atom or a hydrocarbon group having from 1 to 7 carbon atoms which may be substituted (preferably, for example, methyl, ethyl, propyl, butyl, 2-chloroethyl, 2-hydroxyethyl, 3-bromo-2-hydroxypropyl, 2-carboxyethyl, 3-carboxypropyl, 4-carboxybutyl, 3-sulfopropyl, benzyl, sulfobenzyl, methoxybenzyl, carboxybenzyl, phenyl, sulfophenyl, carboxyphenyl, hydroxyphenyl, 2-methoxyethyl, 3-methoxypropyl, 2-methanesulfonylethyl, 2-cyanoethyl, N,N-(dichloroethyl)aminobenzyl, N,N-(dihydroxyethyl)aminobenzyl, chlorobenzyl, methylbenzyl, N,N-(dihydroxyethyl-)aminophenyl, methanesulfonylphenyl, cyanophenyl, dicyanophenyl, and acetylphenyl groups).

TABLE 1

| Group A | Group B |
|---|---|
| —COOH, —$PO_3H_2$ | 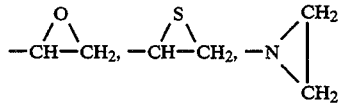 |
| —OH, —SH | —COCl, —$SO_2Cl$, cyclic acid anhydride |
| —$NH_2$ | —N=C=O, —N=C=S |
| —$SO_2H$ | 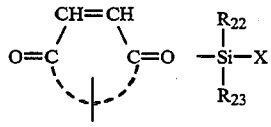 (X = Cl, Br) |

The monofunctional polymer (M) having a polymerizable double bond containing group bonded to only one terminal of the polymer main chain, which is more preferred dispersion stabilizing resin according to the present invention can be produced by conventionally known synthesis methods. For example, there are (i) an ion polymerization method comprising reacting the terminal of a living polymer obtained by an anion or cation polymerization with various reagents to obtain a monofunctional polymer (M), (ii) a radical polymerization method comprising reacting a polymer having a reactive group bonded at the terminal of the polymer chain, obtained by radical polymerization using a polymerization initiator and/or a chain transfer agent each containing a reactive group, for example, a carboxyl group, a hydroxyl group, or an amino group in the molecule with various reagents to obtain a monofunctional polymer (M), and (iii) a polyaddition condensation method comprising introducing a polymerizable double bond group into a polymer obtained by a polyaddition or polycondensation reaction in a similar manner to the above described radical polymerization method.

Specific methods for producing the monofunctional polymer (M) are described, for example, in P. Drefuss & R. P. Quirk, *Encycl. Polym. Sci. Eng.*, 7, 551 (1987), P. F. Rempp, E. Franta, *Adv. Polym. Sci.*, 58, 1 (1984), V. Percec, *Appl. Poly. Sci.*, 285, 95 (1984), R. Asami, M. Takari, *Makromol. Chem. Suppl.*, 12, 163 (1985), P. Rempp et al., "*Makromol. Chem. Suppl.*", 8, 3 (1984), Yusuke Kawakami, *Kagaku Kogyo* (Chemical Industry) 38, 56 (1987), Yuya Yamashita, *Kobunshi* (Polymer) 31, 988 (1982), Shiro Kobayashi, *Kobunshi* (Polymer) 30, 625 (1981), Toshinobu Higashimura, *Nippon Setchaku Kyokaishi* (Japan Adhesive Association), 18, 536 (1982), Koichi Ito, *Kobunshi Kako* (Polymer Processing), 35, 262 (1986), and Kishiro Azuma and Takashi Tsuda, *Kino Zairyo* (Functional Material) 1987, No. 10, 5.

As the synthesis method of the monofunctional polymer (M) described above, more specifically, there can be utilized a method for producing the polymer (M) containing a recurring unit corresponding to the radical-polymerizable monomer as described, for example, in U.S. Pat. Nos. 5,021,311 and 5,055,369, JP-A-3-71152 and JP-A-2-247656, and a method for producing the monofunctional polymer (M) containing a recurring unit corresponding to the polyester or polyether structure as described, for example, in U.S. Pat. No. 5,063,130 and JP-A-2-236562.

Now, the resin grain (L) having a high order network structure which can be used in the present invention will be descried below.

As described above, the resin grain (L) is composed of a polymer portion insoluble in a non-aqueous solvent containing at least the monofunctional monomer (C) as a polymer component and a polymer portion soluble in the non-aqueous solvent consisting of the dispersion stabilizing resin. The resin grain (L) having a high order network structure means that the resin grain (L) has crosslinkages between the polymer portions insoluble in the non-aqueous solvent.

The resin grain (L) having the crosslinking structure is sparingly soluble or insoluble in water. More specifically, the solubility of the resin grain having the network structure in water is $\frac{3}{4}$ or less, preferably $\frac{1}{2}$ or less, of that of the resin grain having no network structure.

Since the resin grain (L) having the high order network structure is prevented from being dissolved-out from the printing plate with dampening water used during printing, the printing plate can maintain good printing properties. Further, the resin grain (L) has water swellability and thus, water retentivity of the printing plate is advantageously improved.

The crosslinkage between polymers described above can be conducted by utilizing a conventionally known crosslinking method. Specifically, (a) a method comprising crosslinking the insoluble polymer portion with various crosslinking agents or hardening agents, (b) a method comprising polymerizing granulation reaction of at least a monomer corresponding to the insoluble polymer portion and a dispersion stabilizing resin in the presence of a polyfunctional monomer or polyfunctional oligomer containing two or more polymerizable functional groups to form a network structure between the molecules, and (c) a method comprising crosslinking a crosslinkable reactive group in the insoluble polymer portion by a polymer reaction can be employed.

As the crosslinking agents used in the above-described method (a), compounds commonly used as cross-linking agents are illustrated. Specifically, compounds are described, for example, in Shinzo Yamashita and Tosuke "Kakyozai Handbook" (Handbook of Cross-linking Agents) published by Taiseisha (1981) and Kobunshi Gakkai Edition "Kobunshi Data Handbook Kisohen" (Polymer Data Handbook Basis) published by Baifukan (1986).

Suitable examples of the crosslinking agents include organosilane compounds ( for example, vinyltrimethoxysilane, vinyltributoxysilane, γ-glycidoxypropyltrimethoxysilane, γ-mercaptopropyltriethoxysilane, γ-aminopropyltriethoxysilane and other silane coupling agents), polyisocyanate compounds (for example, tolylene diisocyanate, o-tolylene diisocyanate, diphenylmethane diisocyanate, triphenylmethane triisocyanate, polymethylenepolyphenyl isocyanate, hexamethylene diisocyanate, isophorone diisocyanate, and high molecular polyisocyanates), polyol compounds (for example, 1,4-butanediol, polyoxypropylene glycol, polyoxyalkylene glycol, and 1,1,1-trimethylolpropane), polyamine compounds (for example, ethylenediamine, γ-hydroxypropylated ethylenediamine, phenylenediamine, hexamethylenediamine, N-aminoethylpiperazine, and modified aliphatic polyamines), polyepoxy group-containing compounds and epoxy resins (for example, compounds as described in Kakiuchi Hiroshi "Shin Epoxy Jushi" (New Epoxy Resins) published by Shokodo (1985), and Kuniyuki Hashimoto "Epoxy Jushi" (Epoxy Resins) published by Nikkan Kogyo Shinbunsha (1969)), melamine resins (for example, compounds as described in Ichiro Miwa and Hideo Matsunaga "Urea-Melamine Jushi" (Urea and Melamine Resins) published by Nikkan Kogyo Shinbunsha (1969)), and poly(meth)acrylate compounds (for example, compounds as described in Shin Ogawara, Takeo Saegusa and Toshinobu Higashimura "Oligomers" published by Kodansha (1976) and Eizo Omori "Kinosei Acryl-Kei Jushi" (Functional Acrylic Resins) published by Technosystem (1985) including specifically, polyethylene glycol diacrylate, neopentyl glycol diacrylate, 1,6-hexanediol diacrylate, trimethylolpropane triacrylate, pentaerythritol polyacrylate, bisphenol A-diglycidyl ether diacrylate, oligoester acrylate and methacrylates thereof.

Suitable examples of the polymerizable function groups of the polyfunctional monomer (hereinafter sometimes referred to as polyfunctional monomer (E)) or polyfunctional oligomer containing at least two polymerizable functional groups used in the above described method (b) include

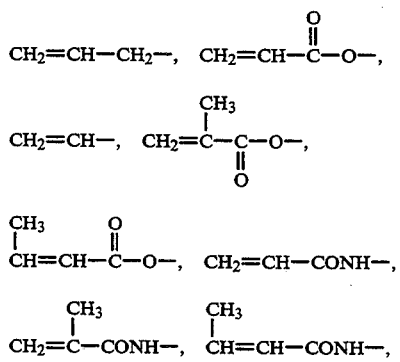

-continued

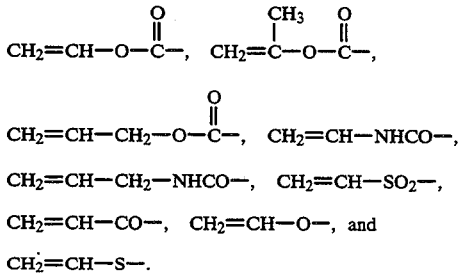

Any of monomers or oligomers containing two or more, same or different polymerizable functional groups may be used.

As specific examples of monomers having two or more polymerizable functional groups, for example, monomers or oligomers having the same polymerizable functional groups include styrene derivatives (e.g., divinyl benzene and trivinyl benzene), esters of a polyhydric alcohol (e.g. , ethylene glycol, diethylene glycol, triethylene glycol, polyethylene glycols #200, 400 and 600, 1,3-butylene glycol, neopentyl glycol, dipropylene glycol, polypropylene glycol, trimethylolpropane, trimethylolethane and pentaerythritol) or a polyhydroxyphenol (e.g., hydroquinone, resorcinol, catechol and derivatives thereof) with methacrylic acid, acrylic acid or crotonic acid, and vinyl ethers or allyl ethers thereof, vinyl eaters of dibasic acids (e.g., malonic acid, succinic acid, glutaric acid, adipic acid, pimelic acid, maleic acid, phthalic acid and itaconic acid), and allyl esters, vinylamides or allylamides thereof, and condensates of a polyamine (e.g., ethylenediamine, 1,3-propylenediamine and 1,4-butylenediamine) with a carboxylic acid containing a vinyl group (e.g., methacrylic acid, acrylic acid, crotonic acid and allylacetic acid).

Monomers or oligomers having two or more different polymerizable functional groups include, for example, ester derivatives or amide derivatives containing vinyl groups of a carboxylic acid containing a vinyl group (e.g., methacrylic acid, acrylic acid, methacryloylacetic acid, acryloylacetic acid, methacryloylpropionic acid, acryloylpropionic acid, itaconyloylacetic acid, itaconyloylpropionic acid, and a reaction product of a carboxylic anhydride with an alcohol or amine (e.g., allyloxycarbonylpropionic acid, allyloxycarbonylacetic acid, 2-allyloxycarbonylbenzoic acid and allylaminocarbonylpropionic acid), for example, vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, vinyloxycarbonylmethyl methacrylate, vinyloxycarbonylmethyloxycarbonylmethylene ester of acrylic acid, N-allylacrylamide, N-allylmethacrylamide, N-allylitaconamide, and methcaryloylpropionic acid allylamide; and condensates of an amino alcohol (e.g., aminoethanol, 1-aminopropanol, 1-aminobutanol, 1-aminohexanol and 2-aminobutanol) with a carboxylic acid containing a vinyl group.

The monomer or oligomer containing two or more polymerizable functional groups used in the present invention is generally used for the polymerization in a proportion of not more than 10% by weight, preferably not more than 5% by weight based on the total amount of the monomer (C) and other monomers coexistent to form a resin.

The crosslinking of polymers by reacting reactive groups in the polymers to form a chemical bond according to the above described method (c) can be carried out in a similar manner to ordinary reaction of organic low molecular weight compound. Specifically, the method as described in the synthesis of the dispersion stabilizing resin above can be applied thereto.

In the dispersion polymerization, the above described method (b) using a polyfunctional monomer or oligomer is preferred as a method for forming a network structure because of obtaining grains of monodisperse system with a uniform grain diameter and tending to obtain fine grains with a grain diameter of not more than 0.8 μm.

As the non-aqueous solvent for the preparation of the non-aqueous solvent dispersed resin grain (L), any of organic solvents having a boiling point of not more than 200° C. may be employed individually or as a mixture of two or more thereof. Useful examples of the organic solvent include alcohols (e.g., methanol, ethanol, propanol, butanol, a fluorinated alcohol and benzyl alcohol), ketones (e.g., acetone, methyl ethyl ketone, cyclohexanone and diethyl ketone), ethers (e.g., diethyl ether, tetrahydrofuran and dioxane), carboxylic acid esters (e.g., methyl acetate, ethyl acetate, butyl acetate and methyl propionate), aliphatic hydrocarbons containing from 6 to 14 carbon atoms (e.g., hexane, octane, decane, dodecane, tridecane, cyclohexane and cyclooctane), aromatic hydrocarbons (e.g., benzene, toluene, xylene and chlorobenzene), and halogenated hydrocarbons (e.g., methylene chloride, dichloroethane, tetrachloroethane, chloroform, methylchloroform, dichloropropane and trichloroethane).

When dispersed resin grains are synthesized by the dispersion polymerization method in a non-aqueous solvent system, the average grain diameter of the resin grains obtained can readily be adjusted to not more than 0.8 μm while simultaneously obtaining grains of monodisperse system with a very narrow distribution of grain diameter.

More specifically, the dispersion polymerization method is described, for example, in K. B. J. Barrett "Dispersion Polymerization in Organic Media" John Wiley & Sons (1975), Koichiro Murata, *Kobunshi Kako* (Polymer Processing), 23, 20 (1974), Tsunetaka Matsumoto and Toyokichi Tange, *Nippon Setchaku Kyokaishi* (Journal of The Japan Adhesive Association), 9, 183 (1973), Toyokichi Tange, *Nippon Setchaku Kyokaishi* (Journal of The Japan Adhesive Association), 23, 26 (1987), D. J. Walbridge, *NATO. Adv. Study Inst. Ser. B.*, No. 67, 40 (1983), British Patents 893,429 and 934,038, U.S. Pat. Nos. 1,122,397, 3,900,412 and 4,606,989, JP-A-60-179751 and JP-A-60-185963.

The dispersed resin grain of the present invention comprises at least one of the monomers (C) and at least one of the dispersion stabilizing resins, and optionally contains the polyfunctional monomer (E) when a network structure is formed. In any case, it is important that if a resin synthesized from such a monomer is insoluble in the non-aqueous solvent, the desired dispersed resin grain can be obtained. More specifically, it is preferred to use from 1 to 50% by weight, more preferably from 2 to 30% by weight of the dispersion stabilizing resin to the total amount of the monomers constituting the insoluble polymer portion such as the monomer (C).

The preparation of the dispersed resin grain (L) used in the present invention is carried out by polymerizing with heating the monomer required such as the monomer (C) and the dispersion stabilizing resin in the presence of a polymerization initiator (e.g., benzoyl peroxide, azobisisobutyronitrile, or butyllithium) in a non-aqueous solvent. Specifically, there are (i) a method comprising adding a polymerization initiator to a mixed solution of the requested monomer such as the monomer (C) and the dispersion stabilizing resin, and (ii) a method comprising adding suitably the above described components and a polymerization initiator to a non-aqueous solvent. However, any other suitable methods can be employed without limiting to these methods.

The total amount of the components constituting the insoluble polymer portion is usually from 5 to 80 parts by weight, preferably from 10 to 50 parts by weight per 100 parts by weight of the non-aqueous solvent.

The amount of the polymerization initiator is usually from 0.1 to 5% by weight of the total amount of the polymerizable compounds. The polymerization temperature is from about 50° to about 180° C., preferably from 60° to 120° C. The reaction time is preferably from 1 to 15 hours.

It is preferred to employ the resin grain (L) according to the present invention in an amount of from 0.01 to 30 parts by weight per 100 parts by weight of photoconductive zinc oxide.

In the present invention, photoconductive zinc oxide is used as an inorganic photoconductive substance, but other inorganic photoconductive substances, for example, titanium oxide, zinc sulfide, cadmium sulfide, cadmium carbonate, zinc selenide, cadmium selenide, tellurium selenide or lead sulfide can be used together with zinc oxide. In such a case, however, the amount of the other inorganic photoconductive substances is not more than 40% by weight, preferably not more than 20% by weight of the photoconductive zinc oxide used. When the amount of the other inorganic photoconductive substances exceeds 40% by weight, the effect for increasing the hydrophilic property in the non-image areas of the lithographic printing plate formed may decrease.

The photoconductive zinc oxide used in the present invention include zinc oxide conventionally known in the field of art. In addition to a so-called zinc oxide, zinc oxide processed with an acid, zinc oxide pre-processed with a dye or zinc oxide pulverized kneading (so-called press-processed zinc oxide) can be employed without any particular limitation.

The total amount of the binder resin used for the photoconductive zinc oxide in the photoconductive layer of the lithographic printing plate precursor according to the present invention is preferably from 10 to 100 parts by weight, and more preferably from 15 to 50 parts by weight, per 100 parts by weight of the photoconductive zinc oxide.

The spectral sensitizing dye used in the photoconductive layer according to the present invention may be any of dyes conventionally known. These dyes can be employed individually or in combination. Examples of these dyes include carbonium dyes, diphenylmethane dyes, triphenylmethane dyes, xanthene dyes, phthalein dyes, polymethine dyes (e.g., oxonol dyes, merocyanine dyes, cyanine dyes, rhodacyanine dyes, and styryl dyes), and phthalocyanine dyes (which may contain metals) as described, for example, in Harumi Miyamoto and Hidehiko Takei, *Imaging*, 1973, (No. 8), 12, C. J. Young et al, *RCA Review*, 15, 469 (1954), Kohei Kiyota, *Journal of Electric Communication Society of Japan*, J 63 C (*No.* 2), 97 (1980), Yuji Harasaki et al, *Kogyo Kagaku Zasshi*, 66, 78 and 188 (1963), and Tadaaki Tani, *Journal of the Society of Photographic Science and Technology of Japan*, 35, 208 (1972).

Specific examples of suitable carbonium dyes, triphenylmethane dyes, xanthene dyes, and phthalein dyes are described, for example, in JP-B-51-452, JP-A-50-90334, JP-A-50-114227, JP-A-53-39130, JP-A-50-82353, U.S. Pat. Nos. 3,052,540 and 4,054,450 and JP-A-57-16456.

The polymethine dyes such as oxonol dyes, merocyanine dyes, cyanine dyes, and rhodacyanine dyes which can be used include those described, for example, in F. M. Harmmer, *The Cyanine Dyes and Related Compounds*, and, more specifically, the dyes described, for example, in U.S. Pat. Nos. 3,047,384, 3,110,591, 3,121,008, 3,125,447, 3,128,179, 3,132,942, and 3,622,317, British Patents 1,226,892, 1,309,274, and 1,405,898, JP-B-48-7814 and JP-B-55-18892.

Furthermore, polymethine dyes capable of spectrally sensitizing in the wavelength region of from near infrared to infrared longer than 700 nm are those described, for example, in JP-A-47-840, JP-A-47-44180, JP-B-51-41061 JP-A-49-5034, JP-A-49-45122, JP-A-57-46245, JP-A-56-35141, JP-A-57-157254, JP-A-61-26044, JP-A-61-27551, U.S. Pat. Nos. 3,619,154 and 4,175,956, and *Research Disclosure*, 216, 117 to 118 (1982).

The light-sensitive material of the present invention is excellent in that, even when various sensitizing dyes are used for the photoconductive layer, the performance thereof is not liable to vary by such sensitizing dyes.

Further, if desired, the photoconductive layers may further contain various known additives commonly employed in electrophotographic light-sensitive layer, such as chemical sensitizers. Examples of such additives include electron-acceptive compounds (e.g., halogen, benzoquinone, chloranil, acid anhydrides, and organic carboxylic acids) as described, for example, in *Imaging*, 1973, (No. 8), page 12, and polyarylalkane compounds, hindered phenol compounds, and p-phenylenediamine compounds as described in Hiroshi Kokado et al, *Saikin no Kododenzairyo to Kankotai no Kaihatsu to Jitsuyoka* (*Recent Development and Practical Use of Photoconductive Materials and Light-sensitive Materials*), Chapters 4 to 6, Nippon Kagaku Joho K.K. (1986).

There is no particular restriction on the amount of these additives added, but the amount thereof is usually from 0.001 to 2.0 parts by weight per 100 parts by weight of the photoconductive substance.

The thickness of the photoconductive layer according to the present invention is suitably from 1 μm to 100 μm, and preferably from 10 μm to 50 μm.

Also, when the photoconductive layer is used as a charge generating layer of a double layer type electrophotographic light-sensitive material having the charge generating layer and a charge transporting layer, the thickness of the charge generating layer is suitably from 0.01 μm to 1 μm, and preferably from 0.05 μm to 0.5 μm.

As the charge transporting materials for the double layer type light-sensitive material, there are polyvinylcarbazole, oxazole dyes, pyrazoline dyes, and triphenylmethane dyes. The thickness of the charge transporting layer is suitably from 5 μm to 40 μm, and preferably from 10 μm to 30 μm.

Resins which can be used for the charge transporting layer typically include thermoplastic and thermosetting resins such as polystyrene resins, polyester resins, cellulose resins, polyether resins, vinyl chloride resins, vinyl acetate resins, vinyl chloride-vinyl acetate copolymer resins, polyacryl resins, polyolefin resins, urethane resins, polyester resins, epoxy resins, melamine resins, and silicone resins.

The photoconductive layer according to the present invention can be provided on a conventional support. In general, the support for the electrophotographic light-sensitive material is preferably electroconductive. As the electroconductive support, there are base materials such as metals, paper, and plastic sheets rendered electroconductive by the impregnation of a low resistant substance, the base materials in which the back surface thereof (the surface opposite to the surface of providing a photoconductive layer) is rendered electroconductive and having coated with one or more layer for preventing the occurrence of curling of the support, the above-described support having formed on the surface a water-resistant adhesive layer, the above-described support having formed on the surface at least one precoat, and a support formed by laminating on paper a plastic film rendered electroconductive by vapor depositing thereon aluminum.

More specifically, the electroconductive base materials or conductivity-imparting materials as described, for example, in Yukio Sakamoto, *Denshi Shashin* (*Electrophotography*), 14 (No. 1), 2–11 (1975), Hiroyuki Moriga, *Nyumon Tokushu Shi no Kagaku* (*Introduction for Chemistry of Specific Paper*), Kobunshi Kankokai (1975), and M. F. Hoover, *J. Macromol. Sci. Chem.*, A-4 (6), 1327–1417 (1970) can be used.

The production of the lithographic printing plate precursor of the present invention can be carried out in a conventional manner by dissolving or dispersing the components for forming the photoconductive layer including the binder resin (A) and the resin grain (L) according to the present invention in a volatile hydrocarbon solvent having a boiling point of not more than 200° C. and coating it on an electroconductive substrate, followed by drying, to form an electrophotographic light-sensitive layer (photoconductive layer). The organic solvent preferably used includes a halogenated hydrocarbon containing from 1 to 3 carbon atoms, for example, dichloromethane, chloroform, 1,2-dichloroethane, tetrachloroethane, dichloropropane, or trichloroethane. In addition, various solvents for coating a composition of photoconductive layer, for example, aromatic hydrocarbons such as chlorobenzene, toluene, xylene, and benzene, ketones such as acetone, and 2-butanone, ethers such as tetrahydrofuran, and methylene chloride, and a mixture of the above-described solvents can be used.

The production of a lithographic printing plate from the electrophotographic lithographic printing plate precursor of the present invention can be carried out in a conventional manner wherein the duplicated images are formed on the electrophotographic lithographic printing plate precursor and then the non-image areas are subjected to an oil-desensitizing treatment to prepare a lithographic printing plate. Of the oil-desensitizing treatment according to the present invention, an oil-desensitization of zinc oxide can be conducted in a conventionally known manner. On the other hand, for the purpose of an oil-desensitizing treatment of the resin grain, a method of providing hydrophilicity can be utilized wherein the resin grain of the present invention is decomposed to form a carboxy group through a hydrolysis reaction or redox reaction by the treatment with a processing solution or a method of irradiating light. More specifically, the treatment can be carried out by any of (1) a method of effecting simultaneously the oil-desensitizing treatment of zinc oxide grain and the resin grain, (2) a method comprising effecting the oil-desensitizing treatment of zinc oxide grain and then effecting the oil-desensitizing treatment of the resin grain, and (3) a method comprising effecting the oil-desensitizing treatment of the resin grain and then effecting the oil-desensitizing treatment of zinc oxide.

In the method for the oil-desensitization of zinc oxide, there can be used any of known processing solutions. For example, processing solution containing, as a main oil-desensitizing component, a ferrocyanide compound as described, for example, in JP-A-62-239158, JP-A-62-292492, JP-A-63-99993, JP-A-63-9994, JP-B-40-7334, JP-B-45-33683, JP-A-57-107889, JP-B-46-21244, JP-B-44-9045, JP-B-47-32681, JP-B-55-9315 and JP-A-52-101102 may be employed.

However, in view of safety of the processing solution, those containing a phytic acid compound as the main component, as described, for example, in JP-B-43-28408, JP-B-45-24609, JP-A-51-103501, JP-A-54-10003, JP-A-53-83805, JP-A-53-83806, JP-A-53-127002, JP-A-54-44901, JP-A-56-2189, JP-A-57-2796, JP-A-57-20394 and JP-A-59-207290; those containing a water-soluble polymer capable of forming a metal chelate as the main component, as described, for example, in JP-B-38-9665, JP-B-39-22263, JP-B-40-763, JP-B-43-28404, JP-B-47-29642, JP-A-52-126302, JP-A-52-134501, JP-A-53-49506, JP-A-53-59502 and JP-A-53-104302; those containing a metal complex compound as the main component, as described, for example, in JP-A-53-104301, JP-B-55-15313 and JP-B-54-41924; and those containing an inorganic or organic acid compound as the main component, as described, for example, in JP-B-39-13702, JP-B-40-10308, JP-B-46-26124, JP-A-51-118501 and JP-A-56-111695 are preferably used.

The oil-desensitizing method of the resin grain to be used wherein a protected carboxy group is decomposed can be appropriately selected depending on decomposition reactivity of the protected carboxy group. One method comprises hydrolysis of the protected group with an aqueous solution in an acidic condition having a pH of 1 to 6 or in an alkaline condition having a pH of 8 to 12. The pH of the solution can be easily adjusted by using known compounds. Another method comprises a redox reaction using a water-soluble reductive or oxidative compound. Such a compound can be selected from known compounds, for example, anhydrous hydrazine, sulfites, lipoic acid, hydroquinones, formic acid, thiosulfates, hydrogen peroxide, persulfates and quinones.

The processing solution may contain other compounds in order to accelerate the reaction or improve preservation stability of the processing solution. For example, a water-soluble organic solvent may be added in a proportion of from 1 to 50 parts by weight to 100 parts by weight of water. Suitable examples of the water-soluble organic solvents include an alcohol (for example, methanol, ethanol, propanol, propargyl alcohol, benzyl alcohol, or phenethyl alcohol), a ketone (for example, acetone, methyl ethyl ketone, or acetophenone), an ether (for example, dioxane, trioxane tetrahydrofuran, ethylene glycol, propylene glycol, ethylene glycol monomethyl ether, propylene glycol monomethyl ether, or tetrahydropyran), an amide (for example, dimethylformamide, or dimethylacetamide), an ester (for example, methyl acetate, ethyl acetate, or ethyl formate). The organic solvents can be used individually or as a mixture of two or more thereof.

Furthermore, a surfactant can be incorporated into the processing solution in a proportion of from 0.1 to 20 parts by weight to 100 parts by weight of water. Suitable examples of the surfactants include anionic, cationic and nonionic surfactants well known in the art, for example, those described in Hiroshi Horiguchi, *Shin-Kaimen Kasseizai* (New Surfactants), Sankyo Shuppan KK (1975), and Ryohei Oda and Kazuhiro Teramura, *Kaimen Kasseizai no Gosei to Sono Oyo* (Synthesize of Surfactants and Applications Thereof), Maki Shoten (1980). .

With respect to the conditions of the treatment, a processing temperature is preferably from 15° to 60° C. and a processing time is preferably from 10 seconds to 5 minutes.

In a case wherein the specific functional group present in the resin according to the present invention is decomposed upon irradiation by light, it is preferred to insert a step of irradiation by a chemically active ray after the formation of toner image at plate making. More specifically, after electrophotographic development, the irradiation is conducted either simultaneously with fixing of the toner image, or after fixing of toner image according to a conventionally known fixing method using, for example, heat, pressure or solvent.

The term "chemically active ray" used in the present invention can be any of visible ray, ultraviolet ray, far ultraviolet ray, electron beam, X-ray, $\gamma$-ray and $\alpha$-ray. Among them, ultraviolet ray is preferred, and ray having a wavelength of from 310 nm to 500 nm is more preferred. A high-pressure or super high-pressure mercury lamp is usually employed. The treatment of irradiation is ordinarily conducted at a distance of from 5 cm to 50 cm and for a period of from 10 seconds to 10 minutes.

BEST MODE FOR CONDUCTING THE INVENTION

The present invention is illustrated in greater detail with reference to the following examples, but the present invention is not to be construed as being limited thereto.

Synthesis examples of the resin (A) are specifically illustrated below.

SYNTHESIS EXAMPLE 1 OF RESIN (A): Resin (A-1)

A mixed solution of 95 g of benzyl methacrylate, 5 g of acrylic acid, and 200 g of toluene was heated to 90° C. under nitrogen gas stream, and 6.0 g of 2,2'-azobisisobutyronitrile (abbreviated as AIBN) was added thereto to effect reaction for 4 hours. To the reaction mixture was further added 2 g of AIBN, followed by reacting for 2 hours. The resulting resin (A-1) had a weight average molecular weight of 8,500.

SYNTHESIS EXAMPLES 2 TO 28 OF RESIN (A): Resins (A-2) to (A-28)

Resins (A) shown in Table 2 below were synthesized under the same polymerization conditions as described in Synthesis Example 1 of Resin (A), respectively. A weight average molecular weight of each of the resin (A) was in a range of from $5.0\times10^3$ to $9.0\times10^3$.

TABLE 2

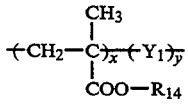

| Synthesis Example of Resin (A) | Resin (A) | $R_{14}$ | $Y_1$ | x/y (weight ratio) |
|---|---|---|---|---|
| 2 | A-2 | $-CH_2C_6H_5$ | $-CH_2-C(CH_3)(COOH)-$ | 94/6 |
| 3 | A-3 | 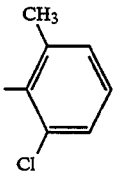 | $-CH_2-CH(COOCH_2CH_2COOH)-$ | 95/5 |
| 4 | A-4 | $-C_6H_5$ | $-CH_2-CH(COOH)-$ | 95/5 |
| 5 | A-5 | $-CH_2C_6H_5$ | $-CH_2-C(CH_3)(COOCH_2CH_2-O-P(=O)(OH)-OH)-$ | 97/3 |
| 6 | A-6 | 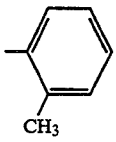 | $-CH_2-CH(COOH)-$ | 95/5 |

TABLE 2-continued
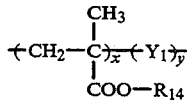
| Synthesis Example of Resin (A) | Resin (A) | $R_{14}$ | $Y_1$ | x/y (weight ratio) |
|---|---|---|---|---|
| 7 | A-7 | 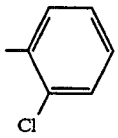 | 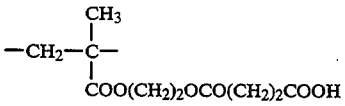 | 94/6 |
| 8 | A-8 | 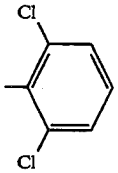 | 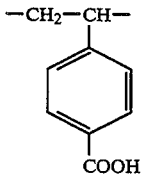 | 95/5 |
| 9 | A-9 | $-CH_2C_6H_5$ | 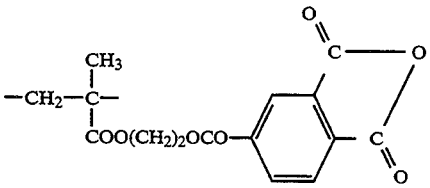 | 97/3 |
| 10 | A-10 | 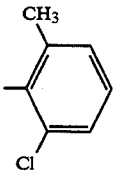 | 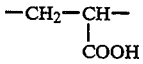 | 95/5 |
| 11 | A-11 | 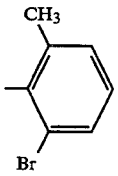 | 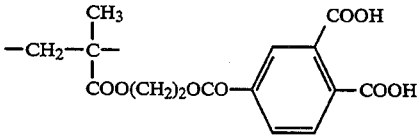 | 96/4 |
| 12 | A-12 | 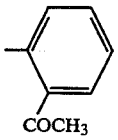 | 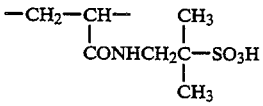 | 97/3 |
| 13 | A-13 | 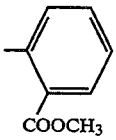 | 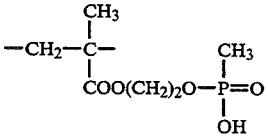 | 97/3 |
| 14 | A-14 | 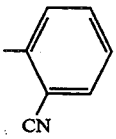 | 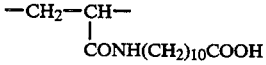 | 94/6 |

TABLE 2-continued
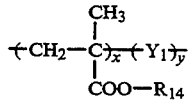
| Synthesis Example of Resin (A) | Resin (A) | $R_{14}$ | $Y_1$ | x/y (weight ratio) |
|---|---|---|---|---|
| 15 | A-15 | 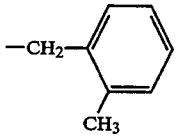 | 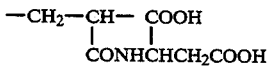 | 97/3 |
| 16 | A-16 | 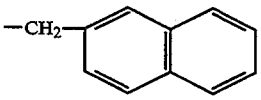 | 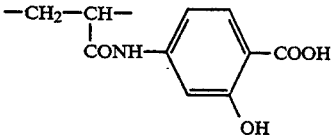 | 95/5 |
| 17 | A-17 | 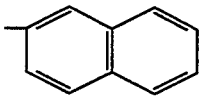 | 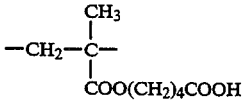 | 93/7 |
| 18 | A-18 | 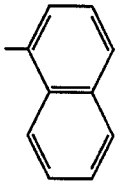 | 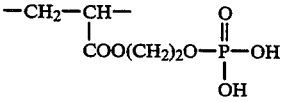 | 97/3 |
| 19 | A-19 | 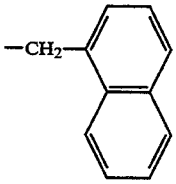 | 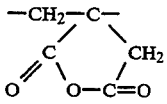 | 95/5 |
| 20 | A-20 | 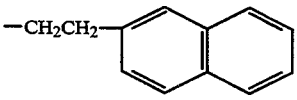 | 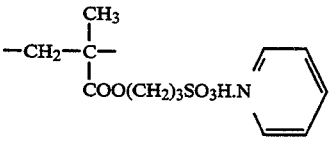 | 98/2 |
| 21 | A-21 | 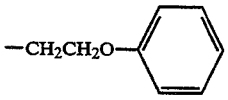 | 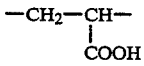 | 96/4 |
| 22 | A-22 | $-CH_2C_6H_5$ | 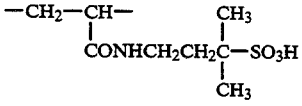 | 97/3 |
| 23 | A-23 | 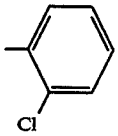 | 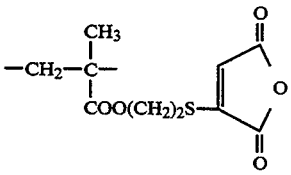 | 94/6 |

TABLE 2-continued

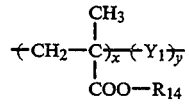

| Synthesis Example of Resin (A) | Resin (A) | $R_{14}$ | $Y_1$ | x/y (weight ratio) |
|---|---|---|---|---|
| 24 | A-24 | 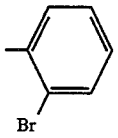 | 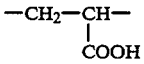 | 95/5 |
| 25 | A-25 | 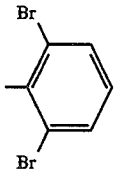 | 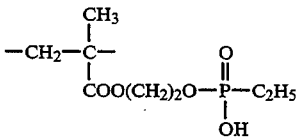 | 92/8 |
| 26 | A-26 | $-C_2H_5$ | 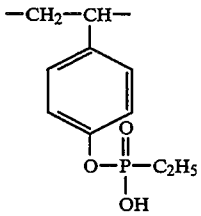 | 97/3 |
| 27 | A-27 | 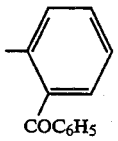 | 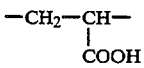 | 95/5 |
| 28 | A-28 | 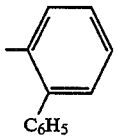 | 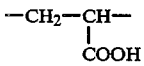 | 95/5 |

SYNTHESIS EXAMPLE 29 OF RESIN (A): Resin (A-29)

A mixed solution of 95 g of 2,6-dichlorophenyl methacrylate, 5 g of acrylic acid, 2 g of n-dodecylmercaptan, and 200 g of toluene was heated to a temperature of 80° C. under nitrogen gas stream, and 2 g of AIBN was added thereto to effect reaction for 4 hours. Then, 0.5 g of AIBN was added thereto, followed by reacting for 2 hours, and thereafter 0.5 g of AIBN was added thereto, followed by reacting for 3 hours. After cooling, the reaction mixture was poured into 2 liters of a solvent mixture of methanol and water (9:1) to reprecipitate, and the precipitate was collected by decantation and dried under reduced pressure to obtain 78 g of the copolymer in the wax form having a weight average molecular weight of $6.3\times10^3$.

SYNTHESIS EXAMPLES 30 TO 33 OF RESIN (A): Resins (A-30) to (A-33)

Copolymers shown in Table 3 below were synthesized in the same manner as described in Synthesis Example 29 of Resin (A), respectively. A weight average molecular weight of each of the polymers was in a range of from $6\times10^3$ to $8\times10^3$.

TABLE 3

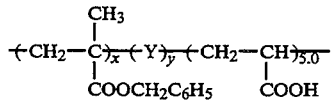

| Synthesis Example of Resin (A) | Resin (A) | —Y— | x/y (weight ratio) |
|---|---|---|---|
| 30 | A-30 | 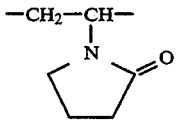 | 90/5 |
| 31 | A-31 | 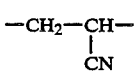 | 92/3 |
| 32 | A-32 | 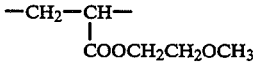 | 88/7 |

TABLE 3-continued

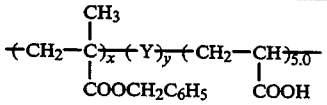

| Synthesis Example of Resin (A) | Resin (A) | —Y— | x/y (weight ratio) |
|---|---|---|---|
| 33 | A-33 | —CH₂—CH(CONHCH₃)— | 90/5 |

SYNTHESIS EXAMPLE 101 OF RESIN (A): RESIN (A-101)

A mixed solution of 96 g of benzyl methacrylate, 4 g of thiosalicylic acid, and 200 g of toluene was heated to a temperature 75° C. under nitrogen gas stream, and 1.0 g of 2,2'-azobisisobutyronitrile (hereinafter simply referred to as AIBN) was added thereto to effect reaction for 4 hours. To the reaction mixture was further added 0.4 g of AIBN, followed by reacting for 2 hours, and thereafter 0.2 g of AIBN was added thereto, followed by reacting for 3 hours with stirring. The resulting resin (A-101) had the following structure and a weight average molecular weight of $6.8\times10^3$.

Resin (A-101)

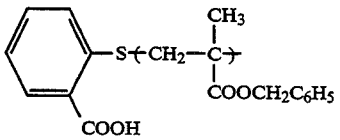

SYNTHESIS EXAMPLES 102 TO 113 OF RESIN (A): Resins (A-102) to (A-113)

Resins (A-102) to (A-113) were synthesized in the same manner as described in Synthesis Example 101 of Resin (A), except for using the monomers described in Table 4 below in place of 96 g of benzyl methacrylate, respectively. A weight average molecular weight of each of these resins was in a range of from $6.0\times10^3$ to $8\times10^3$.

TABLE 4

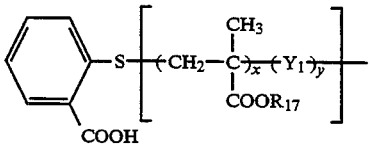

x and y represent a weight composition ratio

| Synthesis Example of Resin (A) | Resin (A) | $R_{17}$ | $-Y_1-$ | x/y (weight ratio) |
|---|---|---|---|---|
| 102 | A-102 | —C₂H₅ | —CH₂—CH(COO(CH₂)₂COOH)— | 94/2 |
| 103 | A-103 | —C₆H₅ | —CH₂—C(CH₃)(COOH)— | 94/2 |
| 104 | A-104 | 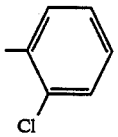 | — | 96/0 |
| 105 | A-105 | 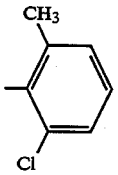 | — | 96/0 |
| 106 | A-106 | —CH₂C₆H₅ | —CH₂—CH(COOH)— | 93.5/2.5 |
| 107 | A-107 | —C₂H₅ | 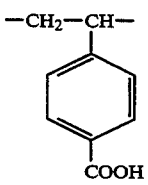 | 93/3 |

TABLE 4-continued

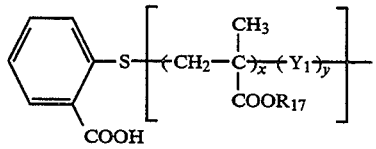

x and y represent a weight composition ratio

| Synthesis Example of Resin (A) | Resin (A) | $R_{17}$ | $-Y_1-$ | x/y (weight ratio) |
|---|---|---|---|---|
| 108 | A-108 | 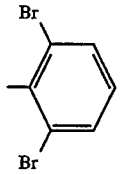 | 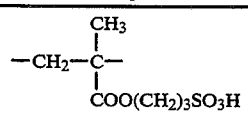 | 85/11 |
| 109 | A-109 | 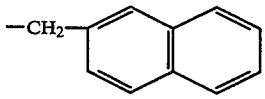 | — | 96/0 |
| 110 | A-110 | 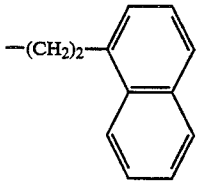 | 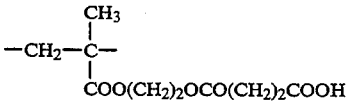 | 92/4 |
| 111 | A-111 | 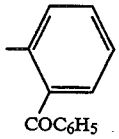 | 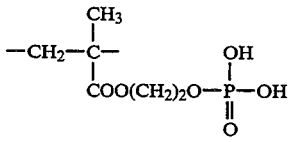 | 94.5/1.5 |
| 112 | A-112 | 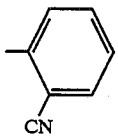 | 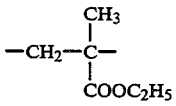 | 76/20 |
| 113 | A-113 | $-(CH_2)_2-OC_6H_5$ | — | 96/0 |

SYNTHESIS EXAMPLES 114 TO 124 OF RESIN (A): Resins (A-114) to (A-124)

Resins (A-114) to (A-124) were synthesized under the same reaction conditions as described in Synthesis Example 101 of Resin (A), except for using the methacrylates and mercapto compounds described in Table 5 below in place of 96 g of benzyl methacrylate and 4 g of thiosalicylic acid and replacing 200 g of toluene with 150 g of toluene and 50 g of isopropanol, respectively.

TABLE 5

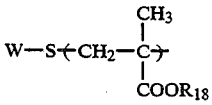

| Synthesis Example of Resin (A) | Resin (A) | W— | Amount | $-R_{18}$ | Amount | Weight Average Molecular Weight |
|---|---|---|---|---|---|---|
| 114 | A-114 | $HOOCCH_2CH_2CH_2-$ | 4 g | $-C_2H_5$ | 96 g | $7.3 \times 10^3$ |
| 115 | A-115 | $HOOCCH_2-$ | 5 g | $-C_3H_7$ | 95 g | $5.8 \times 10^3$ |
| 116 | A-116 | HOOC—CH—<br>\|<br>HOOC—$CH_2$ | 5 g | $-CH_2C_6H_5$ | 95 g | $7.5 \times 10^3$ |
| 117 | A-117 | $HOOCCH_2CH_2-$ | 5.5 g | $-C_6H_5$ | 94.5 g | $6.5 \times 10^3$ |

TABLE 5-continued

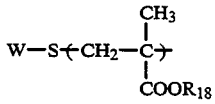

| Synthesis Example of Resin (A) | Resin (A) | W— | Amount | —$R_{18}$ | Amount | Weight Average Molecular Weight |
|---|---|---|---|---|---|---|
| 118 | A-118 | $HOOCCH_2$— | 4 g | 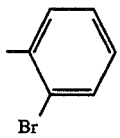 | 96 g | $5.3 \times 10^3$ |
| 119 | A-119 | 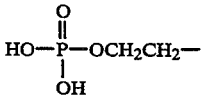 | 3 g | 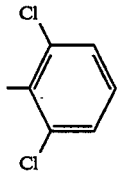 | 97 g | $6.6 \times 10^3$ |
| 120 | A-120 | $HO_3SCH_2CH_2$— | 3 g | 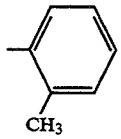 | 97 g | $8.8 \times 10^3$ |
| 121 | A-121 | 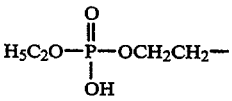 | 4 g | 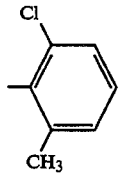 | 96 g | $7.5 \times 10^3$ |
| 122 | A-122 | 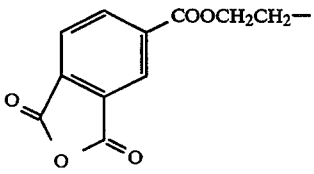 | 7 g | 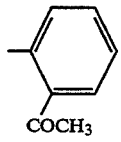 | 93 g | $5.5 \times 10^3$ |
| 123 | A-123 | 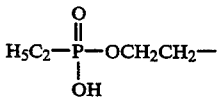 | 6 g | 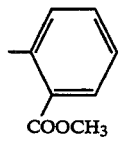 | 94 g | $4.5 \times 10^3$ |
| 124 | A-124 | 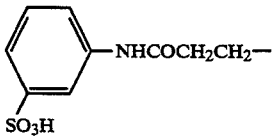 | 4 g | 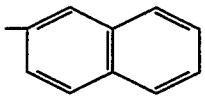 | 96 g | $5.6 \times 10^3$ |

SYNTHESIS EXAMPLE 125 OF RESIN (A): Resin (A-125)

A mixed solution of 100 g of 1-naphthyl methacrylate, 150 g of toluene and 50 g of isopropanol was heated to a temperature of 80° C. under nitrogen gas stream, and 5.0 g of 4,4'-azobis(4-cyanovaleric acid) (abbreviated as ACV) was added thereto, followed by reacting with stirring for 5 hours. Then, 1 g of ACV was added thereto, followed by reacting with stirring for 2 hours, and thereafter 1 g of ACV was added thereto, followed by reacting with stirring for 3 hours. The resulting polymer had a weight average molecular weight of $7.5 \times 10^3$.

Resin (A-125)

-continued

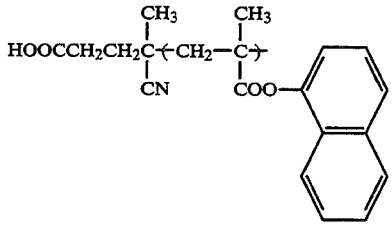

SYNTHESIS EXAMPLE 126 OF RESIN (A): Resin (A-126)

A mixed solution of 50 g of methyl methacrylate and 150 g of methylene chloride was cooled to −20° C. under nitrogen gas stream, and 1.0 g of a 10% hexane solution of 1,1-diphenylhexyl lithium prepared just before was added thereto, followed by stirring for 5 hours. Carbon dioxide was passed through the mixture at a flow rate of 10 ml/cc for 10 minutes with stirring, the cooling was discontinued, and the reaction mixture was allowed to stand to room temperature with stirring. Then, the reaction mixture was added to a solution of 50 ml of 1N hydrochloric acid in 1 liter of methanol to precipitate, and the white powder was collected by filtration. The powder was washed with water until the washings became neutral, and dried under reduced pressure to obtain 18 g of the polymer having a weight average molecular weight of $6.5\times10^3$.

Resin (A-126)

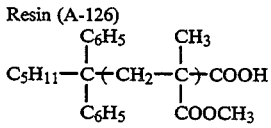

SYNTHESIS EXAMPLE A-127 OF RESIN (A): Resin (A-127)

A mixed solution of 95 g of benzyl methacrylate, 4 g of thioglycolic acid, and 200 g of toluene was heated to a temperature of 75° C. under nitrogen gas stream, and 1.0 g of ACV was added thereto to effect reaction for 6 hours. Then, 0.4 g of ACV was added thereto, followed by reacting for 3 hours. The resulting polymer had a weight average molecular weight of $7.8\times10^3$.

Resin (A-127)

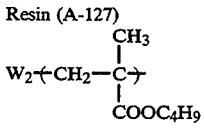

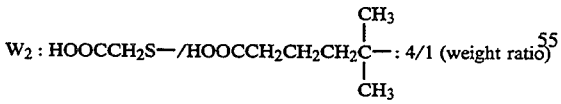

Preparation examples of the dispersion stabilizing resin are specifically illustrated below.

PREPARATION EXAMPLE 1 OF DISPERSION STABILIZING RESIN: Dispersion Stabilizing Resin (P-1)

A mixed solution of 97 g of dodecyl methacrylate, 3 g of glycidyl methacrylate and 200 g of toluene was heated to a temperature of 75° C. under nitrogen gas stream while stirring. 1.0 g of 2,2'-azobisisobutyronitrile (abbreviated as AIBN) was added thereto, followed by stirring for 4 hours, and 0.5 g of AIBN was further added thereto, followed by stirring for 4 hours. To the reaction mixture were added 5 g of methacrylic acid, 1.0 g of N,N-dimethyldodecylamine and 0.5 g of t-butylhydroquinone and stirred at a temperature of 110° C. for 8 hours. After cooling, the reaction mixture was subjected to reprecipitation in 2 liters of methanol, and the resulting brownish oily product was collected and dried. A yield thereof was 73 g and a weight average molecular weight was $3.6\times10^4$.

Dispersion Stabilizing Resin (P-1)

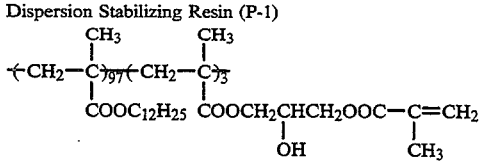

PREPARATION EXAMPLE 2 OF DISPERSION STABILIZING RESIN: Dispersion Stabilizing Resin (P-2)

A mixed solution of 100 g of 2-ethylhexyl methacrylate, 150 g of toluene and 50 g of isopropanol was heated to a temperature of 75° C. under nitrogen gas stream while stirring. 2 g of 4,4'-azobis(4-cyanovaleric acid) (abbreviated as ACV) was added thereto, followed by reacting for 4 hours, and 0.8 g of ACV was further added thereto, followed by reacting for 4 hours. After cooling, the reaction mixture was subjected to reprecipitation in 2 liters of methanol and the resulting oily product was collected and dried.

A mixture of 50 g of the oily product thus obtained, 6 g of 2-hydroxyethyl methacrylate and 150 g of tetrahydrofuran was dissolved, to which a mixed solution of 8 g of dicyclohexylcarbodiimide (DCC), 0.2 g of 4-(N,N-dimethylamino)pyridine and 20 g of methylene chloride was dropwise added at a temperature of 25° to 30° C., followed by further stirring for 4 hours. 5 g of formic acid was then added to the reaction mixture, followed by stirring for 1 hour. The deposited insoluble material was separated by filtration, and the filtrate was reprecipitated in one liter of methanol to collect the resulting oily product. Then, the oily product was dissolved in 200 g of tetrahydrofuran. After removing the insoluble material by filtration, the filtrate was reprecipitated in one liter of methanol and the resulting oily produce was-collected and dried. A yield thereof was 32 g and a weight average molecular weight was $4.2\times10^4$.

Dispersion Stabilizing Resin (P-2)

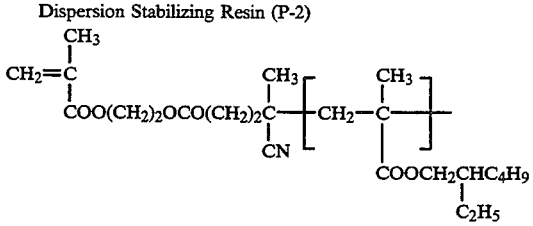

PREPARATION EXAMPLE 3 OF DISPERSION STABILIZING RESIN: Dispersion Stabilizing Resin (P-3)

A mixed solution of 96 g of butyl methacrylate, 4 g of thioglycolic acid and 200 g of toluene was heated to a temperature of 70° C. under nitrogen gas stream while stirring. 1.0 g of AIBN was added thereto, followed by reacting for 8 hours. To the reaction solution were then added 8 g of glycidyl methacrylate, 1.0 g of N,N-dimethyldodecylamine and 0.5 g of t-butylhydroquinone, and the mixture was stirred at a temperature of 100° C. for 12 hours. After cooling, the reaction solution was subjected to reprecipitation in 2 liters of methanol and 82 g of the resulting oily product was obtained. A weight average molecular weight thereof was $8\times10^3$.

Dispersion Stabilizing Resin (P-3)

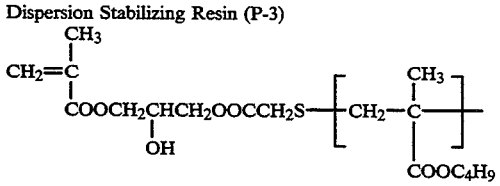

PREPARATION EXAMPLE 4 OF DISPERSION STABILIZING RESIN: Dispersion Stabilizing Resin (P-4)

A mixed solution of 100 g of n-butyl methacrylate, 4 g of β-mercaptopropionic acid and 200 g of toluene was heated to a temperature of 70° C. under nitrogen gas stream while stirring. One g of AIBN was added thereto, followed by reacting for 6 hours. The reaction mixture was cooled to a temperature of 25° C., and a mixed solution of 10 g of 2-hydroxyethyl methacrylate, 8 g of dicyclohexylcarbodiimide (DCC), 0.2 g of 4-(N,N-dimethylamino)pyridine and 20 g of methylene chloride was dropwise added thereto at a temperature of 25° to 30° C., followed by further stirring for 4 hours. 5 g of formic acid was then added to the reaction mixture and stirred for 1 hour. The deposited insoluble material was separated by filtration, and the filtrate was reprecipitated in one liter of methanol to collect the resulting oily product. Then, the oily product was dissolved in 200 g of tetrahydrofuran, and the insoluble material was removed by filtration. The filtrate was again reprecipitated in 2 liters of methanol and the oily product was collected and dried. A yield thereof was 68 g and a weight average molecular weight was $6.6\times10^3$.

Dispersion Stabilizing Resin (P-4)

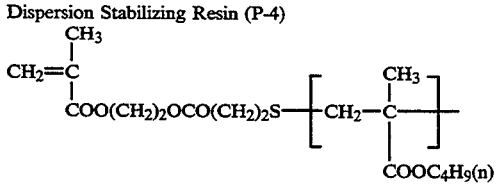

PREPARATION EXAMPLES 5 TO 12 OF DISPERSION STABILIZING RESIN: Dispersion Stabilizing Resins (P-5) to (P-12)

In the same manner as described in Preparation Example 4 except for using the corresponding monomers shown in Table 6 below in place of 100 g of n-butyl methacrylate, each of the dispersion stabilizing resins was prepared. A weight average molecular weight of each resin was in a range of from $5.5\times10^3$ to $7\times10^3$.

TABLE 6

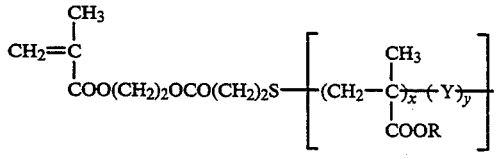

| Preparation Example of Dispersion Stabilizing Resin | Dispersion Stabilizing Resin (P) | R | —Y— | x/y (weight ratio) |
|---|---|---|---|---|
| 5 | P-5 | $-CH_3$ | $-CH_2-CH(COOCH_3)-$ | 50/50 |
| 6 | P-6 | $-C_2H_5$ | — | 100/0 |
| 7 | P-7 | $-C_3H_7$ | — | 100/0 |
| 8 | P-8 | $-C_5H_{11}$ | — | 100/0 |
| 9 | P-9 | $-C_2H_5$ | $-CH_2-CH(COOC_2H_5)-$ | 60/40 |
| 10 | P-10 | — | $-CH_2-CH(COOC_2H_5)-$ | 0/100 |
| 11 | P-11 | $-C_{12}H_{25}$ | — | 100/0 |
| 12 | P-12 | $-C_4H_9$ | $-CH_2-CH(CONH_2)-$ | 95/5 |

PREPARATION EXAMPLES 13 TO 16 OF DISPERSION STABILIZING RESIN: Dispersion Stabilizing Resins (P-13) to (P-16)

In the same manner as described in Preparation Example 4 except for using the corresponding compound shown in Table 7 below in place of 2-hydroxyethyl methacrylate, each of the dispersion stabilizing resins was prepared. A weight average molecular weight of each resin was in a range of from $6\times10^3$ to $7\times10^3$.

TABLE 7

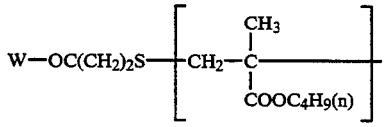

| Preparation Example of Dispersion Stabilizing Resin | Dispersion Stabilizing Resin (P) | W— |
|---|---|---|
| 13 | P-13 | $CH_2=CH(COO(CH_2)_2O-)$ |
| 14 | P-14 | $CH_2=CH(CH_2O-)$ |
| 15 | P-15 | $CH_2=CH(CH_2NH-)$ |

TABLE 7-continued

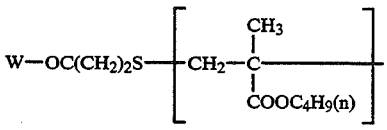

| Preparation Example of Dispersion Stabilizing Resin | Dispersion Stabilizing Resin (P) | W— |
|---|---|---|
| 16 | P-16 | $CH_2=C(CH_3)-COO(CH_2)_2O-$ |

PREPARATION EXAMPLE 17 OF DISPERSION STABILIZING RESIN: Dispersion Stabilizing Resin (P-17)

A mixed solution of 80 g of hexyl methacrylate, 20 g of glycidyl methacrylate, 2 g of 2-mercaptoethanol and 300 g of tetrahydrofuran was heated to a temperature of 60° C. under nitrogen gas stream while stirring, to which 0.8 g of 2,2'-azobis(isovaleronitrile) (abbreviated as AIVN) was added, followed by reacting for 4 hours. Further, 0.4 g of AIVN was added thereto and reacted for 4 hours. After cooling the reaction mixture to a temperature of 25° C., 4 g of methacrylic acid was added, and then a mixed solution of 6 g of DCC, 0.1 g of 4-(N,N-dimethylamino)pyridine and 15 g of methylene chloride was dropwise added thereto with stirring for 1 hour, followed by further stirring for 3 hours. Then, 10 g of water was added thereto, and the mixture was stirred for 1 hour. The deposited insoluble material was filtered off, the filtrate was reprecipitated in one liter of methanol, and the resulting oily product was collected. Then, the oily product was dissolved in 150 g of benzene, the insoluble material was filtered off, the filtrate was again reprecipitated in one liter of methanol, and resulting the oily product was collected and dried. A yield thereof was 56 g, and a weight average molecular weight was $8\times10^3$.

Dispersion Stabilizing Resin (P-17)

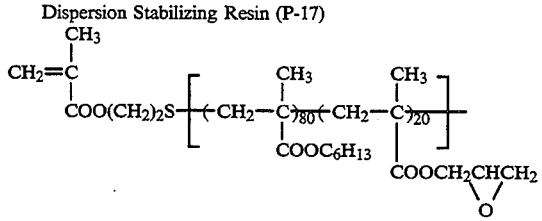

PREPARATION EXAMPLES 18 TO 22 OF DISPERSION STABILIZING RESIN: Dispersion Stabilizing Resins (P-18) to (P-22)

According to a procedure similar to that described in Preparation Example 17 of Dispersion Stabilizing Resin, each of the dispersion stabilizing resins shown in Table 8 below was prepared. A weight average molecular weight of each resin was in a range of from $6\times10^3$ to $9\times10^3$.

TABLE 8

| Preparation Example of Stabilizing Resin | Dispersion Stabilizing Resin | Chemical Structure of Dispersion Stabilizing Resin |
|---|---|---|
| 18 | P-18 | 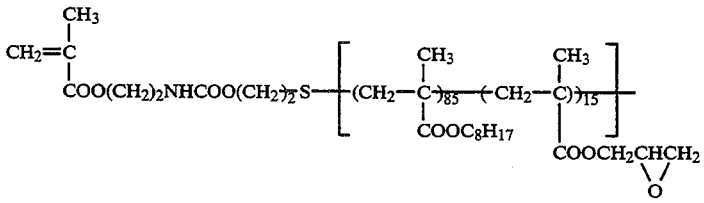 |
| 19 | P-19 | 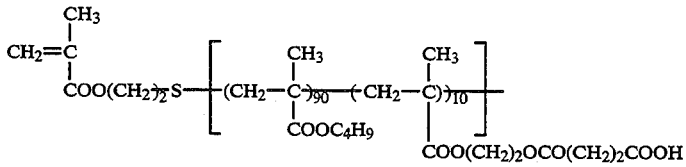 |
| 20 | P-20 | 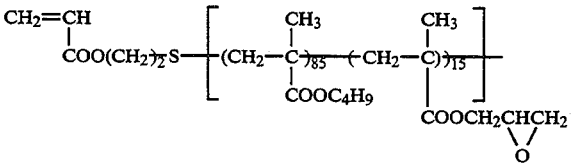 |
| 21 | P-21 | 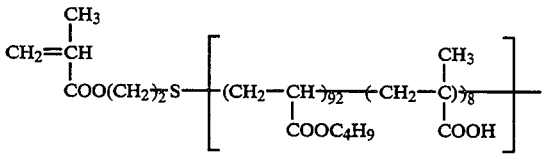 |

TABLE 8-continued

| Preparation Example of Stabilizing Resin | Dispersion Stabilizing Resin | Chemical Structure of Dispersion Stabilizing Resin |
|---|---|---|
| 22 | P-22 | 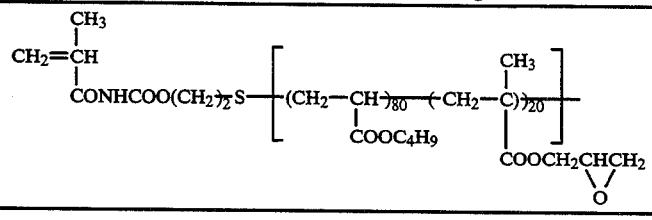 |

PREPARATION EXAMPLE 101 OF DISPERSION STABILIZING RESIN: Dispersion Stabilizing Resin (M-1)

A mixed solution of 95 g of 2,2,2,2',2',2'-hexafluoroisopropyl methacrylate, 5 g of thioglycolic acid, and 200 g of toluene was heated to a temperature of 70° C. with stirring under nitrogen gas stream. To the mixture was added 1.0 g of azobisisobutyronitrile (abbreviated as AIBN) to conduct a reaction for 8 hours. To the reaction mixture were then added 8 g of glycidyl methacrylate, 1.0 g of N,N-dimethyldodecylamine, and 0.5 g of tert-butylhydroquinone, followed by stirring at a temperature of 100° C. for 12 hours. After cooling, the reaction solution was reprecipitated in 2 liters of methanol to obtain 82 g of a white powder. The weight average molecular weight of the polymer was 4,000.

Dispersion Stabilizing Resin (M-1)

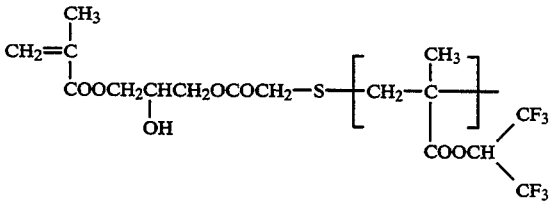

PREPARATION EXAMPLE 102 OF DISPERSION STABILIZING RESIN: Dispersion Stabilizing Resin (M-2)

A mixed solution of 96 g of Monomer (MA-1) having the following structure, 4 g of β-mercaptopropionic acid, and 200 g of toluene was heated to a temperature of 70° C. with stirring under nitrogen gas stream. 1.0 g of AIBN was added thereto, followed by reacting for 8 hours. After cooling the reaction solution to a temperature of 25° C. in a water bath, 10 g of 2-hydroxyethyl methacrylate was added thereto. Then, a mixed solution of 15 g of dicyclohexylcarbodiimide (abbreviated as DCC), 0.2 g of 4-(N,N-dimethylamino)pyridine and 50 g of methylene chloride was added dropwise thereto with stirring over a period of 30 minutes, followed by stirring for 4 hours. To the reaction mixture was then added 5 g of formic acid, the mixture was stirred for one hour, and the insoluble substance was removed by filtration. The filtrate obtained was reprecipitated in one liter of n-hexane, and the viscous substance thus-deposited was collected by decantation and dissolved in 100 ml of tetrahydrofuran. After removing the insoluble substance by filtration, the filtrate was again reprecipitated in one liter of n-hexane, and the viscous substance thus-deposited was collected and dried to obtain 60 g of the polymer having a weight average molecular weight of $5.2\times10^3$.

(MA-1)

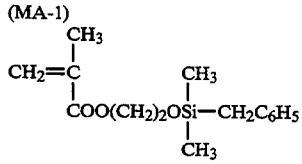

Dispersion Stabilizing Resin (M-2)

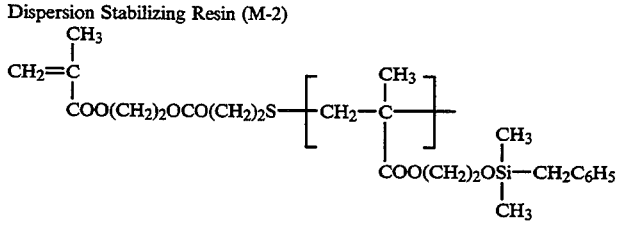

PREPARATION EXAMPLE 103 OF DISPERSION STABILIZING RESIN: Dispersion Stabilizing Resin (M-3)

A mixed solution of 95 g of Monomer (MA-2) having the following structure, 150 g of benzotrifluoride and 50 g of ethanol was heated to a temperature of 75° C. with stirring under nitrogen gas stream. 2 g of 4,4'-azobis(4-cyanovaleric acid) (abbreviated as ACV) was added thereto, followed by reacting for 8 hours. After cooling, the reaction mixture was reprecipitated in one liter of methanol, and the polymer thus-obtained was dried. Then, 50 g of the resulting polymer and 11 g of 2-hydroxyethyl methacrylate were dissolved in 150 g of benzotrifluoride, and the temperature was kept at 25° C. To the mixture was added dropwise with stirring a mixed solution of 15 g of DCC, 0.1 g of 4-(N,N-dimethylamino)pyridine and 30 g of methylene chloride over a period of 30 minutes, followed by stirring for 4 hours. To the reaction mixture was added 3 g of formic acid, the mixture was stirred for one hour, and the insoluble substance deposited was removed by filtration. The filtrate was reprecipitated in 800 ml of methanol, and the precipitates were collected, dissolved in 150 g of benzotrifluoride and subjected to reprecipitation to obtain 30 g of a viscous substance. A weight average molecular weight of polymer (M-3) was $3.3\times10^4$.

(MA-2)

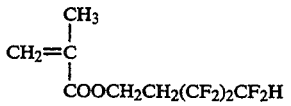

Dispersion Stabilizing Resin (M-3)

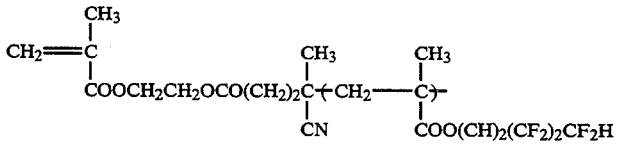

PREPARATION EXAMPLES 104 TO 122 OF DISPERSION STABILIZING RESIN: Dispersion Stabilizing Resins (M-4) to (M-22)

Each of the dispersion Stabilizing resins was prepared in the same manner as described in Preparation Example 102, except for replacing Monomer (MA-1) with each of the monomers corresponding to the polymer components shown in Table 9 below. A weight average molecular weight of each resin was in a range of from $4\times10^3$ to $6\times10^8$.

TABLE 9

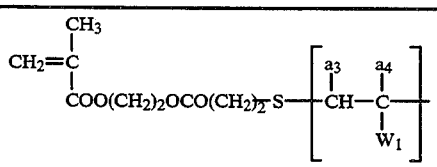

| Preparation Example of Dispersion Stabilizing Resin | Dispersion Stabilizing Resin | $a_3$ | $a_4$ | $-W_1$ |
|---|---|---|---|---|
| 104 | M-4 | H | $CH_3$ | $-COOCH_2CF_3$ |
| 105 | M-5 | H | $CH_3$ | $-COO(CH_2)_2(CF_2)_4CF_2H$ |
| 106 | M-6 | H | $CH_3$ | $-COO(CH_2)_2OCOC_3F_7$ |
| 107 | M-7 | $CH_3$ | H | $-COO(CH_2)_2(CF_2)_6CF_2H$ |
| 108 | M-8 | H | H | $-COO(CH_2)_2C_4F_9$ |
| 109 | M-9 | H | $CH_3$ | $-COO(CH_2)_2Si(OCH_3)_3$ |
| 110 | M-10 | H | $CH_3$ | $-COOSi(C_4H_9)_2CH_2C_6H_5$ |
| 111 | M-11 | H | H | $-COOCH_2Si(CH_3)_2-O-Si(CH_3)_2-CH_3$ |
| 112 | M-12 | H | H | $-COO(CH_2)_2NHSO_2C_4F_9$ |
| 113 | M-13 | H | $CH_3$ | $-COOCH_2CH_2CF_3$ |

TABLE 9-continued

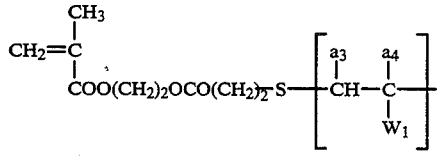

| Preparation Example of | Dispersion | $a_3$ | $a_4$ | $-W_1$ |
|---|---|---|---|---|
| 114 | M-14 | H | $CH_3$ | $-COOCH(COOCH_2CF_3)_2$ |
| 115 | M-15 | H | $CH_3$ | $-COO-C_6H_3(CF_3)_2$ |
| 116 | M-16 | H | H | $-COO-C_6H_2F_4-F$ |
| 117 | M-17 | H | H | $-CH_2OCOC_3F_7$ |
| 118 | M-18 | H | H | $-C_6H_4-CF_3$ |
| 119 | M-19 | H | H | $-C_6H_4-O-Si(CH_3)_2-C_6H_5$ |
| 120 | M-20 | H | H | $-COOCH_2CH(OCOC_2F_5)CH_2OCOC_2F_5$ |
| 121 | M-21 | H | $CH_3$ | $-COO(CH_2)_3OSi(C_2H_5)_2CH_2CH_2CF_3$ |
| 122 | M-22 | $CH_3$ | H | $-COOCH(CF_3)_2$, $COO(CH_2)_2C(CF_3)_2$ |

PREPARATION EXAMPLES 123 TO 130 OF DISPERSION STABILIZING RESIN: Dispersion Stabilizing Resins (M-23) to (M-30)

Each of the dispersion stabilizing resins was prepared in the same manner as described in Preparation Example 102, except for replacing Monomer (MA-1) and 2-hydroxyethyl methacrylate with each of the compounds corresponding to the polymer components shown in Table 10 below. A weight average molecular weight of each resin was in a range of from $5\times10^3$ to $6\times10^3$.

TABLE 10

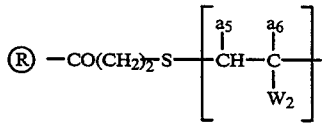

| Preparation Example of Dispersion Stabilizing Resin | Dispersion Stabilizing Resin | Ⓡ— | $a_5$ | $a_6$ | —$W_2$ |
|---|---|---|---|---|---|
| 123 | M-23 | $CH_2{=}CH$<br>\|<br>$COO(CH_2)_2O$— | H | $CH_3$ | —$COOCH_2CH(CF_3)_2$ |
| 124 | M-24 | $CH_2{=}CH$<br>\|<br>$COO(CH_2)_2O$— | H | $CH_3$ | —$COO(CH_2)_2OSi(C_2H_5)_2CH_2C_6H_5$ |
| 125 | M-25 | $CH_2{=}CH$<br>\|<br>$COO(CH_2)_2O$— | $CH_3$ | H | —$CH_2COO(CH_2)_2(CF_2)_2CF_2H$ |
| 126 | M-26 | $CH_2{=}CH$<br>\|<br>$CH_2O$— | H | $CH_3$ | —$COO(CH_2)_3OSi(CH_3)_2OSi(CH_3)_2CH_3$ |
| 127 | M-27 | —$CH_2{=}CH$<br>\|<br>$COO(CH_2)_2COO(CH_2)_2O$— | H | $CH_3$ | —$COO(CH_2)_3OSi(CH_3)_2OSi(CH_3)_2CH_3$ |
| 128 | M-28 | $CH_3$<br>\|<br>$CH{=}CH_2$<br>\|<br>$COO(CH_2)_2O$— | H | H | —$COO(CH_2)_2OCOC_4F_9$ |
| 129 | M-29 | $CH_2{=}CH$— 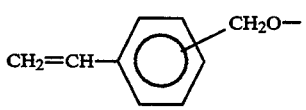 —$CH_2O$— | H | $CH_3$ | —$COO(CH_2)_2OCOC_4F_9$ |
| 130 | M-30 | $CH_2{=}CH$<br>\|<br>$CONH(CH_2)_2O$— | H | H | —$COOCH_2CH(OSi(C_2H_5)_3)CH_2OSi(C_2H_5)_3$ |

PREPARATION EXAMPLE 131 OF DISPERSION STABILIZING RESIN: Dispersion Stabilizing Resin (M-31)

A mixed solution of 27 g of octyl methacrylate, 60 g of Monomer (MA-3) having the following structure, 3 g of glycidyl methacrylate and 200 g of benzotrifluoride was heated to a temperature of 75° C. with stirring under nitrogen gas stream, to which 1.0 g of 2,2'-azobisisobutyronitrile (AIBN) was added, followed by reacting for 4 hours, and then was further added 0.5 g of AIBN, followed by reacting for 4 hours. Then, 5 g of methacrylic acid, 1.0 g of N,N-dimethyldodecylamine and 0.5 g of tert-butylhydroquinone were added to the reaction mixture and stirred at a temperature of 110° C. for 8 hours. After cooling, the reaction mixture was subjected to reprecipitation in 2 liters of methanol, and the resulting slightly brown colored oily product was collected and dried. A yield thereof was 73 g and a weight average molecular weight was $3.6\times10^4$.

Monomer (MA-3)

-continued

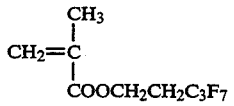

Dispersion Stabilizing Resin (M-31)

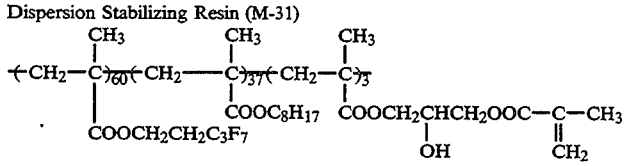

PREPARATION EXAMPLE 132 OF DISPERSION STABILIZING RESIN: Dispersion Stabilizing Resin (M-32)

A mixed solution of 80 g of Monomer (MA-4) shown below, 20 g of glycidyl methacrylate, 2 g of 2-mercaptoethanol and 300 g of tetrahydrofuran was heated to a temperature of 60° C. with stirring under nitrogen gas stream, to which 0.8 g of 2,2'-azobis(isovaleronitrile) (abbreviated as AIVN) was added, followed by reacting for 4 hours. Further, 0.4 g of AIVN was added thereto, followed by reacting for 4 hours. After cooling the reaction mixture to a temperature of 25° C., 4 g of methacrylic acid was added, and a mixed solution of 6 g of DCC, 0.1 g of 4-(N,N-dimethylamino)pyridine and 15 g of methylene chloride was dropwise added thereto with stirring over a period of one hour, and further stirred for 3 hours. Then, 10 g of water was added thereto, and the mixture was stirred for one hour. The insoluble substance deposited was filtered off, the filtrate was subjected to reprecipitation in one liter of methanol, and the resulting oily product was collected. The oily product was then dissolved in 150 g of benzene, and the insoluble substance was filtered off. The filtrate was again subjected to reprecipitation in one liter of methanol, and the resulting oily product was collected and dried. A yield thereof was 56 g, and a weight average molecular weight was $8\times10^3$.

Monomer (MA-4)

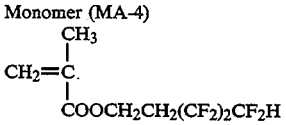

Dispersion Stabilizing Resin (M-32)

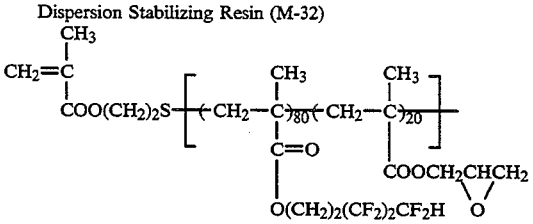

PREPARATION EXAMPLES 133 TO 139 OF DISPERSION STABILIZING RESIN: Dispersion Stabilizing Resins (M-33) to (M-39)

According to a procedure similar to that described in Preparation Example 132, each of the dispersion stabilizing resins shown in Table 11 below was prepared. A weight average molecular weight of each resin was in a range of from $6\times10^3$ to $9\times10^3$.

TABLE 11

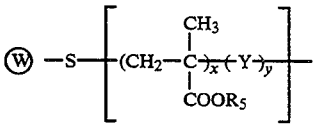

| Preparation Example of Dispersion Stabilizing Resin | Dispersion Stabilizing Resin | Ⓦ— | —$R_5$ | —Y— | x/y |
|---|---|---|---|---|---|
| 133 | M-33 | 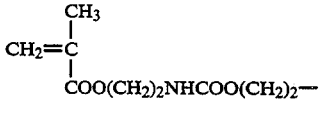 | —$CH_2CH_2(CF_2)_3CF_3$ | 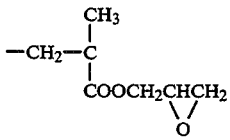 | 85/15 |
| 134 | M-34 | 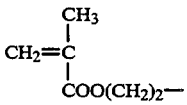 | —$CH_2CH_2(CF_2)_3CF_3$ | 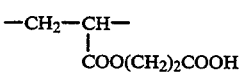 | 90/10 |
| 135 | M-35 | 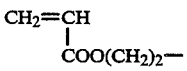 | —$(CH_2)_2CF_2CFH$—$CF_3$ | 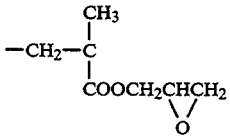 | 85/15 |

TABLE 11-continued

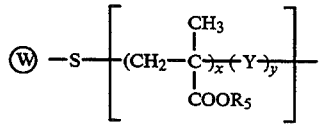

| Preparation Example of Dispersion Stabilizing Resin | Dispersion Stabilizing Resin | Ⓦ— | —$R_5$ | —Y— | x/y |
|---|---|---|---|---|---|
| 136 | M-36 | 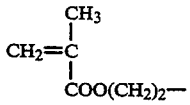 | —$(CH_2)_2CF_2CFH—CF_3$ | 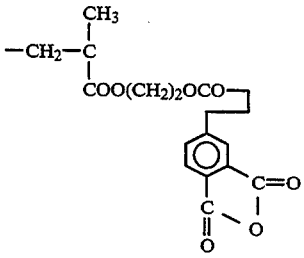 | 90/10 |
| 137 | M-37 | 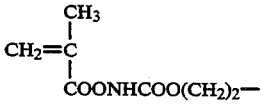 | —$(CH_2)_2(CF_2)CF_2H$ | 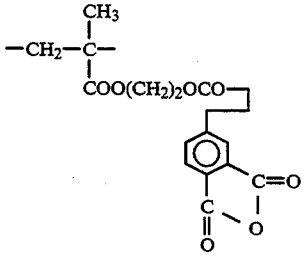 | 85/15 |
| 138 | M-38 | 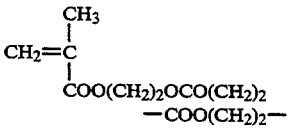 | —$(CH_2)_2(CF_2)CF_2H$ | 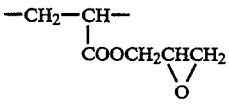 | 80/20 |
| 139 | M-39 | 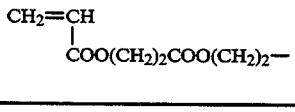 | 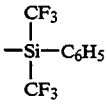 | 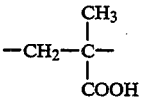 | 90/10 |

Preparation Examples of the resin grain are specifically illustrated below.

PREPARATION EXAMPLE 1 OF RESIN GRAIN: Resin Grain (L-1)

A mixed solution of 10 g of Dispersion Stabilizing Resin (M-32) and 200 g of n-octane was heated to a temperature of 60° C. with stirring under nitrogen gas stream, to which a mixed solution of 40 g of Monomer (A-1) shown below, 10 g of ethylene glycol dimethacrylate, 0.5 g of AIVN and 240 g of n-octane was dropwise added over a period of 2 hours, followed by subjecting the mixture to reaction for 2 hours. Further, 0.5 g of AIVN was added thereto, followed by reacting for 2 hours. After cooling, the reaction mixture was passed through a nylon cloth of 200 mesh to obtain a white dispersion, which was a latex with an average grain diameter of 0.18 μm (grain diameter being measured by CAPA-500 manufactured by Horiba Seisakujo KK).

Monomer (A-1)

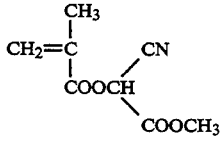

PREPARATION EXAMPLES 2 TO 12 OF RESIN GRAIN: Resin Grains (L-1) to (L-12)

The resin grains were prepared in the same manner as described in Preparation Example 1 of Resin Grain except for using the dispersion stabilizing resins and monomers shown in Table 12 below in place of Dispersion Stabilizing Resin (M-32) and Monomer (A-1), respectively. An average grain diameter of each grain was in a range of from 0.15 to 0.30.

TABLE 12
| Preparation Example of Resin Grain | Resin Grain | Dispersion Stabilizing Resin (M) | Monomer (A) | |
|---|---|---|---|---|
| 2 | L-2 | M-33 | 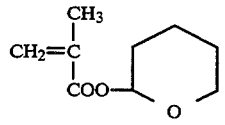 | (A-2) |
| 3 | L-3 | M-35 | 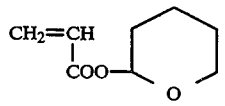 | (A-3) |
| 4 | L-4 | M-36 | 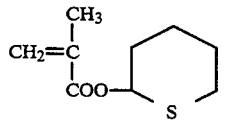 | (A-4) |
| 5 | L-5 | M-37 | 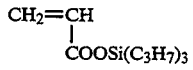 | (A-5) |
| 6 | L-6 | M-38 | 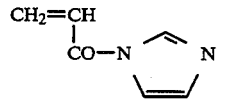 | (A-6) |
| 7 | L-7 | M-2 | 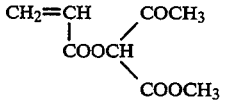 | (A-7) |
| 8 | L-8 | M-3 | 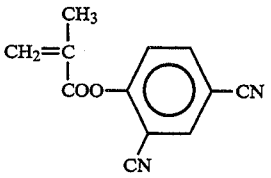 | (A-8) |
| 9 | L-9 | M-6 | 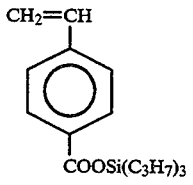 | (A-9) |
| 10 | L-10 | M-9 | 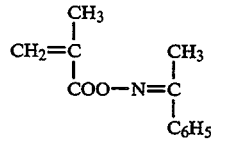 | (A-10) |
| 11 | L-11 | M-11 | 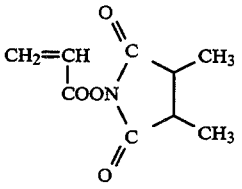 | (A-11) |

TABLE 12-continued

| Preparation Example of Resin Grain | Resin Grain | Dispersion Stabilizing Resin (M) | Monomer (A) | |
|---|---|---|---|---|
| 12 | L-12 | M-25 | 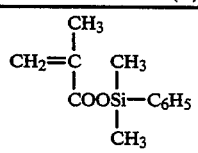 | (A-12) |

PREPARATION EXAMPLES 13 TO 23 OF RESIN GRAIN: Resin Grains (L-13) to (L-23)

Resin Grains (L-13) to (L-23) were prepared in the same manner as described in Preparation Example 1 of Resin Grain except for using the polyfunctional compounds shown in Table 13 below in place of 10 g of ethylene glycol dimethacrylate, respectively. Each grain had a polymerization ratio of 95 to 98% and an average grain diameter of 0.15 to 0.25 μm.

TABLE 13

| Preparation Example of Resin Grain | Resin Grain (L) | Polyfunctional Compound |
|---|---|---|
| 13 | L-13 | Trimethylolpropane Triacrylate |
| 14 | L-14 | Divinyl Benzene |
| 15 | L-15 | Diethylene Glycol Dimethacrylate |
| 16 | L-16 | Trivinylbenzene |
| 17 | L-17 | Ethylene Glycol Diacrylate |
| 18 | L-18 | Propylene Glycol Dimethacrylate |
| 19 | L-19 | Propylene Glycol Diacrylate |
| 20 | L-20 | Vinyl Methacrylate |
| 21 | L-21 | Allyl Methacrylate |
| 22 | L-22 | Trimethylolpropane Trimethacrylate |
| 23 | L-23 | Isopropenyl Itaconate |

PREPARATION EXAMPLE 24 OF RESIN GRAIN: Resin Grain (L-24)

A mixed solution of 8 g of Dispersion Stabilizing Resin (M-35) and 130 g of methyl ethyl ketone was heated to 60° C. with stirring under nitrogen gas stream, and a mixed solution of 45 g of Monomer (A-13) shown below, 5 g of diethylene glycol dimethacrylate, 0.5 g of AIVN and 150 g of methyl ethyl ketone was dropwise added thereto over a period of one hour. Further, 0.25 g of AIVN was added thereto, followed by reacting for 2 hours. After cooling, the reaction mixture was passed through a nylon cloth of 200 mesh to obtain a dispersion having an average grain diameter of 0.25 μm.

Monomer (A-13)

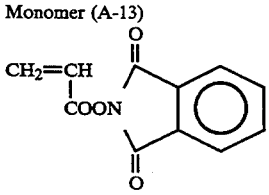

PREPARATION EXAMPLE 25 OF RESIN GRAIN: Resin Grain (L-25)

A mixed solution of 7.5 g of Dispersion Stabilizing Resin (M-26) and 230 g of methyl ethyl ketone was heated to 60° C. with stirring under nitrogen gas stream, and a mixed solution of 22 g of Monomer (A-12), 15 g of acrylamide, 0.5 g of AIVN and 200 g of methyl ethyl ketone was dropwise added over a period of 2 hours, followed by reacting for one hour. Further, 0.25 g of AIVN was added thereto, followed by reacting for 2 hours. After cooling, the reaction mixture was passed through a nylon cloth of 200 mesh to obtain a dispersion having an average grain diameter of 0.25 μm.

PREPARATION EXAMPLE 26 OF RESIN GRAIN: Resin Grain (L-26)

A mixed solution of 42 g of Monomer (A-14) shown below, 8 g of ethylene glycol diacrylate, 8 g of Dispersion Stabilizing Resin (M-27) and 230 g of dipropyl ketone was dropwise added to 200 g of dipropyl ketone solution heated at a temperature of 60° C. under nitrogen gas stream while stirring over a period of 2 hours. After reacting for one hour, further 0.3 g of AIVN was added thereto, followed by reacting for 2 hours. After cooling, the reaction mixture was passed through a nylon cloth of 200 mesh to obtain a dispersion having an average grain diameter of 0.20 μm.

Monomer (A-14)

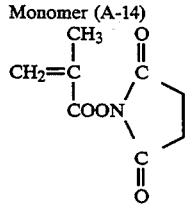

PREPARATION EXAMPLES 27 TO 36 OF RESIN GRAIN: Resin Grains (L-27) to (L-36)

Each of the resin grains was prepared in the same manner as described in Preparation Example 26 of Resin Grain except for using each of the dispersion stabilizing resin shown in Table 14 below in place of Dispersion Stabilizing Resin (M-27). An average grain diameter of each grain was in a range of from 0.20 to 0.25.

TABLE 14

| Preparation Example of Resin Grain | Resin Grain | Disperison Stabilizing Resin |
|---|---|---|
| 27 | L-27 | M-5 |
| 28 | L-28 | M-8 |
| 29 | L-29 | M-12 |
| 30 | L-30 | M-15 |
| 31 | L-31 | M-22 |
| 32 | L-32 | M-24 |
| 33 | L-33 | M-30 |
| 34 | L-34 | M-31 |
| 35 | L-35 | M-34 |
| 36 | L-36 | M-39 |

PREPARATION EXAMPLES 37 TO 42 OF RESIN GRAIN: Resin Grains (L-37) to (L-42)

Each of the resin grains was prepared in the same manner as described in Preparation Example 25 of Resin Grain except for using each of the compounds shown in Table 15 below in place of Monomer (A-12), acrylamide and methyl ethyl ketone as a reaction solvent. An average grain diameter of each grain was in a range of from 0.15 to 0.30.

TABLE 15

| Preparation Example of Resin Grain | Resin Grain | Monomer (A) | Other Monomer | Reaction Solvent |
|---|---|---|---|---|
| 37 | L-37 | 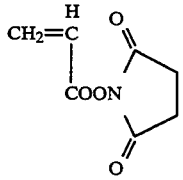 | Acrylonitrile | Methyl Ethyl Ketone |
| 38 | L-38 | 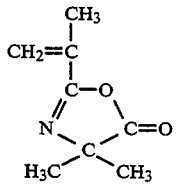 | — | Ethyl Acetate/n-Hexane (1/7 weight ratio) |
| 39 | L-39 | 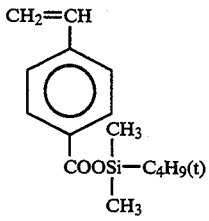 | Styrene | n-Octane |
| 40 | L-40 | 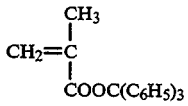 | Methyl Methacrylate | n-Octane |
| 41 | L-41 | 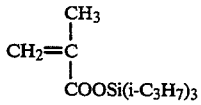 | Acrylonitrile | n-Octane |
| 42 | L-42 | 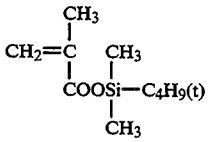 | Acrylamide | Methyl Isobutyl Ketone |

PREPARATION EXAMPLE 101 OF RESIN GRAIN: Resin Grain (L-101)

A mixed solution of 10 g of Dispersion Stabilizing Resin (P-17) and 200 g of n-octane was heated to a temperature of 60° C. with stirring under nitrogen gas stream, and a mixed solution of 47 g of Monomer (C-1) shown below, 3 g of Monomer (D-1) shown below, 10 g of ethylene glycol dimethacrylate, 0.5 g of AIVN and 240 g of n-octane was dropwise added thereto over a period of 2 hours, followed by reactiing for 2 hours. Further, 0.5 g of AIVN was added threto, followed by reacting for 2 hours. After cooling, the reaction mixture was passed through a nylon cloth of 200 mesh to obtain a white dispersion, which was a latex with an average grain diameter of 0.18 μm (grain diameter being measured by CAPA-500 manufactured by Horiba Seisakujo KK).

Monomer (C-1)

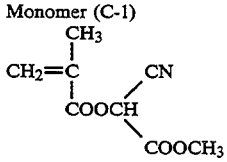

Monomer (D-1)

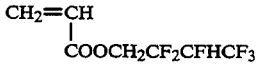

PREPARATION EXAMPLES 102 TO 112 OF RESIN GRAIN: Resin Grains (L-102) to (L--112)

The resin grains were prepared in the same manner as described in Preparation Example 101 of Resin Grain except for using the dispersion stabilizing resins and monomers shown in Table 16 below in place of Dispersion Stabilizing Resin (P-17), Monomer (C-1) and Monomer (D-1), respectively. An average grain diameter of each grain was in a range of from 0.15 to 0.30 μm.
TABLE 16
| Preparation Example of Resin Grain | Resin Grain | Dispersion Stabilizing Resin | Monomer (C) | | Monomer (D) | |
|---|---|---|---|---|---|---|
| 102 | L-102 | P-17 | 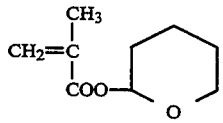 | (C-2) | 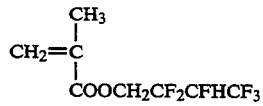 | (D-2) |
| 103 | L-103 | P-18 | 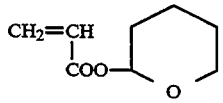 | (C-3) | 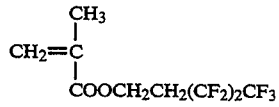 | (D-3) |
| 104 | L-104 | P-19 | 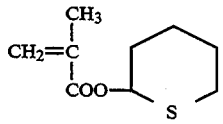 | (C-4) | 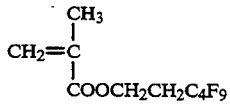 | (D-4) |
| 105 | L-105 | P-20 | 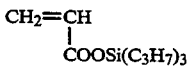 | (C-5) | 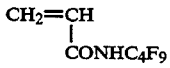 | (D-5) |
| 106 | L-106 | P-22 | 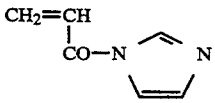 | (C-6) | 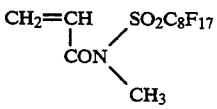 | (D-6) |
| 107 | L-107 | P-18 | 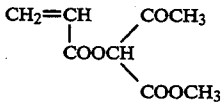 | (C-7) | 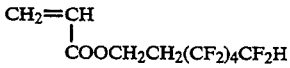 | (D-7) |
| 108 | L-108 | P-1 | 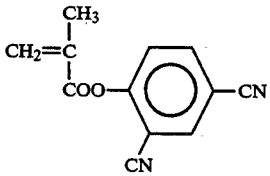 | (C-8) | 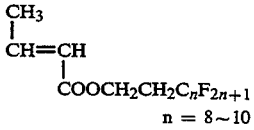 | (D-8) |
| 109 | L-109 | P-16 | 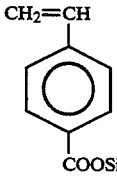 | (C-9) | 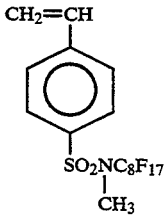 | (D-9) |
| 110 | L-110 | P-13 | 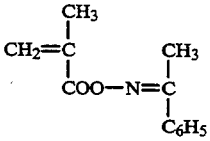 | (C-10) | 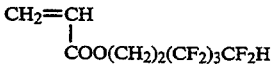 | (D-10) |
| 111 | L-111 | P-5 | 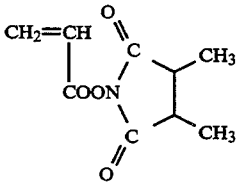 | (C-11) | 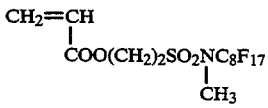 | (D-11) |

TABLE 16-continued

| Preparation Example of Resin Grain | Resin Grain | Dispersion Stabilizing Resin | Monomer (C) | Monomer (D) |
|---|---|---|---|---|
| 112 | L-112 | P-8 | (C-12) 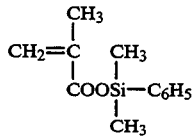 | (D-12) 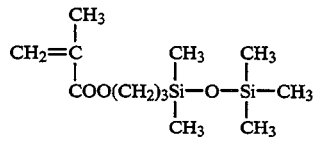 |

PREPARATION EXAMPLES 113 TO 123 OF RESIN GRAIN: Resin Grains (L-113) to (L-123)

Resin Grains (L-113) to (L-123) were prepared in the same manner as described in Preparation Example 101 of Resin Grain except for using the polyfunctional compounds shown in Table 17 below in place of 10 g of ethylene glycol dimethacrylate, respectively. Each grain had a polymerization ratio of 95 to 98% and an average grain diameter of 0.15 to 0.25 μm.

TABLE 17

| Preparation Example of Resin Grain | Resin Grain (L) | Polyfunctional Compound |
|---|---|---|
| 113 | L-113 | Trimethylolpropane Triacrylate |
| 114 | L-114 | Divinyl Benzene |
| 115 | L 115 | Diethylene Glycol Dimethacrylate |
| 116 | L-116 | Trivinylbenzene |
| 117 | L-117 | Ethylene Glycol Diacrylate |
| 118 | L-118 | Propylene Glycol Dimethacrylate |
| 119 | L-119 | Propylene Glycol Diacrylate |
| 120 | L-120 | Vinyl Methacrylate |
| 121 | L-121 | Allyl Methacrylate |
| 122 | L-122 | Trimethylolpropane Trimethacrylate |
| 123 | L-123 | Isopropenyl Itaconate |

PREPARATION EXAMPLE 124 OF RESIN GRAIN: Resin Grain (L-124)

A mixed solution of 8 g of Dispersion Stabilizing Resin (P-19) and 130 g of methyl ethyl ketone was heated to 60° C. with stirring under nitrogen gas stream, and a mixed solution of 45 g of Monomer (C-13) shown below, 5 g of Monomer (D-13) shown below, 5 g of diethylene glycol dimethacrylate, 0.5 g of AIVN and 150 g of methyl ethyl ketone was dropwise added thereto over a period of one hour. Further, 0.25 g of AIVN was added thereto, followed by reacting for 2 hours. After cooling, the reaction mixture was passed through a nylon cloth of 200 mesh to obtain a dispersion having an average grain diameter of 0.25 μm.

Monomer (C-13)

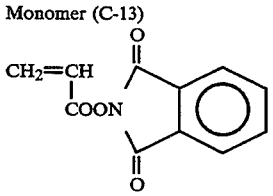

Monomer (D-13)

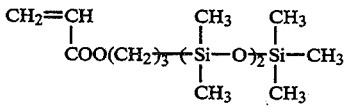

PREPARATION EXAMPLE 125 OF RESIN GRAIN: Resin Grain (L-125)

A mixed solution of 7.5 g of Dispersion Stabilizing Resin (P-22) and 230 g of methyl ethyl ketone was heated to 60° C. with stirring under nitrogen gas stream, and a mixed solution of 22 g of Monomer (C-12), 15 g of acrylamide, 0.5 g of AIVN and 200 g of methyl ethyl ketone was dropwise added thereto over a period of 2 hours, followed by reacting for one hour. Further, 0.25 g of AIVN was added thereto, followed by reacting for 2 hours. After cooling, the reaction mixture was passed through a nylon cloth of 200 mesh to obtain a dispersion having an average grain diameter of 0.25 μm.

PREPARATION EXAMPLE 126 OF RESIN GRAIN: Resin Grain (L-126)

A mixed solution of 42 g of Monomer (C-14) shown below, 8 g of Monomer (D-4), 8 g of ethylene glycol diacrylate, 8 g of Dispersion Stabilizing Resin (P-20) and 230 g of dipropyl ketone was dropwise added to 200 g of dipropyl ketone solution heated at a temperature of 60° C. under nitrogen gas stream while stirring over a period of 2 hours. After reacting for one hour, further 0.3 g of AIVN was added thereto, followed by reacting for 2 hours. After cooling, the reaction mixture was passed through a nylon cloth of 200 mesh to obtain a dispersion having an average grain diameter of 0.20 μm.

Monomer (C-14)

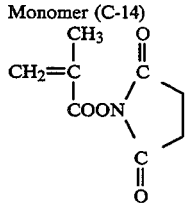

PREPARATION EXAMPLES 127 TO 136 OF RESIN GRAIN: Resin Grains (L-127) to (L-136)

Each of the resin grains was prepared in the same manner as described in Preparation-Example 126 of Resin Grain except for using each of the dispersion stabilizing resin shown in Table 18 below in place of Dispersion Stabilizing Resin (P-20). An average grain diameter of each grain was in a range of from 0.20 to 0.25 μm.

TABLE 18

| Preparation Example of Resin Grain | Resin Grain | Dispersion Stabilizing Resin |
|---|---|---|
| 127 | L-127 | P-1 |
| 128 | L-128 | P-2 |
| 129 | L-129 | P-8 |

TABLE 18-continued

| Preparation Example of Resin Grain | Resin Grain | Dispersion Stabilizing Resin |
|---|---|---|
| 130 | L-130 | P-3 |
| 131 | L-131 | P-11 |
| 132 | L-132 | P-16 |
| 133 | L-133 | P-17 |
| 134 | L-134 | P-18 |
| 135 | L-135 | P-21 |
| 136 | L-136 | P-22 |

PREPARATION EXAMPLES 137 TO 142 OF RESIN GRAIN: Resin Grains (L-137) to (L-142)

Each of the resin grains was prepared in the same manner as described in Preparation Example 125 of Resin Grain except for using each of the compounds shown in Table 19 below in place of Monomer (C-12), acrylamide and methyl ethyl ketone as a reaction solvent. An average grain diameter of each grain was in a range of from 0.15 to 0.30.

EXAMPLE 1

A mixture of 6 g (as solid basis) of Resin (A-3), 32 g (as solid basis) of Resin (B-1) shown below, 200 g of photoconductive zinc oxide, 0.018 g of Methine Dye (I) having the following structure, 0.15 g of salicylic acid, and 300 g of toluene was dispersed by a homogenizer (manufactured by Nippon Seiki K.K.) at a rotation of $7\times10^3$ r.p.m. for 10 minutes. To the dispersion were added 2 g (as solid basis) of Dispersed Resin Grain (L-5) and 0.01 g of phthalic anhydride, and the mixture was dispersed by a homogenizer at a rotation of $1\times10^3$ r.p.m. for 1 minute. The resulting coating composition for a light-sensitive layer was coated on paper, which had been subjected to electrically conductive treatment, by a wire bar at a dry coverage of 25 g/m$^2$ followed by drying at 100° C. for 30 seconds and then heating at 120° C. for 1 hour. The coated material was allowed to stand in a dark place at 20° C. and 65% RH for 24 hours to prepare an electrophotographic light-sensitive material.

TABLE 19

| Preparation Example of Resin Grain | Resin Grain | Monomer (C) | Other Monomer | Reaction Solvent |
|---|---|---|---|---|
| 137 | L-137 | 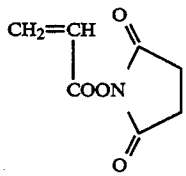 | Acrylonitrile | Methyl Ethyl Ketone |
| 138 | L-138 | 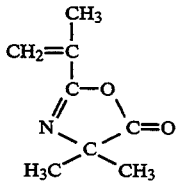 | — | Ethyl Acetate/n-Hexane (1/7 weight ratio) |
| 139 | L-139 | 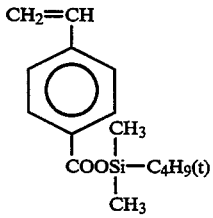 | Styrene | n-Octane |
| 140 | L-140 | 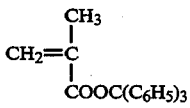 | Methyl Methacrylate | n-Octane |
| 141 | L-141 | 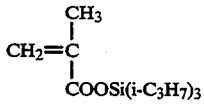 | Acrylonitrile | n-Octane |
| 142 | L-142 | 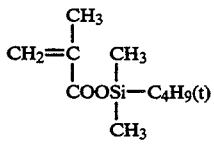 | Acrylamide | Methyl Isobutyl Ketone |

Resin (B-1)

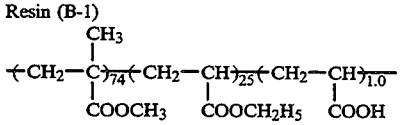

(weigh ratio)

Weight average molecular weight: $5.3 \times 10^4$

Methine Dye (I)

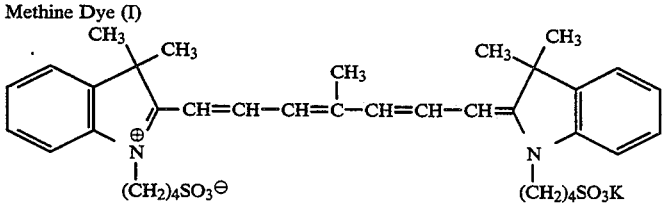

COMPARATIVE EXAMPLE A-1

An electrophotographic light-sensitive material was prepared in the same manner as described in Example 1 except that 38 g of Resin (B-1) was used alone in place of 6 g of Resin (A-3) and 32 g of Resin (B-1).

COMPARATIVE EXAMPLE B-1

Preparation of Comparative Dispersed Resin Grain (LR-1)

Comparative Dispersed Resin Grain (LR-1) was prepared in the same manner as described in Preparation Example 5 of Resin Grain except using 10 g of the resin shown below in place of 10 g of Dispersion Stabilizing Resin M-37. An average grain diameter of the latex obtained was 0.17 μm.

Comparative Dispersion Stabilizing Resin

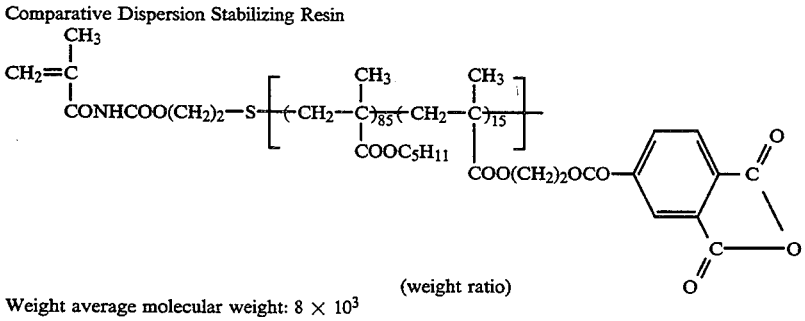

(weight ratio)

Weight average molecular weight: $8 \times 10^3$

An electrophotographic light-sensitive material was prepared in the same manner as described in Example 1 except that 2 g (as solid basis) of Resin Grain (LR-1) in place of 2 g of Resin Grain (L-5).

These light-sensitive materials were evaluated for the film property (surface smoothness), electrostatic characteristics, image forming performance, water retentivity and printing durability.

The results obtained are shown in Table 20 below.

TABLE 20

| | Example 1 | Comparative Example A-1 | Comparative Example B-1 |
|---|---|---|---|
| Smoothness of Photoconductive Layer 1) | 450 | 400 | 445 |
| Electrostatic Characteristics 2) | | | |
| $V_{10}$ (−V) | | | |
| I (20° C., 65% RH) | 630 | 570 | 630 |
| II (30° C., 80% RH) | 615 | 480 | 620 |
| D.R.R. (%) | | | |
| I (20° C., 65% RH) | 88 | 65 | 88 |
| II (30° C., 80% RH) | 84 | 40 | 85 |
| $E_{1/10}$ (erg/m$^2$) | | | |
| I (20° C., 65% RH) | 20 | 105 | 21 |
| II (30° C., 80% RH) | 25 | more than 200 | 25 |
| Image Forming Performance 3) | | | |
| I (20° C., 65% RH) | good | cutting of fine lines and letters | good |
| II (30° C., 80% RH) | good | reduced Dm cutting of fine lines and letters | good |
| Water Retentivity 4) | good | slight stain | background stain |
| Printing Durability 5) | 5,000 prints | cutting of letters from start of printing | background stain from start of printing |

The characteristic items described in Table 20 were evaluated as follows:

1) Smoothness of Photoconductive Layer

The resulting light-sensitive material was subjected to measurement of its smoothness (sec/cc) under an air volume condition of 1 cc using a Beck smoothness test machine (manufactured by Kumagaya Riko KK).

2) Electrostatic Characteristics

The light-sensitive material was subjected to corona discharge at a voltage of −6 kV for 20 seconds in a dark room using a paper analyzer (Paper Analyzer SP-428 manufactured by Kawaguchi Denki KK) and after allowed to stand for 10 seconds, the surface potential $V_{10}$ was measured. Then, the sample was further allowed to stand in the dark room for 120 seconds to measure the surface potential $V_{120}$, thus obtaining the retention of potential after the dark decay for 120 seconds, i.e., dark decay retention ratio (DRR (%)) represented by $(V_{120}/V_{10})\times 100$ (%). Moreover, the surface of the photoconductive layer was charged to −500 V by corona discharge, then irradiated with monochromatic light of a wavelength of 780 nm and the time required for decay of the surface potential ($V_{10}$) to 1/10 was measured, and the exposure amount $E_{1/10}$ (erg/cm$^2$) was calculated therefrom. The ambient conditions for the image formation were Condition I (20° C., 65% RH) and Condition II (30° C., 80% RH).

3) Image Forming Performance

The light-sensitive material was allowed to stand for a whole day and night under Condition I or Condition II. Then, the sample was charged to −5 kV, imagewise exposed at a pitch of 25 μm and a scanning speed of 330 m/sec under irradiation of 50 erg/cm$^3$ on the surface of the light-sensitive material using a gallium-aluminum-arsenic semiconductor laser (oscillation wavelength: 780 nm) with an output of 2.8 mW as a light source, developed using a full-automatic plate making machine ELP-404V (manufactured by Fuji Photo Film Co., Ltd.) with ELP-T as a liquid developer (manufactured by Fuji Photo Film Co., Ltd.) and fixed to obtain a reproduced image which was then subjected to visual evaluation of the fog and image quality.

4) Water Retentivity

A degree of hydrophilicity upon an oil-desensitizing treatment of the light-sensitive material when used as a printing plate was measured by processing under the forced condition described below.

Specifically, the light-sensitive material was (without plate making, i.e., a raw plate) was passed once through an etching processor with an aqueous solution prepared by diluting an oil-desensitizing solution ELP-EX manufactured by Fuji Photo Film Co., Ltd. by 5 times with distilled water, and then immersed in Oil-desensitizing Solution E-1 which had been prepared by diluting 0.5 moles of monoethanolamine with 1 liter of distilled water for 3 minutes.

Then, the plate was subjected to printing using a printing machine (Hamada Star 8005X manufactured by Hamada Star KK), and the 50th print from the start of printing was visually evaluated on background stain thereof.

5) Printing Durability

The light-sensitive material was subjected to plate making under the same conditions as in the above described item 3), passed once through an etching processor with ELP-EX, immersed in Oil-desensitizing Solution E-1 as described in the item 4) above for 3 minutes and washed with water. The resulting master plate for offset printing was subjected to printing using, as dampening water, a solution prepared by diluting by 5 times Oil-desensitizing Solution E-1, and a number of prints which could be obtained without the occurrence of background stains determined visually was evaluated.

As shown in Table 20, the light-sensitive materials of the present invention and Comparative Example B-1 showed excellent smoothness and electrostatic characteristics of the photoconductive layer and gave reproduced images free from background stains and excellent in image quality.

When the light-sensitive material of the present invention was used as a master plate for offset printing and the light-sensitive material without plate making was subjected to oil-desensitizing treatment under the severe conditions and printing to evaluate its water retentivity, the excellent water retentivity was recognized without the formation of background stain from the start of printing. Further, the printing plate obtained by plate making of the light-sensitive material of the present invention provided 5,000 clear prints free from background stain. On the contrary, in case of Comparative Example B-1 wherein known Comparative Resin Grain (LR-1) having no surface concentration function was used, the water retentivity was insufficient so that background stains occurred from the start of printing and could not be eliminated in subsequent printing.

On the other hand, in case of Comparative Example A-1, the electrostatic characteristics were remarkably decreased and thus the satisfactory reproduced image could not be obtained with respect to the evaluation of image forming performance. Although the water retentivity of the offset master formed was almost good, the image quality of prints practically obtained was insufficient from the start of printing due to the background stains in the non-image area and the deterioration of image quality (cutting of fine lines and letters) in the image area caused during the plate making.

Form these results, it can be seen that the electrophotographic light-sensitive material having the satisfactory electrostatic characteristics and printing properties is obtained only when both the resin (A) and the resin grain (L) according to the present invention are employed.

EXAMPLE 2

An electrophotographic light-sensitive material was prepared in the same manner as descrbed in Example 1 except for using 5.5 g (as solid basis) of Resin (A-7), 32.5 g (as solid basis) of Resin (B-2) shown below, 2 g (as solid basis) of Resin Grain (L-24) and 0.02 g of Methine Dye (II) having the following structure.

Resin (B-2)

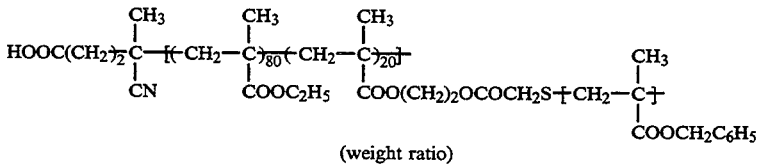

(weight ratio)

Weight average molecular weight: $9.0 \times 10^4$

Methine Dye (II)

-continued

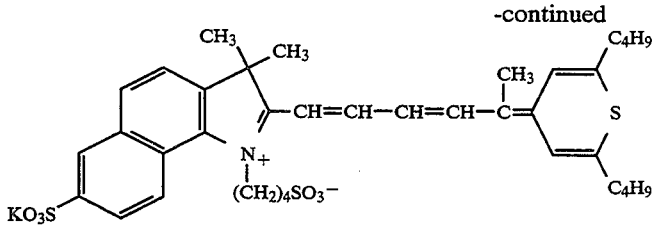

The resulting light-sensitive material was subjected to the evaluation of electrostatic characteristics, image forming performance and printing properties in the same manner as described in Example 1, and the results shown below were obtained.

| Electrostatic Characteristics (30° C., 80% RH) | |
|---|---|
| $V_{10}$ | −600 V |
| DRR | 83% |
| $E_{1/10}$ | 18 erg/cm$^2$ |
| Image Forming Performance | |
| I (20° C., 65% RH) | good |
| II (30° C., 80% RH) | good |
| Water Retentivity | very good |
| Printing Durability | 5,000 prints |

As described above, good electrostatic characteristics, image forming performance and printing properties were obtained.

EXAMPLES 3 TO 22

In the same manner as described in Example 1 except for using 5 g (as solid basis) of each of Resins (A), 2 g (as solid basis) of each of Resin Grains (L) shown in Table 21 below, 33 g of Resin (B) and 0.018 g of Methine Dye (III) having the following structures, each of light-sensitive materials was prepared.

Resin (B-3)

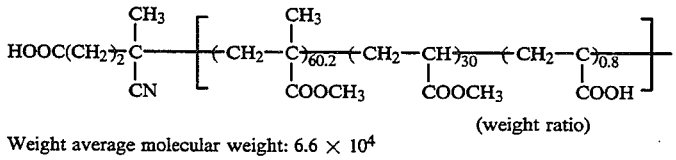

(weight ratio)

Weight average molecular weight: 6.6 × 10$^4$

Methine Dye (III)

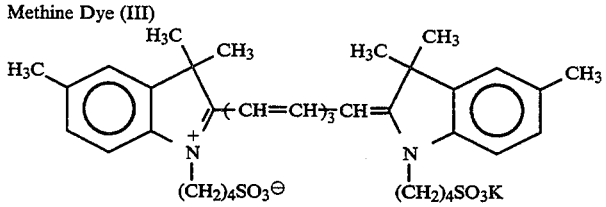

TABLE 21

| Example No. | Resin (A) | Resin Grain (L) |
|---|---|---|
| 3 | A-3 | L-1 |
| 4 | A-4 | L-2 |
| 5 | A-6 | L-3 |
| 6 | A-8 | L-5 |
| 7 | A-10 | L-6 |
| 8 | A-11 | L-7 |
| 9 | A-12 | L-8 |
| 10 | A-13 | L-9 |
| 11 | A-16 | L-11 |
| 12 | A-17 | L-12 |
| 13 | A-18 | L-14 |
| 14 | A-19 | L-15 |
| 15 | A-23 | L-16 |

TABLE 21-continued

| Example No. | Resin (A) | Resin Grain (L) |
|---|---|---|
| 16 | A-24 | L-24 |
| 17 | A-27 | L-25 |
| 18 | A-20 | L-26 |
| 19 | A-22 | L-31 |
| 20 | A-8 | L-33 |
| 21 | A-29 | L-35 |
| 22 | A-2 | L-36 |

The evaluation of the electrostatic characteristics, image forming performance and printing properties was conducted in the same manner as described in Example 1 except that Oil-desensitizing Solution E-2 having the composition shown below was employed in place of Oil-desensitizing Solution E-1 used in Example 1 for the resin grain in the evaluation of printing properties.

| Oil-desensitizing Solution E-2 | |
|---|---|
| Diethanolamine | 60 g |
| Neosoap (manufactured by Matsumoto Yushi KK) | 10 g |
| Methyl ethyl ketone | 70 g |

The above components were dissolved in distilled water to make a total volume of one liter, and pH was adjusted with potassium hydroxide to 10.5.

Each of the light-sensitive materials provided extremely good results on the electrostatic characteristics, image forming performance and printing properties equivalent to those obtained in Example 1.

EXAMPLE 23

A mixture of 5 g of Resin (A-1), 34 g of Resin (B-4) having the following structure, 1 g of Resin Grain (L-42), 200 g of zinc oxide, 0.02 g of uranine, 0.04 g of Rose Bengal, 0.03 g of bromophenol blue, 0.20 g of phthalic anhydride and 300 g of toluene was dispersed by a homogenizer at a rotation of 1×10$^4$ r.p.m. for 5 minutes to prepare a coating composition for a light-sensitive layer. The coating composition was coated on paper, which had been subjected to electrically conductive treatment, by a wire bar at a dry coverage of 22 g/m$^2$, followed by drying at 110° C. for 1 minutes. The coated material was allowed to stand in a dark place at 20° C. and 65% RH for 24 hours to prepare an electrophotographic light-sensitive material.

Resin (B-4):

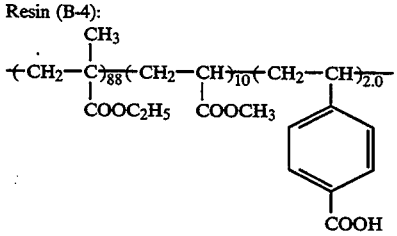

(weight ratio)

Weight average molecular weight: 5.8 × 10$^4$

COMPARATIVE EXAMPLE C-1

An electrophotographic light-sensitive material was prepared in the same manner as described in Example 23 except that 40 g of Resin (B-4) was used alone in place of 5 g of Resin (A-1) and 34 g of Resin (B-4), and that Resin Grain (L-42) was omitted.

With each of the light-sensitive materials thus prepared, each of the characteristics same as described in Example 1 was evaluated. The results obtained are shown in Table 22 below.

TABLE 22

| | | | Example 23 | Comparative Example C-1 |
|---|---|---|---|---|
| Binder Resin | | | (A-1)/(B-4) | (B-4) |
| Resin Grain | | | (L-42) | — |
| Smoothness of Photoconductive Layer (sec/cc) | | | 500 | 460 |
| Electrostatic Characteristics 6) | | | | |
| $V_{10}$ (−V) | I | (20° C., 65% RH) | 580 | 575 |
| | II | (30° C., 80% RH) | 570 | 560 |
| D.R.R. (%) | I | (20° C., 65% RH) | 92 | 88 |
| | II | (30° C., 80% RH) | 90 | 83 |
| $E_{1/10}$ | I | (20° C., 65% RH) | 8.6 | 14.8 |
| (lux/sec) | II | (30° C., 80% RH) | 9.2 | 15.2 |
| Image Forming Performance 7) | | | | |
| | I | (20° C., 65% RH) | very good | good |
| | II | (30° C., 80% RH) | very good | poor reproduction of fine lines and letters |
| Water Retentivity | | | very good | background stain |
| Printing Durability | | | 5,000 prints | background stain from start of printing |

The characteristic items described in Table 22 above were evaluated in the same manner as described in Example 1 except that the electrostatic characteristics and image forming performance were evaluated by the following procedures:

6) Measurement of Electrostatic Characteristic of $E_{1/10}$

The surface of the photoconductive layer was charged to −400 V by corona discharge and irradiated by visible light at an illuminance of 2.0 lux, and the time required to decay the surface potential ($V_{10}$) to $E_{1/10}$ was measured, from which the exposure amount $E_{1/10}$ (lux.sec) was calculated.

7) Image Forming Performance

The light-sensitive material was allowed to stand for a whole day and night under the ambient conditions shown below, and a reproduced image was formed thereon using a full-automatic plate making machine ELP-404V (manufactured by Fuji Photo Film Co., Ltd.) and ELP-T as a toner, which was then subjected to visual evaluation of the fog and image quality. The ambient conditions for the measurement of the image forming performance were Condition I (20° C., 65% RH) and Condition II (30° C., 80% RH).

As shown in Table 22 above, the light-sensitive material of the present invention exhibited the excellent electrostatic characteristics and image forming performance. On the contrary, with the light-sensitive material of Comparative Example C-1 which did not contain the resin (A), the deterioration of image quality (decrease in density and cutting of fine lines and letters) was somewhat observed, in particular, under high temperature and high humidity as a result of the evaluation of the duplicated image practically obtained by image formation, while its electrostatic characteristics had no large difference from those of the light-sensitive material of the present invention.

Further, when used as an offset master plate, the light-sensitive material of the present invention exhibited the excellent water retentivity and the printing durability of 5,000 prints. On the contrary, in case of Comparative Example C-1 in which the resin grain was omitted, the water retentivity was insufficient under the forced condition of hydrophilization, and there was no print wherein no background stain was observed when the oil-desensitizing treatment was practically conducted under conventional conditions, followed by printing.

From these results, it can be seen that the light-sensitive material of the present invention is excellent in both the electrostatic characteristics and printing properties.

EXAMPLES 24 TO 31

In the same manner as described in Example 23 except for using 5 g (as solid basis) of each of Resins (A) and 1 g (as solid basis) of each of Resin Grains (L), shown in Table 23 below, and 34 g of Resin (B-4), each of light-sensitive materials was prepared.

TABLE 23

| Example No. | Resin (A) | Resin Grain (L) |
|---|---|---|
| 24 | A-1 | L-13 |
| 25 | A-2 | L-24 |
| 26 | A-5 | L-37 |
| 27 | A-9 | L-38 |
| 28 | A-15 | L-39 |
| 29 | A-20 | L-40 |
| 30 | A-22 | L-41 |
| 31 | A-29 | L-42 |

Each of the light-sensitive materials of the present invention exhibited excellent electrostatic characteristics, dark decay retention rate and photosensitivity, and provided a clear reproduced image that was free from occurrence of background stains and cutting of fine lines even under severer conditions of high temperature and high humidity (30° C., 80% RH) by practical image formation.

When printing was carried out using as an offset master plate, 5,000 prints were obtained with a clear image without occurrence of background stains.

EXAMPLE 32

A mixture of 6 g of Resin (A-10), 29.2 g of Resin (B-5) and 4 g of Resin (B-6) having the following structures, 200 g of photoconductive zinc oxide, 0.020 g of Methine Dye (IV) having the following structure, 0.18 g of salicylic acid and 300 g of toluene was dispersed by a homogenizer at a rotation of $6\times10^3$ r.p.m. for 10 minutes. To the dispersion were added 0.8 g (as solid basis) of Resin Grain (L-26), 0.01 g of 3,3',5,5'-benzophenonetetracarboxylic acid dianhydride and 0.005 g of o-chlorophenol, and the mixture was dispersed by a homogenizer at a rotation of $1\times10^3$ r.p.m. for 1 minute. The resulting coating composition for a light-sensitive layer. The coating composition was coated on paper, which had been subjected to electrically conductive treatment, by a wire bar at a dry coverage of 25 g/m$^2$, followed by drying at 100° C. for 30 minutes and then heating at 120° C. for 1 hour. The coated material was allowed to stand in a dark place at 20° C. and 65% RH for 24 hours to prepare an electrophotographic light-sensitive material.

Resin (B-5):

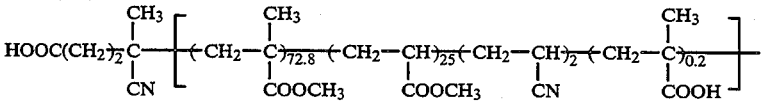

(weight ratio)

Weight average molecular weight: $6\times10^4$

Resin (B-6):

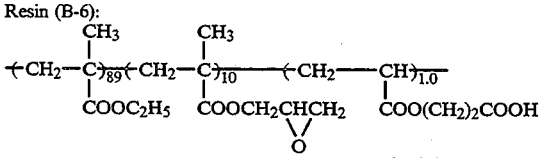

(weight ratio)

Weight average molecular weight: $4.6\times10^4$

Methine Dye (IV)

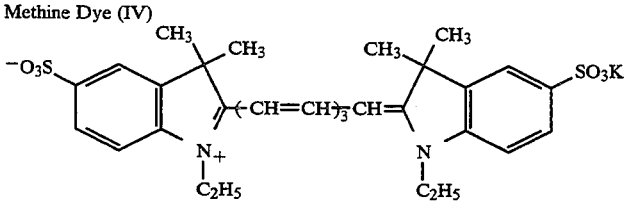

The resulting light-sensitive material was passed once through an etching processor using ELP-FX (manufactured by Fuji Photo Film Co., Ltd.), and then immersed in Oil-desensitizing Solution E-3 having the composition shown below for 5 minutes to perform oil-desensitizing treatment.

| Oil-desensitizing Solution E-3 | |
|---|---|
| Diethanolamine | 52 g |
| Newcol B4SN (manufactured by Nippon Nyukazai KK) | 10 g |
| Methyl ethyl ketone | 80 g |

These components were dissolved in distilled water to make a total volume of 1 liter, and pH was adjusted with sodium hydroxide to 10.5.

On the resulting material was placed 2 μl of a drop of distilled water and the contact angle formed between the surface and water was measured by a goniometer to obtain a contact angle-with water of not more than 10°. Before the oil-desensitizing treatment, a contact angle was 106°. This means that the surface of the light-sensitive material of the present invention was well rendered hydrophilic.

Further, the electrophotographic light-sensitive material was subjected to plate making using a full-automatic plate making machine ELP-404V (manufactured by Fuji Photo Film Co., Ltd.) with a ELP-T as developer to form a toner image and then oil-desensitizing treatment under the same condition as described above to obtain an offset master plate. The resulting printing plate was mounted on an offset printing machine (52 Type manufactured by Sakurai Seisakusho KK) to print on high quality paper using, as dampening water, a solution prepared by diluting in 50-fold Oil-desensitizing Solution E-3 with water. A number of prints which could be obtained without the occurrence of background stain in the non-image area and the deterioration of image quality in the image area of the print was 5,000.

Moreover, the light-sensitive material was allowed to stand for 3 weeks under ambient conditions of 45° C. and 75% RH and then conducted the same procedure as described above. As a result, the same results as those of the fresh sample were obtained.

EXAMPLE 33

An electrophotographic light-sensitive material was prepared in the same manner as described in Example 1 except using 2 g (as solid basis) of Resin Grain (L-10) in place of 2 g of Resin Grain (L-5).

Then, the light-sensitive material was subjected to plate making using ELP-404V with a developer ELP-T. The plate was irradiated for 5 minutes at a distance of 10 cm using a high-pressure mercury lamp of 400 W as a light source. Then, the plate was passed once through an etching machine with an oil-desensitizing solution obtained by diluting twice ELP-EX with water. The non-image area of the printing plate thus oil-desensitized was rendered sufficiently hydrophilic and exhibited the contact angle with water of not more than 10°. As a result of printing using the resulting printing plate in the same manner as described in Example 1, 5,000 prints of clear image having good quality without the occurrence of background stain were obtained.

EXAMPLES 34 TO 37

In the same manner as described in Example 32 except that 25 g of Resin (B-5) was used in place of 29.2 g of Resin (B-5) and 5 g (as solid basis) of each of Resin Grain (L) shown in Table 24 below in place of 0.8 g of Resin Grain (L-26), each of light-sensitive materials was prepared.

TABLE 24

| Example No. | Resin Grain (L) |
|---|---|
| 34 | L-7 |
| 35 | L-11 |
| 36 | L-12 |
| 37 | L-42 |

Each of these light-sensitive materials was subjected to plate making using a full-automatic plate making machine ELP-404V with a liquid developer prepared by dispersing 5 g of polymethyl methacrylate particles (having a particle size of 0.3 μm) as toner particles in one liter of Isopar H (Esso Standard Co.) and adding thereto 0.01 g of soybean oil lecithin as a charge controlling agent. The master plate for offset printing thus obtained exhibited a clear image of good quality having a density of not less than 1.0.

Further, the master plate was immersed in Oil-desensitizing Solution E-4 having the composition shown below for 30 seconds, followed by washing with water to perform an oil-desensitizing treatment.

| Oil-desensitizing Solution E-4 | |
|---|---|
| Boric acid | 55 g |
| Neosoap (manufactured by Matsumoto Yushi KK) | 8 g |
| Benzyl alcohol | 80 g |

These components were dissolved in distilled water to make a total volume of 1 liter, and pH was adjusted with sodium hydroxide to 11.0.

The non-image area of the printing plate was rendered sufficiently hydrophilic and exhibited the contact angle with distilled water of not more than 10°. As a result of printing using the resulting offset printing plate, 5,000 prints of clear image having good quality without the occurrence of background stain was obtained.

EXAMPLE 38

A mixture of 6 g (as solid basis) of Resin (A-10), 32 g (as solid basis) of Resin (B-1) described above, 200 g of photoconductive zinc oxide, 0.018 g of Methine Dye (I) described above, 0.15 g of salicylic acid, and 300 g of toluene was dispersed by a homogenizer (manufactured by Nippon Seiki K.K.) at a rotation of $7\times10^3$ r.p.m. for 10 minutes. To the dispersion were added 1.8 g (as solid basis) of Dispersed Resin Grain (L-101) and 0.01 g of phthalic anhydride, and the mixture was dispersed by a homogenizer at a rotation of $1\times10^3$ r.p.m. for 1 minute to prepare a coating composition for a light-sensitive layer. The coating composition was coated on paper, which had been subjected to electrically conductive treatment, by a wire bar at a dry coverage of 25 g/m$^2$, followed by drying at 100° C. for 30 seconds and then heating at 120° C. for 1 hour. The coated material was allowed to stand in a dark place at 20° C. and 65% RH for 24 hours to prepare an electrophotographic light-sensitive material.

COMPARATIVE EXAMPLE A-2

An electrophotographic light-sensitive material was prepared in the same manner as described in Example 38 except that 38 g of Resin (B-1) was used alone in place of 6 g of Resin (A-10) and 32 g of Resin (B-1).

COMPARATIVE EXAMPLE B-2

Preparation of Comparative Dispersed Resin Grain (LR-101)

Comparative Dispersed Resin Grain (LR-101) was prepared in the same manner as described in Preparation Example 101 of Resin Grain except for eliminating 3 g of Monomer (D-1). An average grain diameter of the latex obtained was 0.20 μm.

An electrophotographic light-sensitive material was prepared in the same manner as described in Example 38 except that 2 g (as solid basis) of Resin Grain (LR-101) was used in place of 1.8 g of Resin Grain (L-101).

With each of the light-sensitive materials thus prepared, the film property (surface smoothness), electrostatic characteristics, image forming performance, water retentivity and printing durability were evaluated in the same manner as described in Example 1.

The results obtained are shown in Table 25 below.

TABLE 25

| | Example 38 | Comparative Example A-2 | Comparative Example B-2 |
|---|---|---|---|
| Smoothness of Photoconductive Layer [1] (sec/cc) | 485 | 450 | 500 |
| Electrostatic Characteristics [2] | | | |
| $V_{10}$ (−V) | | | |
| I (20° C., 65% RH) | 680 | 570 | 685 |
| II (30° C., 80% RH) | 665 | 500 | 675 |
| D.R.R. (%) | | | |
| I (20° C., 65% RH) | 86 | 65 | 88 |
| II (30° C., 80% RH) | 82 | 48 | 84 |
| $E_{1/10}$ (erg/m$^2$) | | | |
| I (20° C., 65% RH) | 26 | 98 | 18 |
| II (30° C., 80% RH) | 29 | 110 | 21 |
| Image Forming Performance [3] | | | |
| I (20° C., 65% RH) | good | cutting of fine lines and letters | good |
| II (30° C., 80% RH) | good | reduced Dm, cutting of fine lines and letters | good |
| Water Retentivity [4a] | good | slight stain | background stain |
| Printing Durability [5a] | 5,000 prints | cutting of letters from start of printing | background stain from start of printing |

The characteristic items described in Table 25 above were evaluated in the same manner as described in Example 1 except that the water retentivity and printing durability were evaluated by the following procedures:

4a) Water Retentivity

A degree of hydrophilicity upon an oil-desensitizing treatment of the light-sensitive material when used as a printing plate was measured by processing under the forced condition described below.

Specifically, the light-sensitive material was passed, without plate making, once through an etching processor with an aqueous solution prepared by diluting an oil-desensitizing solution (ELP-EX manufactured by Fuji Photo Film Co., Ltd.) by 5 times with distilled water, and then immersed in Oil-desensitizing Solution E-5 having the composition shown below for 3 minutes. Then, the plate was subjected to printing using Hamada Star 8005X manufactured by Hamada Star KK, and the 50th print from the start of printing was visually evaluated on background stain thereof.

| Oil-desensitizing Solution E-5 | |
|---|---|
| Monoethanolamine | 60 g |
| Neosoap (manufactured by Matsumoto Yushi KK) | 8 g |
| Benzyl alcohol | 100 g |

These components were dissolved in distilled water to make a total volume of 1 liter, and pH was adjusted with potassium hydroxide to 10.5.

5a) Printing Durability

The light-sensitive material was subjected to plate making under the same conditions as in the above described item 3), passed once through an etching processor with ELP-EX, immersed in Oil-desensitizing Solution E-5 as described in the item 4a) above for 3 minutes and washed with water. The resulting printing plate was subjected to printing using, as dampening water, a solution prepared by diluting by 5 times Oil-desensitizing Solution E-5, and a number of prints which could be obtained without the occurrence of background stains determined visually was evaluated.

As shown in Table 25, the light-sensitive materials of the present invention and Comparative Example B-2 showed excellent smoothness and electrostatic characteristics of the photoconductive layer and gave reproduced images free from background stains and excellent in image quality.

When the light-sensitive material of the present invention was used as a master plate for offset printing and the light-sensitive material without plate making was subjected to oil-desensitizing treatment under the severe condition using a diluted oil-desensitizing solution and printing to evaluate its water retentivity, the excellent water retentivity was observed without formation of background stain from the start of printing. Further, the printing plate obtained by plate making of the light-sensitive material of the present invention provided 5,000 clear prints free from background stain. On the contrary, in case of Comparative Example B-1 wherein known Comparative Resin Grain (LR-101) having no surface concentration function was used, the water retentivity was insufficient so that background stains occurred from the start of printing and could not be eliminated in subsequent printing.

On the other hand, in case of Comparative Example A-2, the electrostatic characteristics were remarkably decreased, and thus the satisfactory reproduced image could not be obtained in the evaluation of image forming performance. Although the water retentivity of the offset master formed was almost good, the image quality of prints practically obtained was insufficient from the start of printing due to the background stains in the non-image area and the deterioration of image quality (cutting of fine lines and letters) in the image area caused during the plate making.

Form these results, it can be seen that the electrophotographic light-sensitive material having the satisfactory electrostatic characteristics and printing properties is obtained only when both the resin (A) and the resin grain (L) according to the present invention are employed.

EXAMPLE 39

An electrophotographic light-sensitive material was prepared in the same manner as described in Example 38 except for using 5.5 g (as solid basis) of Resin (A-7), 32.5 g (as solid basis) of Resin (B-2) described above, 2 g (as solid basis) of Resin Grain (L-124) and 0.02 g of Methine Dye (II) described above.

The resulting light-sensitive material was subjected to the evaluation of electrostatic characteristics, image forming performance and printing properties in the same manner as described in Example 38, and the results shown below were obtained.

| Electrostatic Characteristics (30° C., 80% RH) | |
|---|---|
| $V_{10}$ | −630 V |
| D.R.R. | 83% |
| $E_{1/10}$ | 28 erg/cm$^2$ |
| Image Forming Performance | |
| I (20° C., 65% RH) | good |
| II (30° C., 80% RH) | good |
| Water Retentivity | very good |
| Printing Durability | 10,000 prints |

As described above, excellent electrostatic characteristics, image forming performance and printing properties were obtained.

EXAMPLES 40 TO 59

In the same manner as described in Example 38 except for using 5 g (as solid basis) of each of Resins (A), 2 g (as solid basis) of each of Resin Grains (L) shown in Table 26 below, 33 g of Resin (B-3) described above and 0.018 g of Methine Dye (III) described above, each of light-sensitive materials was prepared.

TABLE 26

| Example No. | Resin (A) | Resin Grain (L) |
|---|---|---|
| 40 | A-3 | L-101 |
| 41 | A-4 | L-102 |
| 42 | A-6 | L-103 |
| 43 | A-7 | L-105 |
| 44 | A-8 | L-106 |
| 45 | A-11 | L-107 |
| 46 | A-12 | L-108 |
| 47 | A-13 | L-109 |
| 48 | A-16 | L-111 |
| 49 | A-17 | L-112 |
| 50 | A-18 | L-114 |
| 51 | A-19 | L-115 |
| 52 | A-23 | L-116 |
| 53 | A-24 | L-124 |
| 54 | A-27 | L-125 |
| 55 | A-20 | L-126 |
| 56 | A-22 | L-131 |
| 57 | A-29 | L-133 |
| 58 | A-30 | L-135 |
| 59 | A-33 | L-136 |

Each of these light-sensitive materials was subjected to the evaluation of the electrostatic characteristics, image forming performance and printing properties in the same manner as described in Example 38 except that Oil-desensitizing Solution E-2 described above was employed in place of Oil-desensitizing Solution E-5 used in Example 38 for the resin grain in the evaluation of printing properties.

Each of the light-sensitive materials provided extremely good results on the electrostatic characteristics, image forming performance and printing properties equivalent to those obtained in Example 38.

EXAMPLES 60 TO 62

In the same manner as described in Examples 38 except for using each of the methine dyes shown in Table 27 below in place of 0.018 mg of Methine Dye (I), each of electrophotographic light-sensitive materials was prepared.

TABLE 27

| Example No. | Methine Dye | Structure of Methine Dye |
|---|---|---|
| 60 | (V) | 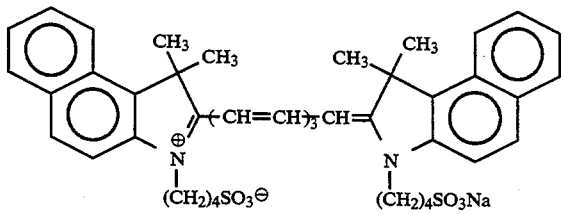 |
| 61 | (VI) | 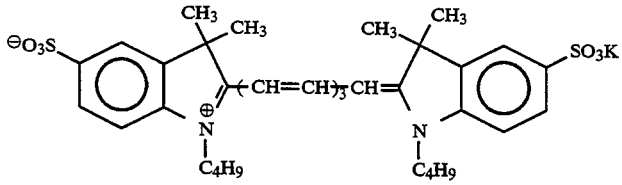 |
| 62 | (VII) | 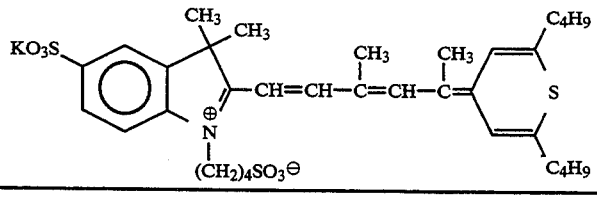 |

Each of the light-sensitive materials provided the excellent electrostatic characteristics of the present invention even under the high temperature and high humidity conditions of 30° C. and 80% RH. Further, both the image forming performance and water retentivity thereof were excellent, and when each of the material was used as an offset master plate, more than 10,000 prints of clear image of good quality free from background stain were obtained.

EXAMPLE 63

A mixture of 5 g of Resin (A-1), 34 g of Resin (B-7) shown below, 1 g of Resin Grain (L-142), 200 g of zinc oxide, 0.02 g of uranine, 0.04 g of Rose Bengal, 0.03 g of bromophenol blue, 0.20 g of phthalic anhydride and 300 g of toluene was dispersed by a homogenizer at a rotation of $6\times10^3$ r.p.m. for 10 minutes. To the dispersion were added 0.02 g of 3,3',5,5'-benzophenonetetracarboxylic acid dianhydride and 0.002 g of phenol, and the mixture was dispersed by a homogenizer at a rotation of $1\times10^3$ r.p.m. for one minute to prepare a coating composition for a light-sensitive layer. The coating composition was coated on paper, which had been subjected to electrically conductive treatment, by a wire bar at a dry coverage of 22 g/m$^2$, followed by drying at 110° C. for 1 minutes. The coated material was allowed to stand in a dark place at 20° C. and 65% RH (relative humidity) for 24 hours to prepare an electrophotographic light-sensitive material shown in Table 28 below.

Resin (B-7):

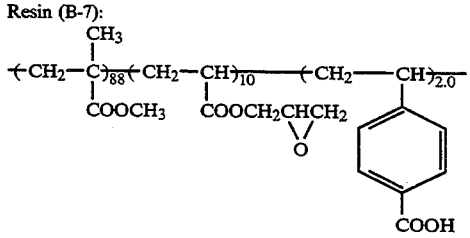

(weight ratio)

Weight average molecular weight: $5.5\times10^4$

COMPARATIVE EXAMPLE C-2

An electrophotographic light-sensitive material was prepared in the same manner as described in Example 63 except that 40 g of Resin (B-7) was used alone in place of 5 g of Resin (A-1) and 34 g of Resin (B-7) and that 1 g of Resin Grain (L-142) was omitted.

With each of the light-sensitive materials thus prepared, each of the characteristics as described in Example 38 was evaluated. The results obtained are shown in Table 28 below.

TABLE 28

| | Example 63 | Comparative Example C-2 |
|---|---|---|
| Binder Resin | (A-1)/(B-7) | (B-7) |
| Resin Grain | (L-142) | — |
| Smoothness of Photoconductive Layer (sec/cc) | 430 | 400 |

TABLE 28-continued

| | | | Example 63 | Comparative Example C-2 |
|---|---|---|---|---|
| Electrostatic Characteristics 6a) | | | | |
| $V_{10}$ (−V) | I | (20° C., 65% RH) | 585 | 550 |
| | II | (30° C., 80% RH) | 570 | 535 |
| D.R.R. (%) | I | (20° C., 65% RH) | 92 | 87 |
| | II | (30° C., 80% RH) | 90 | 85 |
| $E_{1/10}$ | I | (20° C., 65% RH) | 10.2 | 14.8 |
| (lux/sec) | II | (30° C., 80% RH) | 10.8 | 15.2 |
| Image Forming Performance 7) | | | | |
| | I | (20° C., 65% RH) | very good | good |
| | II | (30° C., 80% RH) | very good | poor reproduction of fine lines and letters |
| Water Retentivity | | | very good | background stain |
| Printing Durability | | | 5,000 prints | background stain from start of printing |

The characteristic items described in Table 28 above were evaluated in the same manner as described in Example 38 except that the image forming performance was evaluated according to the procedure of the above described item 7) and the electrostatic characteristics were evaluated by the following procedures:

6a) Measurement of Electrostatic Characteristic of $E_{1/10}$ and $E_{1/100}$

The surface of the photoconductive layer was charged to −400 V by corona discharge and irradiated by visible light at an illuminance of 2.0 lux, and the time required to decay the surface potential ($V_{10}$) to 1/10 or $E_{1/100}$, was measured, from which the exposure amount $E_{1/10}$ or $E_{1/100}$ (lux.sec) was calculated.

As shown in Table 28 above, the light-sensitive material of the present invention exhibited the excellent electrostatic characteristics and image forming performance. On the contrary, with the light-sensitive material of Comparative Example C-2 which did not contain the resin (A), the deterioration of image quality (decrease in density and cutting of fine lines and letters) was somewhat observed, in particular, under high temperature and high humidity conditions as a result of the evaluation of the duplicated image practically obtained by image formation, while no large difference was observed therebetween in electrostatic characteristics.

Further, when used as an offset master plate, the light-sensitive material of the present invention exhibited the excellent water retentivity and the printing durability of 5,000 prints. On the contrary, in case of Comparative Example C-2 in which the resin grain was omitted, the water retentivity was insufficient under the forced condition of hydrophilization, and there was no print wherein no background stain was observed when the oil-desensitizing treatment was practically conducted under conventional conditions using the light-sensitive material of Comparative Example C-2, followed by printing.

From these results, it can be seen that the light-sensitive material of the present invention is excellent in both the electrostatic characteristics and printing properties.

EXAMPLES 64 TO 71

In the same manner as-described in Example 63 except for using 5 g (as solid basis) of each of Resins (A) and 1 g (as solid basis) of each of Resin Grains (L), shown in Table 29 below, and 34 g of Resin (B-7), each of light-sensitive materials was prepared.

TABLE 29

| Example No. | Resin (A) | Resin Grain (L) |
|---|---|---|
| 64 | A-2 | L-101 |
| 65 | A-4 | L-104 |
| 66 | A-9 | L-111 |
| 67 | A-20 | L-116 |
| 68 | A-30 | L-126 |
| 69 | A-31 | L-138 |
| 70 | A-32 | L-140 |
| 71 | A-33 | L-141 |

Each of the light-sensitive materials of the present invention exhibited excellent electrostatic characteristics, dark decay retention rate and photosensitivity, and provided a clear reproduced image that was free from occurrence of background stains and cutting of fine lines even under severer conditions of high temperature and high humidity (30° C., 80% RH) by practical image formation.

When printing was carried out using as an offset master plate, 5,000 prints were obtained with a clear image without occurrence of background stains.

EXAMPLE 72

A mixture of 6 g of Resin (A-18), 29.2 g of Resin (B-5) described above, 4 g of Resin (B-8), 200 g of photoconductive zinc oxide, 0.020 g of Methine Dye (VIII) having the following structure, 0.18 g of salicylic acid and 300 g of toluene was dispersed by a homogenizer at a rotation of $6\times10^3$ r.p.m. for 10 minutes. To the dispersion were added 0.8 g (as solid basis) of Resin Grain (L-126), 0.01 g of 3,3',5,5'-benzophenonetetracarboxylic acid dianhydride and 0.005 g of o-chlorophenol, and the mixture was dispersed by a homogenizer at a rotation of $1\times10^3$ r.p.m. for 1 minute. The resulting coating composition for a light-sensitive layer was coated on paper, which had been subjected to electrically conductive treatment, by a wire bar at a dry coverage of 25 g/m$^2$, followed by drying at 100° C. for 30 seconds and then heating at 120° C. for 1 hour. The coated material was allowed to stand in a dark place at 20° C. and 65% RH for 24 hours to prepare an electrophotographic light-sensitive material.

Resin (B-8)

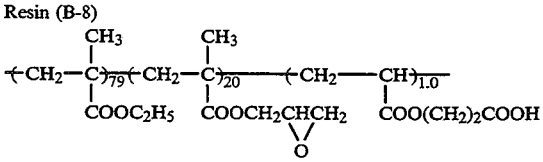

(weight ratio)

Weight average molecular weight: $4.6\times10^4$

Dye (VIII)

-continued

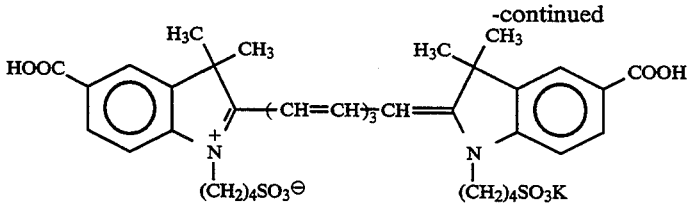

The resulting light-sensitive material was passed once through an etching processor with an oil-passed desensitizing solution ELP-FX (manufactured by Fuji Photo Film Co., Ltd.), and then immersed in Oil-desensitizing Solution E-3 described above for 5 minutes to perform an oil-desensitizing treatment.

On the resulting material was placed 2 μl of a drop of distilled water and the contact angle formed between the surface and water was measured by a goniometer to obtain a contact angle with water of not more than 10°. Before the oil-desensitizing treatment, a contact angle was 106°. This means that the surface layer of the light-sensitive material of the present invention was well rendered hydrophilic.

Further, the electrophotographic light-sensitive material was subjected to plate making using a full-automatic plate making machine ELP-404V (manufactured by Fuji Photo Film Co., Ltd.) with a liquid developer ELP-T to form a toner image and then oil-desensitizing treatment under the same condition as described above. The resulting printing plate was mounted on an offset printing machine (52 Type manufactured by Sakurai Seisakusho KK) to print on high quality paper using, as dampening water, a solution prepared by diluting by 50 times Oil-desensitizing Solution E-3 with water. A number of prints which could be obtained without the occurrence of background stain in the non-image area and the deterioration of image quality in the image area of the print was 5,000.

Moreover, the light-sensitive material was allowed to stand for 3 weeks under ambient conditions of 45° C. and 75% RH and then conducted the same procedure as described above. As a result, the same results as those of the fresh sample were obtained.

EXAMPLES 73 TO 76

Each of the electrophotographic light-sensitive materials was prepared in the same manner as described in Example 38 except for using 2 g (as solid basis) of each of Resin Grains (L) shown in Table 30 below in place of 1.8 g of Resin Grain (L-101).

TABLE 30

| Example No. | Resin Grain (L) |
|---|---|
| 73 | L-110 |
| 74 | L-111 |
| 75 | L-124 |
| 76 | L-126 |

Each of the resulting light-sensitive materials was subjected to plate making using ELP-404V with a liquid developer of ELP-T as described in Examples 38. The plate was irradiated for 5 minutes at a distance of 10 cm using a high-pressure mercury lamp of 400 W as a light source. Then, the plate was passed once through an etching machine with an oil-desensitizing solution obtained by diluting twice ELP-EX with water. The non-image area of the printing plate thus oil-desensitized was rendered sufficiently hydrophilic and exhibited the contact angle with water of not more than 10°. As a result of printing using the resulting printing plate in the same manner as described in Example 38, 10,000 prints of clear image having good quality without the occurrence of background stain were obtained.

EXAMPLES 77 TO 80

In the same manner as described in Example 72 except that 25 g of Resin (B-5) was used in place of 29.2 g of Resin (B-5) and 5 g (as solid basis) of each of Resin Grains (L) shown in Table 31 below in place of 0.8 g of Resin Grain (L-126), each of light-sensitive materials was prepared.

TABLE 31

| Example No. | Resin Grain (L) |
|---|---|
| 77 | L-104 |
| 78 | L-109 |
| 79 | L-135 |
| 80 | L-138 |

Each of these light-sensitive materials was subjected to plate making using a full-automatic plate making machine ELP-404V with a liquid developer prepared by dispersing 5 g of polymethyl methacrylate particles (having a particle size of 0.3 μm) as toner particles in one liter of Isopar H (Esso Standard Co.) and adding thereto 0.01 g of soybean oil lecithin as a charge controlling agent. The master plate for offset printing thus obtained exhibited a clear image of good quality having a density of not less than 1.0.

Further, the master plate was immersed in Oil-desensitizing Solution E-4 described above for 30 seconds, followed by washing with water to perform an oil-desensitizing treatment.

The non-image area of the printing plate was rendered sufficiently hydrophilic and exhibited the contact angle with distilled water of not more than 10°. As a result of printing using the resulting offset printing plate, 5,000 prints of clear image having good quality without the occurrence of background stain were obtained.

EXAMPLE 81

A mixture of 4 g (as solid basis) of Resin (A-104), 33 g (as solid basis) of Resin (B-1) described above, 200 g of photoconductive zinc oxide, 0.018 g of Methine Dye (I) described above, 0.15 g of salicylic acid, and 300 g of toluene was dispersed by a homogenizer (manufactured by Nippon Seiki K.K.) at a rotation of $7\times10^3$ r.p.m. for 10 minutes. To the dispersion were added 3 g (as solid basis) of Dispersed Resin Grain (L-1) and 0.01 g of phthalic anhydride, and the mixture was dispersed by a homogenizer at a rotation of $1\times10^3$ r.p.m. for 1 minute. The resulting coating composition for a light-sensitive layer was coated on paper, which had been subjected to electrically conductive treatment, by a wire bar at a dry coverage of 25 g/m$^2$, followed by drying at 100° C. for 30 seconds and then heating at 120° C. for 1 hour. The coated material was allowed to stand in a dark place at 20° C. and 65% RH for 24 hours to prepare an electrophotographic light-sensitive material.

COMPARATIVE EXAMPLE A-3

An electrophotographic light-sensitive material was prepared in the same manner as described in Example 81 except that 37 g of Resin (B-1) was used alone in place of 4 g of Resin (A-104) and 33 g of Resin (B-1).

COMPARATIVE EXAMPLE B-3

Preparation of Comparative Dispersed Resin Grain (LR-2)

The resin grain was prepared in the same manner as described in Preparation Example 1 of Resin Grain except using 10 g of the resin shown below in place of 10 g of Dispersion Stabilizing Resin M-32. An average grain diameter of the latex obtained was 0.17 μm.

Comparative Dispersion Stabilizing Resin

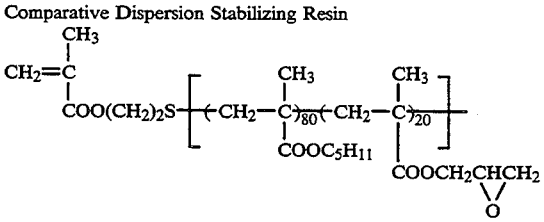

(weight ratio)

Weight average molecular weight: $8 \times 10^3$

An electrophotographic light-sensitive material was prepared in the same manner as described in Example 81 except that 3 g (as solid basis) of Resin Grain (LR-2) was used in place of 3 g of Resin Grain (L-1).

With each of the light-sensitive materials thus prepared, the film property (surface smoothness), electrostatic characteristics, image forming performance, water retentivity and printing durability were evaluated in the same manner as described in Example 1. The results obtained are shown in Table 32 below.

TABLE 32

| | Example 81 | Comparative Example A-3 | Comparative Example B-3 |
|---|---|---|---|
| Smoothness of Photoconductive Layer [1] (sec/cc) | 450 | 400 | 445 |
| Electrostatic Characteristics [2] | | | |
| $V_{10}$ (−V) | | | |
| I (20° C., 65% RH) | 690 | 570 | 695 |
| II (30° C., 80% RH) | 680 | 480 | 685 |
| D.R.R. (%) | | | |
| I (20° C., 65% RH) | 88 | 65 | 88 |
| II (30° C., 80% RH) | 85 | 40 | 85 |
| $E_{1/10}$ (erg/m$^2$) | | | |
| I (20° C., 65% RH) | 18 | 105 | 19 |
| II (30° C., 80% RH) | 20 | more than 200 | 20 |
| Image Forming Performance [3] | | | |
| I (20° C., 65% RH) | good | cutting of fine lines and letters | good |
| II (30° C., 80% RH) | good | reduced Dm, cutting of fine lines and letters | good |
| Water Retentivity [4] | good | slight stain | background stain |
| Printing Durability [5] | 5,000 prints | cutting of letters from | background stain from |

TABLE 32-continued

| | Example 81 | Comparative Example A-3 | Comparative Example B-3 |
|---|---|---|---|
| | | start of printing | start of printing |

The characteristic items described in Table 32 above were evaluated in the same manner as described in Example 1.

As shown in Table 32, the light-sensitive materials of the present invention and Comparative Example B-3 showed excellent smoothness and electrostatic characteristics of the photoconductive layer and gave reproduced images free from background stains and excellent in image quality.

When the light-sensitive material of the present invention was used as a master plate for offset printing and the light-sensitive material without plate making was subjected to oil-desensitizing treatment under the severe condition using a diluted oil-desensitizing solution and printing to evaluate its water retentivity, the excellent water retentivity was observed without the formation of background stain from the start of printing. Further, the printing plate obtained by plate making of the light-sensitive material of the present invention provided 5,000 clear prints free from background stain. On the contrary, in case of Comparative Example B-3 wherein known Comparative Resin Grain (LR-2) having no surface concentration function was used, the water retentivity was insufficient so that background stains occurred from the start of printing and could not be eliminated in subsequent printing.

On the other hand, in case of Comparative Example A-3, the electrostatic characteristics were remarkably decreased and thus the satisfactory reproduced image could not be obtained with respect to the evaluation of image forming performance. Although the water retentivity of the offset master formed was almost good, the image quality of prints practically obtained was insufficient from the start of printing due to the background stains in the non-image area and the deterioration of image quality (cutting of fine lines and letters) in the image area caused during the plate making.

Form these results, it can be seen that the electrophotographic light-sensitive material having the satisfactory electrostatic characteristics and printing properties is obtained only when both the resin (A) and the resin grain (L) according to the present invention are employed.

EXAMPLE 82

An electrophotographic light-sensitive material was prepared in the same manner as described in Example 81 except for using 5.5 g (as solid basis) of Resin (A-105), 32.5 g (as solid basis) of Resin (B-2) described above, 2 g (as solid basis) of Resin Grain (L-24) and 0.02 g of Methine Dye (II) described above.

The resulting light-sensitive material was subjected to the evaluation of electrostatic characteristics, image forming performance and printing properties in the same manner as described in Example 81, and the results shown below were obtained.

| Electrostatic Characteristics (30° C., 80% RH) | |
|---|---|
| $V_{10}$ | −680 V |
| DRR | 84% |

-continued

| | |
|---|---|
| $E_{1/10}$ | 23 erg/cm$^2$ |
| Image Forming Performance | |
| I (20° C., 65% RH) | good |
| II (30° C., 80% RH) | good |
| Water Retentivity | very good |
| Printing Durability | 5,000 prints |

As described above, excellent results were obtained in all the electrostatic characteristics, image forming performance and printing properties.

EXAMPLES 83 TO 102

In the same manner as described in Example 81 except for using 5 g (as solid basis) of each of Resins (A), 2 g (as solid basis) of each of Resin Grains (L) shown in Table 33 below, 33 g of Resin (B-3) described above and 0.018 g of Methine Dye (III) described above, each of light-sensitive materials was prepared.

TABLE 33

| Example No. | Resin (A) | Resin Grain (L) |
|---|---|---|
| 83 | A-103 | L-1 |
| 84 | A-104 | L-2 |
| 85 | A-106 | L-3 |
| 86 | A-108 | L-5 |
| 87 | A-110 | L-6 |
| 88 | A-111 | L-7 |
| 89 | A-112 | L-8 |
| 90 | A-113 | L-9 |
| 91 | A-116 | L-11 |
| 92 | A-117 | L-12 |
| 93 | A-118 | L-14 |
| 94 | A-119 | L-15 |
| 95 | A-123 | L-16 |
| 96 | A-124 | L-24 |
| 97 | A-127 | L-25 |
| 98 | A-120 | L-26 |
| 99 | A-122 | L-31 |
| 100 | A-108 | L-33 |
| 101 | A-106 | L-35 |
| 102 | A-102 | L-36 |

The evaluation of the electrostatic characteristics, image forming performance and printing properties in the same manner as described in Example 81 except that Oil-desensitizing Solution E-6 having the composition shown below was employed in place of Oil-desensitizing Solution E-1 used in Example 81 for the resin grain in the evaluation of printing properties. Oil-desensitizing Solution E-6

| Oil-desensitizing Solution E-6 | |
|---|---|
| Diethanolamine | 60 g |
| Neosoap (manufactured by Matsumoto Yushi KK) | 8 g |
| Methyl ethyl ketone | 70 g |

These components were dissolved in distilled water to make a total volume of 1 liter, and pH was adjusted with potassium hydroxide to 10.5.

Each of the light-sensitive materials provided extremely good results on the electrostatic characteristics, image forming performance and printing properties equivalent to those obtained in Example 81.

EXAMPLE 103

A mixture of 5 g of Resin (A-106), 34 g of Resin (B-4) described above, 1 g of Resin Grain (L-42), 200 g of zinc oxide, 0.02 g of uranine, 0.04 g of Rose Bengal, 0.03 g of bromophenol blue, 0.20 g of phthalic anhydride and 300 g of toluene was dispersed by a homogenizer at a rotation of $1\times10^4$ r.p.m. for 5 minutes to prepare a coating composition for a light-sensitive layer. The coating composition was coated on paper, which had been subjected to electrically conductive treatment, by a wire bar at a dry coverage of 22 g/m$^2$, followed by drying at 110° C. for 1 minutes. The coated material was allowed to stand in a dark place at 20° C. and 65% RH for 24 hours to prepare an electrophotographic light-sensitive material shown in Table 34 below.

COMPARATIVE EXAMPLE C-3

An electrophotographic light-sensitive material was prepared in the same manner as described in Example 103 except that 40 g of Resin (B-4) was used alone in place of 5 g of Resin (A-106) and 34 g of Resin (B-4) and that 1 g of Resin Grain (L-42) was omitted.

With each of the light-sensitive materials thus prepared, each of the characteristics as described in Example 81 was evaluated. The results obtained are shown in Table 34 below.

TABLE 34

| | | | Example 103 | Comparative Example C-3 |
|---|---|---|---|---|
| Binder Resin | | | (A-106)/(B-4) | (B-4) |
| Resin Grain | | | (L-42) | — |
| Smoothness of Photoconductive Layer (sec/cc) | | | 500 | 460 |
| Electrostatic Characteristics 6) | | | | |
| $V_{10}$ (−V) | I | (20° C., 65% RH) | 590 | 570 |
| | II | (30° C., 80% RH) | 580 | 555 |
| D.R.R. (%) | I | (20° C., 65% RH) | 94 | 88 |
| | II | (30° C., 80% RH) | 92 | 80 |
| $E_{1/10}$ (lux/sec) | I | (20° C., 65% RH) | 8.6 | 15.5 |
| | II | (30° C., 80% RH) | 9.2 | 16.0 |
| Image Forming Performance 7) | | | | |
| | I | (20° C., 65% RH) | very good | good |
| | II | (30° C., 80% RH) | very good | poor reproduction of fine lines and letters |
| Water Retentivity | | | very good | background stain |
| Printing Durability | | | 5,000 prints | background stain from start of printing |

The characteristic items described in Table 34 above were evaluated in the same manner as described in Example 81 except that the electrostatic characteristics and image forming performance were evaluated according to the procedures of the above described items 6) and 7).

As shown in Table 34 above, the light-sensitive material of the present invention exhibited the excellent electrostatic characteristics and image forming performance. On the contrary, with the light-sensitive material of Comparative Example C-3 which did not contain the resin (A), the deterioration of image quality (decrease in density and cutting of fine lines and letters) was somewhat observed, in particular, under high temperature and high humidity conditions as a result of the evaluation of the duplicated image practically obtained by image formation, while no large difference was observed therebetween in electrostatic characteristics.

Further, when used as an offset master plate, the light-sensitive material of the present invention exhibited the excellent water retentivity and the printing durability of 5,000 prints. On the contrary, in case of Comparative Example C-1 in which the resin grain was omitted, the water retentivity was insufficient under the forced condition of hydrophilization, and there was no print wherein no background stain was observed when the oil-desensitizing treatment was practically conducted under conventional conditions, followed by printing.

From these results, it can be seen that the light-sensitive material of the present invention is excellent in both the electrostatic characteristics and printing properties.

EXAMPLES 104 TO 111

In the same manner as described in Example 103 except for using 5 g (as solid basis) of each of Resins (A) and 1 g (as solid basis) of each of Resin Grains (L), shown in Table 35 below, and 34 g of Resin (B-4), each of light-sensitive materials was prepared.

TABLE 35

| Example No. | Resin (A) | Resin Grain (L) |
|---|---|---|
| 104 | A-101 | L-13 |
| 105 | A-102 | L-24 |
| 106 | A-105 | L-37 |
| 107 | A-109 | L-38 |
| 108 | A-115 | L-39 |
| 109 | A-120 | L-40 |
| 110 | A-122 | L-41 |
| 111 | A-127 | L-42 |

Each of the light-sensitive materials of the present invention exhibited excellent electrostatic characteristics, dark decay retention rate and photosensitivity, and provided a clear reproduced image that was free from occurrence of background stains and cutting of fine lines even under severer conditions of high temperature and high humidity (30° C., 80% RH) by practical image formation.

When printing was carried out using as an offset master plate, 5,000 prints were obtained with a clear image without occurrence of background stains.

EXAMPLE 112

A mixture of 6 g of Resin (A-109), 29.2 g of Resin (B-5) described above, 4 g of Resin (B-6) described above, 200 g of photoconductive zinc oxide, 0.020 g of Methine Dye (IV) described above, 0.18 g of salicylic acid and 300 g of toluene was dispersed by a homogenizer at a rotation of $6\times10^3$ r.p.m. for 10 minutes. To the dispersion were added 0.8 g (as solid basis) of Resin Grain (L-26), 0.01 g of 3,3',5,5'-benzophenonetetracarboxylic acid dianhydride and 0.005 g of o-chlorophenol, and the mixture was dispersed by a homogenizer at a rotation of $1\times10^3$ r.p.m. for 1 minute. The resulting coating composition for a light-sensitive layer was coated on paper, which had been subjected to electrically conductive treatment, by a wire bar at a dry coverage of 25 g/m$^2$, followed by drying at 100° C. for 30 minutes and then heating at 120° C. for 1 hour. The coated material was allowed to stand in a dark place at 20° C. and 65% RH for 24 hours to prepare an electrophotographic light-sensitive material.

The resulting light-sensitive material was passed once through an etching processor using ELP-FX (manufactured by Fuji Photo Film Co., Ltd.), and then immersed in Oil-desensitizing Solution E-3 described above for 5 minutes to perform an oil-desensitizing treatment.

On the resulting material was placed 2 μl of a drop of distilled water and the contact angle formed between the surface and water was measured by a goniometer to obtain a contact angle with water of not more than 10°. Before the oil-desensitizing treatment, a contact angle was 106°. This means that the surface layer of the light-sensitive material of the present invention was well rendered hydrophilic.

Further, the electrophotographic light-sensitive material was subjected to plate making using a full-automatic plate making machine ELP-404V (manufactured by Fuji Photo Film Co., Ltd.) with a developer ELP-T to form a toner image and then oil-desensitizing treatment under the same condition as described above to obtain an offset master plate. The resulting printing plate was mounted on an offset printing machine (52 Type manufactured by Sakurai Seisakusho KK) to print on high quality paper using, as dampening water, a solution prepared by diluting by 50 times Oil-desensitizing Solution E-3 with water. A number of prints which could be obtained without the occurrence of background stain in the non-image area and the deterioration of image quality in the image area of the print was 5,000.

Moreover, the light-sensitive material was allowed to stand for 3 weeks under ambient conditions of 45° C. and 75% RH and then treated in the same procedure as described above. As a result, the same results as those of the fresh sample were obtained.

EXAMPLE 113

An electrophotographic light-sensitive material was prepared in the same manner as described in Example 81 except using 3 g (as solid basis) of Resin Grain (L-13) in place of 3 g of Resin Grain (L-1).

Then, the light-sensitive material was subjected to plate making using ELP-404V with a developer of ELP-T in the same manner as in Example 1. The plate was irradiated for 5 minutes at a distance of 10 cm using a high-pressure mercury lamp of 400 W as a light source. Then, the plate was passed once through an etching machine with an oil-desensitizing solution obtained by diluting twice ELP-EX with water. The non-image area of the printing plate thus oil-desensitized was rendered sufficiently hydrophilic and exhibited the contact angle with water of not more than 10°. As a result of printing using the resulting printing plate in the same manner as described in Example 81, 5,000 prints of clear image having good quality without the occurrence of background stain were obtained.

EXAMPLES 114 TO 117

In the same manner as described in Example 112 except that 25 g of Resin (B-5) was used in place of 29.2 g of Resin (B-5) and 5 g (as solid basis) of each of Resin Grains (L) shown in Table 36 below in place of 0.8 g of Resin Grain (L-26), each of light-sensitive materials was prepared.

TABLE 36

| Example No. | Resin Grain (L) |
|---|---|
| 114 | L-7 |
| 115 | L-11 |
| 116 | L-12 |
| 117 | L-42 |

Each of these light-sensitive materials was subjected to plate making using a full-automatic plate making machine ELP-404V with a liquid developer prepared by dispersing 5 g of polymethyl methacrylate particles (having a particle size of 0.3 μm) as toner particles in one liter of Isopar H (by Esso Standard Co.) and adding thereto 0.01 g of soybean oil lecithin as a charge controlling agent. The master plate for offset printing thus obtained exhibited a clear image of good quality having a density of not less than 1.0.

Further, the master plate was immersed in Oil-desensitizing Solution E-4 described above for 30 seconds, followed by washing with water to perform an oil-desensitizing treatment.

The non-image area of the printing plate was rendered sufficiently hydrophilic and exhibited the contact angle with distilled water of not more than 10°. As a result of printing using the resulting offset printing plate, 5,000 prints of clear image having good quality without the occurrence of background stain was obtained.

EXAMPLE 118

A mixture of 6 g (as solid basis) of Resin (A-110), 32 g (as solid basis) of Resin (B-1) described above, 200 g of photoconductive zinc oxide, 0.018 g of Methine Dye (I) described above, 0.15 g of salicylic acid, and 300 g of toluene was dispersed by a homogenizer (manufactured by Nippon Seiki K.K.) at a rotation of $7\times10^3$ r.p.m. for 10 minutes. To the dispersion were added 1.8 g (as solid basis) of Dispersed Resin Grain (L-101) and 0.01 g of phthalic anhydride, and the mixture was dispersed by a homogenizer at a rotation of $1\times10^3$ r.p.m. for 1 minute. The resulting coating composition for a light-sensitive layer was coated on paper, which had been subjected to electrically conductive treatment, by a wire bar at a dry coverage of 25 g/m$^2$, followed by drying at 100° C. for 30 seconds and then heating at 120° C. for 1 hour. The coated material was allowed to stand in a dark place at 20° C. and 65% RH for 24 hours to prepare an electrophotographic light-sensitive material.

COMPARATIVE EXAMPLE A-4

An electrophotographic light-sensitive material was prepared in the same manner as described in Example 118 except that 38 g of Resin (B-1) was used alone in place of 6 g of Resin (A-110) and 32 g of Resin (B-1).

COMPARATIVE EXAMPLE B-4

An electrophotographic light-sensitive material was prepared in the same manner as described in Example 118 except that 2 g (as solid basis) of Resin Grain (LR-101) described above was used in-place of 1.8 g of Resin Grain (L-101).

With each of the light-sensitive materials thus prepared, the film property (surface smoothness), electrostatic characteristics, image forming performance, water retentivity and printing durability were evaluated in the same manner as described in Example 1. The results obtained are shown in Table 37 below.

TABLE 37

| | Example 118 | Comparative Example A-4 | Comparative Example B-4 |
|---|---|---|---|
| Smoothness of Photo-6conductive Layer 1) (sec/cc) | 460 | 400 | 465 |
| Electrostatic Characteristics 2) | | | |
| $V_{10}$ (−V) | | | |
| I (20° C., 65% RH) | 690 | 495 | 695 |
| II (30° C., 80% RH) | 675 | 450 | 680 |
| D.R.R. (%) | | | |
| I (20° C., 65% RH) | 85 | 63 | 84 |
| II (30° C., 80% RH) | 81 | 45 | 80 |

TABLE 37-continued

| | Example 118 | Comparative Example A-4 | Comparative Example B-4 |
|---|---|---|---|
| $E_{1/10}$ (erg/m$^2$) | | | |
| I (20° C., 65% RH) | 23 | 100 | 25 |
| II (30° C., 80% RH) | 28 | more than 150 | 30 |
| Image Forming Performance 3) | | | |
| I (20° C., 65% RH) | good | cutting of fine lines and letters | good |
| II (30° C., 80% RH) | good | reduced Dm, cutting of fine lines and letters | good |
| Water Retentivity 4a) | good | slight stain | background stain |
| Printing Durability 5a) | 10,000 prints | cutting of letters from start of printing | background stain from start of printing |

The characteristic items described in Table 37 above were evaluated in the same manner as described in Example 1 except that the water retentivity and printing durability were evaluated in the same manner as described in the items (4a) and (5a) above.

As shown in Table 37, the light-sensitive materials of the present invention and Comparative Example B-4 showed excellent smoothness and electrostatic characteristics of the photoconductive layer and gave reproduced images free from background stains and excellent in image quality.

When the light-sensitive material of the present invention was used as a master plate for offset printing and the light-sensitive material without plate making was subjected to oil-desensitizing treatment under the severe condition using a diluted oil-desensitizing solution and printing to evaluate its water retentivity, the excellent water retentivity was observed without formation of background stain from the start of printing. Further, the printing plate obtained by plate making of the light-sensitive material of the present invention provided 10,000 clear prints free from background stain. On the contrary, in case of Comparative Example B-4 wherein known Comparative Resin Grain (LR-101) having no surface concentration function was used, the water retentivity was insufficient so that background stains occurred from the start of printing and could not be eliminated in subsequent printing.

On the other hand, in case of Comparative Example A-4, the electrostatic characteristics were remarkably decreased and thus the satisfactory reproduced image could not be obtained with respect to the evaluation of image forming performance. Although the water retentivity of the offset master formed was almost good, the image quality of prints practically obtained was insufficient from the start of printing due to the background stains in the non-image area and the deterioration of image quality (cutting of fine lines and letters) in the image area caused during the plate making.

Form the above results, it can be seen that the electrophotographic light-sensitive material having the satisfactory electrostatic characteristics and printing properties is obtained only when both the resin (A) and the resin grain (L) according to the present invention are employed.

EXAMPLE 119

An electrophotographic light-sensitive material was prepared in the same manner as described in Example 118 except for using 5.5 g (as solid basis) of Resin (A-106), 32.5 g (as solid basis) of Resin (B-2) described above, 2 g (as solid basis) of Resin Grain (L-124) and 0.02 g of Methine Dye (II) described above.

The resulting light-sensitive material was subjected to the evaluation of electrostatic characteristics, image forming performance and printing properties in the same manner as described in Example 118, and the results shown below were obtained.

| | |
|---|---|
| Electrostatic Characteristics (30° C., 80% RH) | |
| $V_{10}$ | −615 V |
| D.R.R. | 83% |
| $E_{1/10}$ | 29 erg/cm$^2$ |
| Image Forming Performance | |
| I (20° C., 65% RH) | good |
| II (30° C., 80% RH) | good |
| Water Retentivity | very good |
| Printing Durability | 10,000 prints |

As described above, the electrostatic characteristics, image forming performance and printing properties were found to be excellent.

EXAMPLES 120 TO 139

In the same manner as described in Example 118 except for using 5 g (as solid basis) of each of Resins (A), 2 g (as solid basis) of each of Resin Grains (L) shown in Table 38 below, 33 g of Resin (B-3) described above and 0.018 g of Methine Dye (III) described above, each of light-sensitive materials was prepared.

TABLE 38

| Example No. | Resin (A) | Resin Grain (L) |
|---|---|---|
| 120 | A-101 | L-101 |
| 121 | A-103 | L-102 |
| 122 | A-104 | L-103 |
| 123 | A-106 | L-105 |
| 124 | A-108 | L-106 |
| 125 | A-109 | L-107 |
| 126 | A-111 | L-108 |
| 127 | A-112 | L-109 |
| 128 | A-116 | L-111 |
| 129 | A-118 | L-112 |
| 130 | A-119 | L-114 |
| 131 | A-120 | L-115 |
| 132 | A-121 | L-116 |
| 133 | A-122 | L-124 |
| 134 | A-123 | L-125 |
| 135 | A-124 | L-126 |
| 136 | A-108 | L-131 |
| 137 | A-106 | L-133 |
| 138 | A-104 | L-141 |
| 139 | A-103 | L-136 |

Each of these light-sensitive materials was subjected to the evaluation of the electrostatic characteristics, image forming performance and printing properties in the same manner as described in Example 118 except that Oil-desensitizing Solution E-2 described above was employed in place of Oil-desensitizing Solution E-5 used in Example 118 for the resin grain in the evaluation of printing properties.

Each of the light-sensitive materials provided extremely good results on the electrostatic characteristics, image forming performance and printing properties equivalent to those obtained in Example 118.

EXAMPLES 140 TO 142

In the same manner as described in Examples 118 except for using each of Methine Dyes (V), (VI) and (VII) described above in place of 0.018 mg of Methine Dye (I), each of electrophotographic light-sensitive materials was prepared.

Each of the light-sensitive materials provided the excellent electrostatic characteristics of the present invention even under the high temperature and high humidity conditions of 30° C. and 80% RH. Further, both the image forming performance and water retentivity thereof were excellent, and when it was used as an offset master plate, more than 10,000 prints of clear image of good quality free from background stain were obtained.

EXAMPLE 143

A mixture of 5 g of Resin (A-101), 34 g of Resin (B-7) described above, 1 g of Resin Grain (L-107), 200 g of zinc oxide, 0.02 g of uranine, 0.04 g of Rose Bengal, 0.03 g of bromophenol blue, 0.20 g of phthalic anhydride and 300 g of toluene was dispersed by a homogenizer at a rotation of $6\times10^3$ r.p.m. for 10 minutes. To the dispersion were added 0.02 g of 3,3',5,5'-benzophenonetetracarboxylic acid dianhydride and 0.002 g of phenol, and the mixture was dispersed by a homogenizer at a rotation of $1\times10^3$ r.p.m. for one minute. The composition was coated on paper, which had been subjected to electrically conductive treatment, by a wire bar at a dry coverage of 22 g/m$^2$, followed by drying at 110° C. for 1 minutes. The coated material was allowed to stand in a dark place at 20° C. and 65% RH for 24 hours to prepare an electrophotographic light-sensitive material.

COMPARATIVE EXAMPLE C-4

An electrophotographic light-sensitive material was prepared in the same manner as described in Example 143 except that 40 g of Resin (B-7) was used in place of 5 g of Resin (A-101) and 34 g of Resin (B-7) and that Resin Grain (L-107) was omitted.

With each of the light-sensitive materials thus prepared, each of the characteristics was evaluated in the same manner as described in Example 118. The results obtained are shown in Table 39 below.

TABLE 39

| | | | Example 143 | Comparative Example C-4 |
|---|---|---|---|---|
| Binder Resin | | | (A-101)/(B-7) | (B-7) |
| Resin Grain | | | (L-107) | — |
| Smoothness of Photoconductive Layer (sec/cc) | | | 480 | 440 |
| Electrostatic Characteristics 6a) | | | | |
| $V_{10}$ (−V) | I | (20° C., 65% RH) | 600 | 570 |
| | II | (30° C., 80% RH) | 585 | 550 |
| D.R.R. (%) | I | (20° C., 65% RH) | 92 | 86 |
| | II | (30° C., 80% RH) | 90 | 83 |
| $E_{1/10}$ | I | (20° C., 65% RH) | 9.4 | 14.3 |
| (lux/sec) | II | (30° C., 80% RH) | 10.0 | 15.6 |
| Image Forming Performance 7) | | | | |
| | I | (20° C., 65% RH) | very good | good |
| | II | (30° C., 80% RH) | very good | poor reproduction of fine lines and letters |
| Water Retentivity | | | very good | background stain |
| Printing Durability | | | 5,000 prints | background stain from start of |

TABLE 39-continued

| | Example 143 | Comparative Example C-4 |
|---|---|---|
| | | printing |

The characteristic items described in Table 39 above were evaluated in the same manner as described in Example 118 except that the electrostatic characteristics and image forming performance were evaluated according to the procedure of the above described items 6a) and 7).

As shown in Table 39 above, the light-sensitive material of the present invention exhibited the excellent electrostatic characteristics and image forming performance. On the contrary, with the light-sensitive material of Comparative Example C-4 which did not contain the resin (A), the deterioration of image quality (decrease in density and cutting of fine lines and letters) was somewhat observed, in particular, under high temperature and high humidity conditions as a result of the evaluation of the duplicated image practically obtained by image formation, while its electrostatic characteristics had no large difference from those of the light-sensitive material of the present invention.

Further, when used as an offset master plate, the light-sensitive material of the present invention exhibited the excellent water retentivity and the printing durability of 5,000 prints. On the contrary, in case of Comparative Example C-4 in which the resin grain was omitted, the water retentivity was insufficient under the forced condition of hydrophilization, and there was no print wherein no background stain was observed when the oil-desensitizing treatment was practically conducted under conventional conditions, followed by printing.

From these results, it can be seen that the light-sensitive material of the present invention is excellent in both the electrostatic characteristics and printing properties.

EXAMPLES 144 TO 151

In the same manner as described in Example 143 except for using 5 g (as solid basis) of each of Resins (A) and 1 g (as solid basis) of each of Resin Grains (L), shown in Table 40 below, and 34 g of Resin (B), each of light-sensitive materials was prepared.

TABLE 40

| Example No. | Resin (A) | Resin Grain (L) |
|---|---|---|
| 144 | A-102 | L-101 |
| 145 | A-103 | L-104 |
| 146 | A-106 | L-111 |
| 147 | A-107 | L-116 |
| 148 | A-110 | L-126 |
| 149 | A-113 | L-138 |
| 150 | A-114 | L-140 |
| 151 | A-116 | L-141 |

Each of the light-sensitive materials of the present invention exhibited excellent electrostatic characteristics, dark decay retention rate and photosensitivity, and provided a clear reproduced image that was free from occurrence of background stains and cutting of fine lines even under severer conditions of high temperature and high humidity (30° C., 80% RH) by practical image formation.

When printing was carried out using as an offset master plate, 5,000 prints were obtained with a clear image without occurrence of background stains.

EXAMPLE 152

A mixture of 6 g of Resin (A-118), 29.2 g of Resin (B-5) described above, 4 g of Resin (B-8) described above, 200 g of photoconductive zinc oxide, 0.020 g of Methine Dye (VIII) described above, 0.18 g of salicylic acid and 300 g of toluene was dispersed by a homogenizer at a rotation of $6\times10^3$ r.p.m. for 10 minutes. To the dispersion were added 0.8 g (as solid basis) of Resin Grain (L-126), 0.01 g of 3,3',5,5'-benzophenonetetracarboxylic acid dianhydride and 0.005 g of o-chlorophenol, and the mixture was dispersed at a rotation of $1\times10^3$ r.p.m. for 1 minute. The resulting coating composition for a light-sensitive layer was coated on paper, which had been subjected to electrically conductive treatment, by a wire bar at a dry coverage of 25 g/m$^2$, followed by drying at 100° C. for 30 seconds and then heating at 120° C. for 1 hour. The coated material was allowed to stand in a dark place at 20° C. and 65% RH for 24 hours to prepare an electrophotographic light-sensitive material.

The resulting light-sensitive material was passed once through an etching processor using ELP-FX (manufactured by Fuji Photo Film Co., Ltd.), and then immersed in Oil-desensitizing Solution E-3 described above for 5 minutes to perform an oil-desensitizing treatment.

On the surface thus treated was placed 2 μl of a drop of distilled water and the contact angle formed between the surface and water was measured by a goniometer to obtain a contact angle with water of not more than 10°. Before the oil-desensitizing treatment, the contact angle was 106°, indicating that the surface layer of the light-sensitive material of the present invention was well rendered hydrophilic. Further, the electrophotographic light-sensitive material was subjected to plate making using a full-automatic plate making machine ELP-404V (manufactured by Fuji Photo Film Co., Ltd.) with a developer ELP-T to form a toner image and then oil-desensitizing treatment under the same condition as described above. The resulting printing plate was mounted on an offset printing machine (52 Type manufactured by Sakurai Seisakusho KK) to print on high quality paper using, as dampening water, a solution prepared by diluting in 50-fold Oil-desensitizing Solution E-3 with water. A number of prints which could be obtained without the occurrence of background stain in the non-image area and the deterioration of image quality in the image area of the print was 5,000.

Moreover, the light-sensitive material was allowed to stand for 3 weeks under ambient conditions of 45° C. and 75% RH and then conducted the same procedure as described above. As a result, the same results as those of the fresh sample were obtained.

EXAMPLES 153 TO 156

Each of the electrophotographic light-sensitive materials was prepared in the same manner as described in Example 118 except for using 2 g (as solid basis) of each of Resin Grains (L) shown in Table 41 below in place of 1.8 g of Resin Grain (L-101).

TABLE 41

| Example No. | Resin Grain (L) |
|---|---|
| 153 | L-110 |
| 154 | L-111 |
| 155 | L-124 |
| 156 | L-126 |

Each of the resulting light-sensitive materials was subjected to plate making using ELP-404V with a developer ELP-T as described in Examples 118. The plate was irradiated for 5 minutes at a distance of 10 cm using a high-pressure mercury lamp of 400 W as a light source. Then, the plate was passed once through an etching machine with an oil-desensitizing solution obtained by diluting twice ELP-EX with water. The non-image area of the printing plate thus oil-desensitized was rendered sufficiently hydrophilic and exhibited the contact angle with water of not more than 10°. As a result of printing using the resulting printing plate in the same manner as described in Example 118, 10,000 prints of clear image having good quality without the occurrence of background stain were obtained.

EXAMPLES 157 TO 160

In the same manner as described in Example 152 except that 25 g of Resin (B-5) was used in place of 29.2 g of Resin (B-5), and 5 g (as solid basis) of each of Resin Grains (L) shown in Table 42 below in place of 0.8 g of Resin Grain ( L-126), each of light-sensitive materials was prepared.

TABLE 42

| Example No. | Resin Grain (L) |
|---|---|
| 157 | L-104 |
| 158 | L-109 |
| 159 | L-135 |
| 160 | L-138 |

Each of these light-sensitive materials was subjected to plate making using a full-automatic plate making machine ELP-404V with a liquid developer prepared by dispersing 5 g of polymethyl methacrylate particles (having a particle size of 0.3 μm) as toner particles in one liter of Isopar H (Esso Standard Co.) and adding thereto 0.01 g of soybean oil lecithin as a charge controlling agent. The master plate for offset printing thus obtained exhibited a clear image of good quality having a density of not less than 1.0.

Further, the master plate was immersed in Oil-desensitizing Solution E-4 described above for 30 seconds, followed by washing with water to perform oil-desensitizing treatment.

The non-image area of the printing plate was rendered sufficiently hydrophilic and exhibited the contact angle with distilled water of not more than 10°. As a result of printing using the resulting offset printing plate, 5,000 prints of clear image having good quality without the occurrence of background stain were obtained.

APPLICABILITY IN INDUSTRIAL FIELD

According to the present invention, the electrophotographic lithographic printing plate precursor which provides a printing plate having excellent image quality and printing durability even under severe plate making conditions can be obtained. Also the printing plate precursor is advantageously employed in the scanning exposure system using a semiconductor laser beam.

What is claimed is:

1. An electrophotographic lithographic printing plate precursor comprising a conductive support having provided thereon at least one photoconductive layer containing photoconductive zinc oxide, a spectral sensitizing dye and a binder resin, characterized in that the binder resin of the photoconductive layer comprises at least one resin (A) described below and the photoconductive layer further contains at least one non-aqueous solvent dispersed resin grain (L) described below having a grain diameter equivalent to or smaller than the maximum grain diameter of the photoconductive zinc oxide grain;

said at least one resin (A) having a weight average molecular weight of from $1\times10^3$ to $2\times10^4$ and containing at least 30% by weight of a polymer component corresponding to a repeating unit represented by formula (I) described below and from 0.5 to 15% by weight of a polymer component having at least one polar group selected from the group consisting of $-PO_3H_2$, $-SO_3H$, $-COOH$,

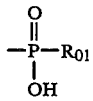

(wherein $R_{01}$ represents a hydrocarbon group or $-OR_{02}$ (wherein $R_{02}$ represents a hydrocarbon group)) and a cyclic acid anhydride-containing group;

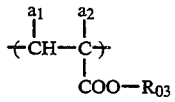

(I)

wherein $a_1$ and $a_2$ each represents a hydrogen atom, a halogen atom, a cyano group or a hydrocarbon group; and $R_{03}$ represents a hydrocarbon group;

said at least one non-aqueous solvent dispersed resin grain (L) being obtained by subjecting, to a dispersion polymerization reaction in a non-aqueous solvent, a monofunctional monomer (C) which is soluble in the non-aqueous solvent but becomes insoluble in the non-aqueous solvent by being polymerized and contains at least one functional group capable of forming at least one carboxy group upon decomposition, in the presence of a dispersion stabilizing resin which is soluble in the non-aqueous solvent, wherein the dispersion polymerization reaction is conducted under condition that the dispersion stabilizing resin contains a repeating unit having a silicon and/or fluorine atom-containing substituent and/or that a monofunctional monomer (D) which is copolymerizable with the monofunctional monomer (C) and which has a silicon and/or fluorine atom-containing substituent is additionally coexistent.

2. An electrophotographic lithographic printing plate precursor as claimed in claim 1, characterized in that the resin (A) contains, as the polymer component represented by the general formula (I), at least one methacrylate component having an aryl group represented by the following general formulae (Ia) and (Ib):

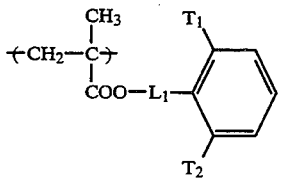

Formula (Ia)

-continued

Formula (Ib)

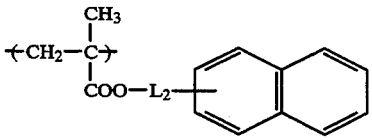

wherein $T_1$ and $T_2$ each represents a hydrogen atom, a halogen atom, a hydrocarbon group having from 1 to 10 carbon atoms, $—COR_{04}$ or $—COOR_{05}$, wherein $R_{04}$ and $R_{05}$ each represents a hydrocarbon group having from 1 to 10 carbon atoms; and $L_1$ and $L_2$ each represents a mere bond or a linking group containing from 1 to 4 linking atoms, which connects —COO— and the benzene ring.

3. An electrophotographic lithographic printing plate precursor as claimed in claim 1, characterized in that the non-aqueous solvent dispersed resin grain (L) has a network structure of high order.

4. An electrophotographic lithographic printing plate precursor as claimed in claim 1, characterized in that the dispersion stabilizing resin has at least one polymerizable double bond group moiety represented by the following general formula (II):

Formula (II)

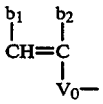

wherein $V_0$ represents —O—, —COO—, —OCO—, $—(CH_2)_p—OCO—$, $—(CH_2)p—COO—$, $—SO_2—$,

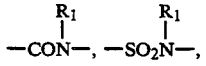

$—C_6H_4—$, —CONHCOO— or —CONHCONH— (wherein p represents an integer of from 1 to 4; and $R_1$ represents a hydrogen atom or a hydrocarbon group having from 1 to 18 carbon atoms); and $b_1$ and $b_2$, which may be the same or different, each represents a hydrogen atom, a halogen atom, a cyano group, a hydrocarbon group, $—COO—R_2—$ or $—COO—R_2$ bonded via a hydrocarbon group (wherein $R_2$ represents a hydrogen atom or a hydrocarbon group which may be substituted).

5. An electrophotographic lithographic printing plate precursor as claimed in claim 1, wherein the resin (A) contains a polymer component containing the polar group in its polymer chain, and the resin grain (L) is that obtained by a dispersion polymerization reaction in the presence of a dispersion stabilizing resin containing a repeating unit having a silicon and/or fluorine atom-containing substituent.

6. An electrophotographic lithographic printing plate precursor as claimed in claim 1, wherein the resin (A) has a polymer component containing the polar group at one terminal of its polymer chain, and the resin grain (L) is that obtained by a dispersion polymerization reaction in the presence of a dispersion stabilizing resin containing a repeating unit having a silicon and/or fluorine atom-containing substituent.

7. An electrophotographic lithographic printing plate precursor as claimed in claim 1, wherein the resin (A) contains a polymer component containing the polar group in its polymer chain, and the resin grain (L) is that obtained by a dispersion polymerization reaction coexistent with a monofunctional monomer (D) which is copolymerizable with the monofunctional monomer (C) and which has a silicon and/or fluorine atom-containing substituent.

8. An electrophotographic lithographic printing plate precursor as claimed in claim 1, wherein the resin (A) has a polymer component containing the polar group at one terminal of its polymer chain, and the resin grain (L) is that obtained by a dispersion polymerization reaction coexistent with a monofunctional monomer (D) which is copolymerizable with the monofunctional monomer (C) and which has a silicon and/or fluorine atom-containing substituent.

* * * * *